US008920024B2

(12) United States Patent
Narihara et al.

(10) Patent No.: US 8,920,024 B2
(45) Date of Patent: Dec. 30, 2014

(54) STEEL PLATE QUALITY ASSURANCE SYSTEM AND EQUIPMENT THEREOF

(75) Inventors: Koji Narihara, Chiyoda-ku (JP); Toshikazu Akita, Chiyoda-ku (JP); Yukihiro Okada, Chiyoda-ku (JP); Yutaka Wada, Chiyoda-ku (JP); Kouhei Obara, Chiyoda-ku (JP); Toru Takahashi, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 810 days.

(21) Appl. No.: 12/935,458

(22) PCT Filed: Mar. 26, 2009

(86) PCT No.: PCT/JP2009/056836

§ 371 (c)(1),
(2), (4) Date: Dec. 23, 2010

(87) PCT Pub. No.: WO2009/123273

PCT Pub. Date: Oct. 8, 2009

(65) Prior Publication Data

US 2011/0103426 A1 May 5, 2011

(30) Foreign Application Priority Data

| | | |
|---|---|---|
| Mar. 31, 2008 | (JP) | 2008-089922 |
| Oct. 27, 2008 | (JP) | 2008-275037 |
| Oct. 28, 2008 | (JP) | 2008-276236 |
| Nov. 6, 2008 | (JP) | 2008-284940 |
| Feb. 3, 2009 | (JP) | 2009-022083 |
| Feb. 3, 2009 | (JP) | 2009-022084 |

(51) Int. Cl.

| | |
|---|---|
| ***G01K 1/14*** | (2006.01) |
| ***G01K 3/06*** | (2006.01) |
| ***B21C 51/00*** | (2006.01) |
| *B21B 45/02* | (2006.01) |
| *B21B 38/00* | (2006.01) |

(52) U.S. Cl.

CPC ..... *B21C 51/00* (2013.01); *B21B 45/0218* (2013.01); *B21B 38/006* (2013.01)

USPC ..... 374/121; 374/141; 374/137; 374/167; 374/130; 374/1; 374/142; 266/87; 148/511

(58) Field of Classification Search

USPC ..... 374/141, 120, 121, 124, 137, 166, 167, 374/139, 4, 5, 29, 100, 112, 1, 45, 57; 266/78, 87, 80, 81, 96, 109, 259; 148/277, 511

See application file for complete search history.

(56) References Cited

U.S. PATENT DOCUMENTS 2,095,430 A * 10/1937 Biggert, Jr. ..... 72/201
2,105,426 A * 1/1938 McManus ..... 148/635

(Continued)

FOREIGN PATENT DOCUMENTS

JP 52-117857 10/1977
JP 04015531 A * 1/1992

(Continued)

OTHER PUBLICATIONS

International Search Report dated Jun. 23, 2009, application No. PCT/JP2009/056836.

*Primary Examiner* — Gail Kaplan Verbitsky
(74) *Attorney, Agent, or Firm* — RatnerPrestia

(57) ABSTRACT

The present invention provides a steel plate quality assurance system and facilities thereof, wherein the steel plate quality assurance system measures, with a steel plate manufacturing line including a finishing mill of a steel plate manufacturing line, and accelerated cooling equipment disposed on the downstream side of the finishing mill in the advancing direction of the steel plate manufacturing line, temperature of at least the whole area of the upper surface of a steel plate, or the whole area of the lower surface of a steel plate to perform quality assurance, and includes temperature measurement means; temperature analysis means; and mechanical property determining means.

4 Claims, 37 Drawing Sheets

(56) References Cited

U.S. PATENT DOCUMENTS

| | | | | | |
|---|---|---|---|---|---|
| 2,305,615 | A | * | 12/1942 | Goss | 148/629 |
| 2,872,173 | A | * | 2/1959 | Munker | 432/8 |
| 3,808,438 | A | * | 4/1974 | Borg et al. | 250/340 |
| 4,008,616 | A | * | 2/1977 | Murray | 374/112 |
| 4,142,713 | A | * | 3/1979 | Nakasugi et al. | 266/87 |
| 4,785,646 | A | * | 11/1988 | Uekaji et al. | 72/8.5 |
| 4,913,748 | A | * | 4/1990 | Sellitto et al. | 148/511 |
| 5,409,119 | A | * | 4/1995 | Rao Datari | 209/580 |
| 5,628,409 | A | * | 5/1997 | Thomas | 209/577 |
| 5,691,921 | A | * | 11/1997 | Berlin | 702/99 |
| 5,785,772 | A | * | 7/1998 | Deka | 148/508 |
| 6,357,911 | B1 | * | 3/2002 | Groen et al. | 374/169 |
| 6,492,625 | B1 | * | 12/2002 | Boguslavskiy et al. | 219/486 |
| 2003/0084972 | A1 | * | 5/2003 | Matsubara et al. | 148/645 |
| 2004/0011438 | A1 | * | 1/2004 | Lorentzen et al. | 148/551 |
| 2004/0081221 | A1 | * | 4/2004 | Sandvoss | 374/130 |
| 2009/0102104 | A1 | * | 4/2009 | Nakamura et al. | 266/160 |
| 2011/0240177 | A1 | * | 10/2011 | Eberlein | 148/508 |
| 2012/0104666 | A1 | * | 5/2012 | Kobayashi et al. | 266/44 |
| 2012/0216923 | A1 | * | 8/2012 | Tachibana et al. | 148/511 |
| 2012/0318414 | A1 | * | 12/2012 | Tachibana et al. | 148/567 |

FOREIGN PATENT DOCUMENTS

| | | | | |
|---|---|---|---|---|
| JP | 6-28665 | | | 4/1994 |
| JP | 6-174552 | A | | 6/1994 |
| JP | 07-041303 | | | 2/1995 |
| JP | 10-005868 | | | 1/1998 |
| JP | 11248686 | A | * | 9/1999 |
| JP | 2001-300627 | | | 10/2001 |
| JP | 2002-143913 | A | | 5/2002 |
| JP | 2005163057 | A | * | 6/2005 |
| JP | 2006-177779 | A | | 7/2006 |
| JP | 2007-211318 | A | | 8/2007 |
| WO | WO0022/423 | | * | 10/1998 |

* cited by examiner

PC : PROCESS COMPUTER

*INDIVIDUAL TEMPERATURE THRESHOLD VALUES TO BE SELECTED FROM EACH OF THERMOMETER INSTALLED POSITIONS

FIG. 20

TEMPERATURE CORRECTION VALUE ΔTw AT A WIDTH POSITION W BETWEEN POSITIONS $w_i$, $w_{i+1}$ ($i = 1, 2, \cdots$)
(EXAMPLE OF LINEAR INTERPOLATION)

$$\Delta Tw = \frac{\Delta T_{i+1} - \Delta T_i}{w_{i+1} - w_i} \times (w - w_i) + \Delta T_i$$

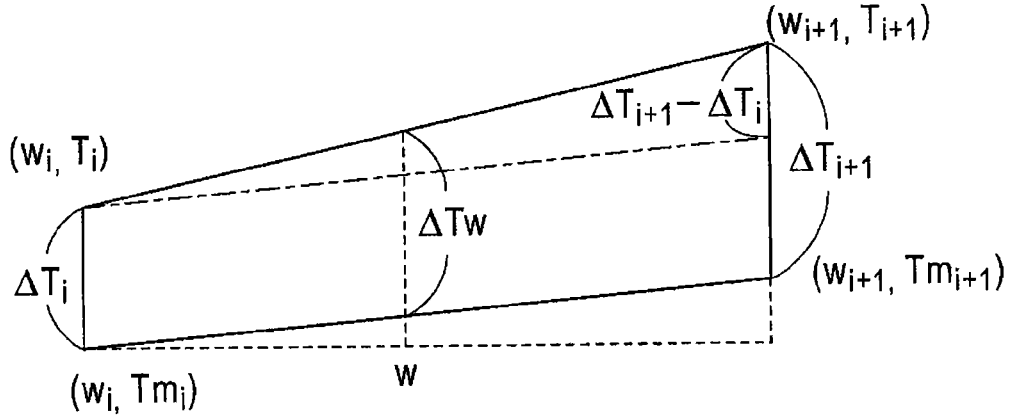

TEMPERATURE CALCULATION VALUE $T_{mw}'$ AFTER CORRECTION AT THE WIDTH POSITION W BETWEEN THE POSITIONS $w_i$ AND $w_{i+1}$
($T_{mw}$: LOWER SURFACE TEMPERATURE CALCULATION VALUE FROM UPPER SURFACE MEASUREMENT TEMPERATURE)

$$T_{mw}' = T_{mw} + \Delta T_w$$

STEEL PLATE QUALITY ASSURANCE SYSTEM AND EQUIPMENT THEREOF

CROSS-REFERENCE TO RELATED APPLICATIONS

This application is the U.S. National Phase application of PCT International Application No. PCT/JP2009/056836 filed Mar. 26, 2009, and claims priority of Japanese Patent Application Nos. 2008-089922, filed Mar. 31, 2008, 2008-275037, filed Oct. 27, 2008, 2008-276236, filed Oct. 28, 2008, 2008-284940, filed Nov. 6, 2008, 2009-022083, filed Feb. 3, 2009, and 2009-022084, filed Feb. 3, 2009, the disclosures of which applications are incorporated herein by reference in their entirety for all purposes.

FIELD OF THE INVENTION

The present invention relates to a steel plate quality assurance system and equipment thereof, and specifically relates to an arrangement suitable as a quality assurance system of the whole area of a steel plate to be subjected to controlled rolling and accelerated cooling, and equipment thereof.

BACKGROUND OF THE INVENTION

In order to manufacture a steel plate having little deformation, such as curvature deformation, by controlling TMCP (Thermo Mechanical Control Process) or internal stress for improving strength and toughness of a steel plate with microstructure as a fine structure of which the crystal grain diameter is 1 μm or so, the start temperature of controlled rolling, finishing temperature, cooling start temperature of accelerated cooling, and cooling stop temperature need to be strictly managed, and accordingly, a measurement method for measuring the temperature of a steel plate with high precision, or cooling equipment of which an innovative placement of a thermometer has been made, has been employed as a manufacturing technique or equipment.

For example, with Japanese Examined Patent Application Publication No. H7-41303, description is made wherein, with regard to cooling control equipment of hot-rolled steel plate, in order to prevent defective shape due to curvature deformation in the plate-width direction at the time of cooling, steel plate temperature is measured, cooling water flow rate from each nozzle disposed above and below of the cooling equipment, cooling start, and cooling end are strictly controlled, and an optical fiber thermometer is disposed on the downstream side of a finishing mill, and on the upstream side, downstream side and the inside of the cooling equipment. Note that hereafter, unless otherwise stated, the upstream side and the downstream side mean that as to the advancing direction (also referred to as threading direction) of a steel plate manufacturing line, placement is made on the upstream side and downstream side, respectively.

With Japanese Unexamined Patent Application Publication No. H10-5868, description is made wherein, with regard to a shape control method of a steel plate subjected to controlled cooling, a shape after cooling to normal temperature of a steel plate subjected to accelerated cooling is estimated from a shape immediately after cooling, and the temperature history of a steel plate, a thermometer for ensuring the shape of the following plate and measuring temperature of the upper and lower surfaces of a steel plate is disposed within the accelerated cooling equipment, and a temperature distribution meter (thermo-tracer) is disposed on the upper surface of the steel plate, and a thermometer is disposed on the upper surface of the steel plate immediately after the accelerated cooling equipment.

With Japanese Unexamined Patent Application Publication No. 2001-300627, description is made wherein, with regard to a steel plate cooling method, in order to realize improvement in the flatness of a steel plate shape, and uniformity of quality, controlled cooling is performed by suppressing scale thickness variance to 10 μm or less by descaling or application of a surface coating film after finishing rolling, and a radiation thermometer is disposed on the upstream side of the controlled cooling equipment as a surface thermometer.

Also, with Japanese Unexamined Patent Application Publication No. S52-117857, a method is described wherein temperature distributions in the rolling direction and the plate width direction are measured only on the downstream side of the final finishing rolling, temperature difference as to a required value is obtained, and with this as an index, a portion deviating from this temperature difference index is discarded.

Incidentally, recently, with regard to heat-treated material (particularly, high nickel steel of which the quality sensitivity as to deviation of manufacturing conditions is high), manufacturing has been made by the direct quenching method, and there are more applications of TMCP for streamlining. Also, heretofore, the quality of a steel plate has passed by assuring a part thereof such as a central portion in the width direction, but the number of user requests for quality assurance of the whole area of a product plate has increased. Also, the strictness of requests thereof has been increasing year by year.

Also, with a line pipe base plate, shipbuilding material, and so forth, a nonconventional request for assuring strength variation within a steel plate to be a particular value or less has also emerged.

On the other hand, with regard to a steel plate, during the manufacturing process thereof, the steel plate is passed through a continuous reheating furnace, a roughing mill, a finishing mill, a descaling device, an accelerated cooling equipment, and so forth, and accordingly, temperature distribution on the plate surface or in the plate thickness direction readily becomes uneven, and as a result, the quality also readily becomes uneven. Accordingly, in many conventional cases, for example, quality determination has been made wherein according to a radiation thermometer attached above a transportation line, temperature of the central portion in the plate-width direction of the steel plate is continuously measured in the rolling direction, and in the event that the temperature measurement only on the central portion thereof is included in a allowable temperature range, the quality determination of the whole steel plate is passed, and in the event of deviating from the allowable temperature range, the quality determination fails.

However, with quality determination using temperature measurement results by the above radiation thermometer, a particular portion (e.g., temperature of the central portion in the width direction of a steel plate) is measured by a radiation thermometer attached on the upper surface of the steel plate in the center in the transportation line width direction, the measurement temperature thereof and each of the management temperature ranges are compared, the quality determination is carried out only for the particular portion, and accordingly, the quality assurance of the full length and full width (whole area) is insufficient.

However, the quality of a steel plate is changed by the structure thereof being changed due to conditions such as controlled rolling, accelerated cooling, and so forth, and particularly, it has been known that of the conditions, the temperature of a steel plate has a great impact on the quality thereof, and with a conventional method described in the above Japanese Unexamined Patent Application Publication No. S52-117857, even when a temperature history of a steel plate during rolling receives is changed, temperature is evaluated only on the downstream side of the final finishing rolling, and accordingly, if determination is made with temperature difference on the downstream side of this finishing rolling, there are many cases deviating from the quality originally assured regarding partially collected products from the large plate of a steel plate, and sufficient quality assurance cannot be realized, which causes major concerns. Also, as described in an embodiment of Japanese Examined Patent Application Publication No. H7-41303, the temperature of any one surface of the upper surface of a steel plate, or the lower surface of a steel plate is measured, and accordingly, with regard to an extremely-thick steel plate having great plate thickness, there are cases where evaluation cannot be performed regarding the difference between the temperature of the upper surface of the steel plate, and the temperature of the lower surface of the steel plate, demand has also been strong regarding quality assurance in the plate thickness direction.

Also, a steel plate such as a pipe plate is manufactured in large quantities by the same manufacturing conditions, and accordingly, with a conventional method for determining various types of quality with test specimens collected from each position of the front end, middle, and tail end, in the rolling direction, there are cases where it takes several days after the test specimens of a steel plate are collected, and if determination were to become impossible, all steel plates manufactured during the period thereof might fail, resulting in massive defective plates.

Also, quality variance equivalent to temperature variance is taken into consideration, and with a quality design, in order to provide a margin as to the lower limit specifications of material property (e.g., mechanical property), extra alloying elements need to be added, and manufacturing cost becomes expensive. Further, the target temperature range of acceptance/rejection is narrowed, and accordingly, there is a problem such that a material having strict quality specifications cannot be manufactured with an accelerated cooling process after rolling.

Therefore, the present invention provides a steel plate online quality assurance system capable of rapidly determining the quality of a steel plate subjected to finishing rolling and accelerated cooling to assure the quality thereof.

Also, a steel plate quality assurance system is provided for accurately measuring steel plate temperature on a manufacturing line to evaluate uniformity of quality by predicting quality within the plate surface of a steel plate from the obtained temperature distribution.

Also, steel plate quality assurance equipment is provided that is capable of operating control for improving quality uniformity in the plate thickness direction of a steel plate and within the steel plate surface by suitably disposing a thermometer for measuring steel plate temperature in a steel plate manufacturing line.

Also, a steel plate quality assurance method is provided wherein steel plate temperature is measured in the manufacturing line, the temperature of the whole area of the upper and lower surfaces of a steel plate is calculated from the measured steel plate temperature, and based on the temperature of the calculated whole area, quality within the plate surface of a steel plate is evaluated, and the quality thereof is determined and assured.

SUMMARY OF THE INVENTION

Benefits according to aspects of the present invention may be achieved by the following means.

1. A steel plate quality assurance system configured to measure, with a steel plate manufacturing line including a finishing mill of a steel plate manufacturing line, and accelerated cooling equipment disposed on the downstream side of the finishing mill in the advancing direction of a steel plate manufacturing line, the temperature of at least the whole area of the upper surface of a steel plate or the whole area of the lower surface of a steel plate to perform quality assurance, the quality assurance system including: temperature measurement means; temperature analysis means; and mechanical property determining means; with the temperature measurement means including a thermometer disposed on at least the upstream side or downstream side of the finishing mill, and/or at least the upstream side or downstream side of the accelerated cooling equipment, and temperature collecting means is configured to collect temperature measured by the thermometer; with the temperature analysis means creates a temperature MAP of the whole area of a steel plate from the temperature collected by the temperature collecting means; and with the mechanical property determining means estimating the material property of the whole area of a steel plate from the temperature MAP to perform judgment of acceptance.

2. The steel plate quality assurance system according to the item 1 above, wherein the temperature analysis means uses a temperature measurement value collected by the temperature collecting means to create at least a temperature MAP of the whole area of the upper surface of this steel plate, or a temperature MAP of the whole area of the lower surface of a steel plate to perform judgment of acceptance of the material of this steel plate from this temperature MAP, and an individual temperature threshold value to be selected from each thermometer installation position set according to this temperature MAP. Note here that the temperature MAP is the surface temperature of the upper and lower surfaces of a steel plate, or a temperature distribution map within a steel plate in the thickness direction.

3. The steel plate quality assurance system according to the temperature history of a steel plate according to the item 1 above, wherein the temperature analysis means use a temperature measurement value collected by the temperature collecting means to create at least a temperature MAP of the whole area of the upper surface of this steel plate, or a temperature MAP of the whole area of the lower surface of a steel plate to perform judgment of acceptance of the material of this steel plate from this temperature MAP, a temperature history of this steel plate obtained with creation of this temperature MAP, and an allowable range set according to this temperature history.

4. The steel plate online quality assurance system according to the item 1 above, wherein the temperature analysis means include a calculation model of a mechanical property configured to refer to the temperature of a steel plate to predict the quality thereof, use a temperature measurement value collected by the temperature collecting means to create at least a temperature MAP of the whole area of the upper surface of this steel plate, or a temperature MAP of the whole area of the lower surface of a steel plate to perform judgment of acceptance of the material of this steel plate from this temperature MAP and prediction results by the calculation model of the mechanical property.

5. The steel plate quality assurance system according to item 1 or 2 above wherein, with the item 1 above, at the time of estimating the material property of the whole area of a steel plate from the temperature MAP, a database-type calculation model of the mechanical property is employed.

6. The steel plate online quality assurance system according to any one of the item 1 through 4 above, wherein a temperature measurement value collected by the temperature collecting means is used to create a temperature MAP of the whole area of the upper surface of this steel plate, a temperature MAP of the whole area of the lower surface of a steel plate, and a temperature MAP of a certain position in the plate-thickness direction to perform judgment of acceptance of the quality of this steel plate from these temperature MAPs.

7. Steel plate quality assurance equipment including, with a steel plate manufacturing line including a finishing mill, and accelerated cooling equipment installed on the downstream side of the finishing mill in the advancing direction of the steel plate manufacturing line: temperature measurement means configured to measure steel plate temperature; and measured temperature analyzing means configured to analyze the measured steel plate temperature; with a scanning radiation thermometer and a spot type radiation thermometer each of which is made up of a plurality of high-temperature thermometers and low-temperature thermometers being disposed on the downstream side in the advancing direction of the steel plate manufacturing line of the accelerated cooling equipment.

8. The steel plate quality assurance equipment according to item 7 above, wherein a spot type radiation thermometer and a scanning radiation thermometer to be installed on the downstream side in the advancing direction of the steel plate manufacturing line of the accelerated cooling equipment are each made up of a plurality of a high-temperature thermometers, which measure a temperature range between 200° C. and 700° C., and low-temperature thermometers, which measure a temperature range between 50° C. and 300° C.

9. Steel plate temperature assurance equipment including, with a steel plate manufacturing line including a finishing mill, and accelerated cooling equipment disposed above a transportation line on the downstream side of the finishing mill in the advancing direction of the steel plate manufacturing line: temperature measurement means configured to measure steel plate temperature at least on the upstream side or downstream side of the finishing mill, and at least on the upstream side or downstream side of the cooling device; and measured temperature analyzing means configured to analyze the steel plate temperature measured by the steel plate temperature measurement means; with the temperature measurement means including an optical fiber radiation thermometer installed at least on the upstream side or downstream side of the finishing mill, and at least on the upstream side or downstream side of the cooling device, and installed at least on the lower surface side of the transportation line steel plate; and with the measured temperature analyzing means obtaining steel plate temperature from the temperature measured by the temperature measurement means.

10. The steel plate temperature assurance equipment according to any one of the items 7 through 9 above, wherein with the temperature measurement means, as to the advancing direction of a steel plate manufacturing line, a spot type radiation thermometer is disposed on the upstream side of the finishing mill, a spot type radiation thermometer and a scanning radiation thermometer are disposed on the downstream side of the finishing mill, and on the upstream side and downstream side of the accelerated cooling equipment above the transportation line of the steel plate manufacturing line, a spot-type optical-fiber thermometer is disposed below the transportation line at a position where the spot type radiation thermometer and scanning radiation thermometer face sandwiching the transportation line, a plurality of the spot-type optical-fiber thermometers to be disposed at a position facing the scanning radiation thermometer are disposed in the scanning direction of the scanning radiation thermometer with an appropriate interval, and the measured temperature analyzing means obtain a temperature distribution of the whole of a steel plate from temperature measured by the temperature measurement means.

11. The steel plate assurance equipment according to item 7 or 8 above, wherein as to the advancing direction of a steel plate manufacturing line, the temperature measurement means are made up of a spot type radiation thermometer to be installed above the upper surface side of a steel plate of a steel plate manufacturing line, and to be installed on the upstream side of a finishing mill, and a spot type radiation thermometer and a scanning radiation thermometer to be installed on the downstream side of a finishing mill, and the upstream side and downstream side of accelerated cooling equipment, and the measured temperature analyzing means are made up of means for obtaining a temperature distribution of the whole of a steel plate from steel plate temperature measured by each of the temperature measurement means.

12. The steel plate quality assurance equipment according to any one of the items 7 through 9 above, wherein the temperature measurement means are made up of a plurality of optical fiber radiation thermometers installed on the lower surface side of a transportation line steel plate on the downstream side of the finishing mill, and the upstream side and downstream side of the accelerated cooling equipment in the line width direction with an arbitrary interval, and the measured temperature analyzing means are made up of means for obtaining a temperature distribution of the whole of a steel plate from steel plate temperature measured by the plurality of optical fiber radiation thermometers.

13. The steel plate quality assurance equipment according to any one of the items 7 through 9 above, wherein the temperature measurement means are made up of a spot type radiation thermometer and a scanning radiation thermometer to be installed at respective positions on the downstream side of the finishing mill and on the upstream side and downstream side of accelerated cooling equipment above the upper surface side of a steel plate of a steel plate manufacturing line, an optical fiber radiation thermometer to be installed on the lower surface side of a steel plate of the steel plate manufacturing line at a position corresponding to the spot type radiation thermometer on the upper surface side of the steel plate, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

14. The steel plate quality assurance equipment according to any one of the items 7 through 9 above, wherein the temperature measurement means are made up of a spot type radiation thermometer to be installed on the upstream side of a finishing mill above the upper surface side of a steel plate of a steel plate manufacturing line, a spot type radiation thermometer and a scanning radiation thermometer to be installed at respective positions on the downstream side of a finishing mill and the downstream side of accelerated cooling equipment, an optical fiber radiation thermometer to be installed at respective positions on the downstream side of a steel plate of the steel plate manufacturing line, corresponding to the spot type radiation thermometer on the upper surface side of the steel plate, and a plurality of optical fiber radiation thermometers to be installed on the lower surface side of a steel plate of the steel plate manufacturing line at respective positions corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

15. The steel plate quality assurance equipment according to the item 7 or 8 above, wherein the temperature measurement means are made up of a spot type radiation thermometer and a scanning radiation thermometer to be installed on the downstream side of the accelerated cooling equipment above the upper surface side of a steel plate of a steel plate manufacturing line, an optical fiber radiation thermometer to be installed on the lower surface side of a steel plate of the steel plate manufacturing line at a position corresponding to the spot type radiation thermometer on the upper surface side of the steel plate, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

16. The steel plate quality assurance equipment according to the item 7 or 8 above, wherein the temperature measurement means are made up of a spot type radiation thermometer and a scanning radiation thermometer to be installed at respective positions on the upstream side and downstream side of the accelerated cooling equipment above the upper surface side of a steel plate of a steel plate manufacturing line, an optical fiber radiation thermometer to be installed on the lower surface side of a steel plate of the steel plate manufacturing line at a position corresponding to a spot type radiation thermometer on the upper surface side of the steel plate, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

17. The steel plate quality assurance equipment according to any one of the items 7 through 9 above, wherein the temperature measurement means are made up of a spot type radiation thermometer and a scanning radiation thermometer to be installed at respective positions on the downstream side of a finishing mill, and on the downstream side of accelerated cooling equipment above the upper surface side of a steel plate of a steel plate manufacturing line, an optical fiber radiation thermometer to be installed on the lower surface side of a steel plate of the steel plate manufacturing line at a position corresponding to a spot type radiation thermometer on the upper surface side of the steel plate, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

18. The steel plate quality assurance equipment according to any one of the items 7 through 9 above, wherein the temperature measurement means are made up of a spot type radiation thermometer to be installed on the upstream side of a finishing mill, above the upper surface side of a steel plate of a steel plate manufacturing line, a spot type radiation thermometer and a scanning radiation thermometer to be installed at respective positions on the upstream side and downstream side of accelerated cooling equipment, an optical fiber radiation thermometer to be installed on the lower surface side of a steel plate of the steel plate manufacturing line at a position corresponding to a spot type radiation thermometer on the upstream side of the finishing mill and on the upstream side and downstream side of the accelerated cooling equipment, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

19. The steel plate quality assurance equipment according to any one of the items 7 through 9 above, wherein the temperature measurement means are made up of a spot type radiation thermometer to be installed on the upstream side of a finishing mill, above the upper surface side of a steel plate of a steel plate manufacturing line, a spot type radiation thermometer and a scanning radiation thermometer to be installed on the downstream side of the accelerated cooling equipment, an optical fiber radiation thermometer to be installed on the lower surface side of a steel plate of the steel plate manufacturing line at a position corresponding to a spot type radiation thermometer on the upstream side of the finishing mill and on the downstream side of the accelerated cooling equipment, and a plurality of optical fiber radiation thermometers to be installed at a position corresponding to the scanning radiation thermometer in the line width direction with an arbitrary interval, and the measured temperature analyzing means are made up of means for obtaining a temperature distribution of the whole of a steel plate from steel plate temperature measured by each of the temperature measurement means.

20. The steel plate quality assurance equipment according to any one of the items 7 through 19 above, wherein the measured temperature analyzing means includes: first temperature measurement means configured to measure a surface temperature distribution of one surface side of the upper surface of a steel plate, and the lower surface of a steel plate; second temperature measurement means configured to measure surface temperature of measurement points of which the number of measurement points is smaller than measurement points to be measured by the first temperature measurement means, on a surface different from a surface to be measured by the first temperature measurement means; and means configured to calculate the surface temperature of a measurement location of the second temperature measurement means from measured temperature by the first temperature measurement means, to obtain calculation error from the difference between the calculated temperature and the measured temperature by the second temperature measurement means, and to calculate surface temperature other than the measurement locations of the second temperature measurement means using this calculation error.

21. A steel plate material determining method, wherein the material of a steel plate is determined using temperature measured by the first temperature measurement means and the second temperature measurement means, and the temperature calculated by the temperature calculating means, of the steel plate surface temperature measuring device according to the item 20 above.

22. A steel plate quality assurance method, wherein a process for removing a location not allowed by the steel plate material determining method according to the item 21 above is included in the steel plate manufacturing process.

23. A steel plate manufacturing method according to any one of the items 7 through 19, wherein, with manufacturing of the following plate, the operating condition of at least one of a heating furnace, mill, and cooling equipment is controlled to prevent defective shape based on a steel plate temperature distribution measured by the steel plate temperature assurance equipment.

24. A steel plate manufacturing method according to item 23 above, wherein in order to prevent defective shape, in the event of a heating furnace, temperature of upper and lower surface of steel plate and/or gas flow rate of upper and lower surface of steel plate within the heating furnace is controlled, and in the event of a mill, peripheral-speed of upper and lower surface of steel plate and/or descaling water flow rate is controlled, and in the event of cooling equipment, at least one of water flow rate in the plate width direction, plate length direction or water flow rate of upper and lower surface of steel plate is controlled.

According to an embodiment of the present invention, after finishing rolling, the quality and shape of a steel plate to be subjected to accelerated cooling or direct quenching may be improved across the whole area. Also, temperature acceptance of the whole area may be determined immediately after rolling, and accordingly, occurrence of extensive nonconformance may be prevented by controlling the temperature of the following steel plate thereafter, which is very effective industrially.

Also, according to an embodiment of the present invention, the quality of a steel plate subjected to finishing rolling and accelerated cooling may be determined and assured in a sure and rapid manner. That is to say, the quality of a steel plate is determined based on a temperature distribution over the whole area of the upper surface of the steel plate, and accordingly, the quality may be assured across the whole area of the steel plate. In addition, it may be determined immediately after finishing rolling and accelerated cooling whether or not the temperature of the whole area of a steel plate is included in an allowable range, and accordingly, there is provided a secondary effect wherein the temperature of a steel plate of the following plate and thereafter may be controlled with reference to this temperature, occurrence of extensive nonconformance plate may be prevented, and the steel plate may effectively be manufactured with good yield, which is very effective industrially.

Also, according to an embodiment of the present invention, quality determination may be performed online across the whole area of the upper surface and the lower surface of a steel plate. As a result thereof, with a quality design, alloying elements to be added may be reduced by reducing the margin cost of material properties, and consequently, manufacturing cost may be reduced. Also, the target temperature range may be extended, and accordingly, a material having strict quality specifications can be manufactured by an accelerated cooling process after rolling.

Further, temperature during the cooling process of test specimens to be collected from a steel plate may be managed, and accordingly, improvement in precision of a quality design, and optimization of a component design may be realized.

BRIEF DESCRIPTION OF THE DRAWINGS

FIG. 20 is a diagram illustrating a procedure example for calculating the correction value of a temperature calculation value between adjacent temperature measurement positions $w_i$, $w_{i+1}$ (i=1, 2, . . . ) on the lower surface side of a steel plate.

REFERENCE NUMERALS

Figure 1:
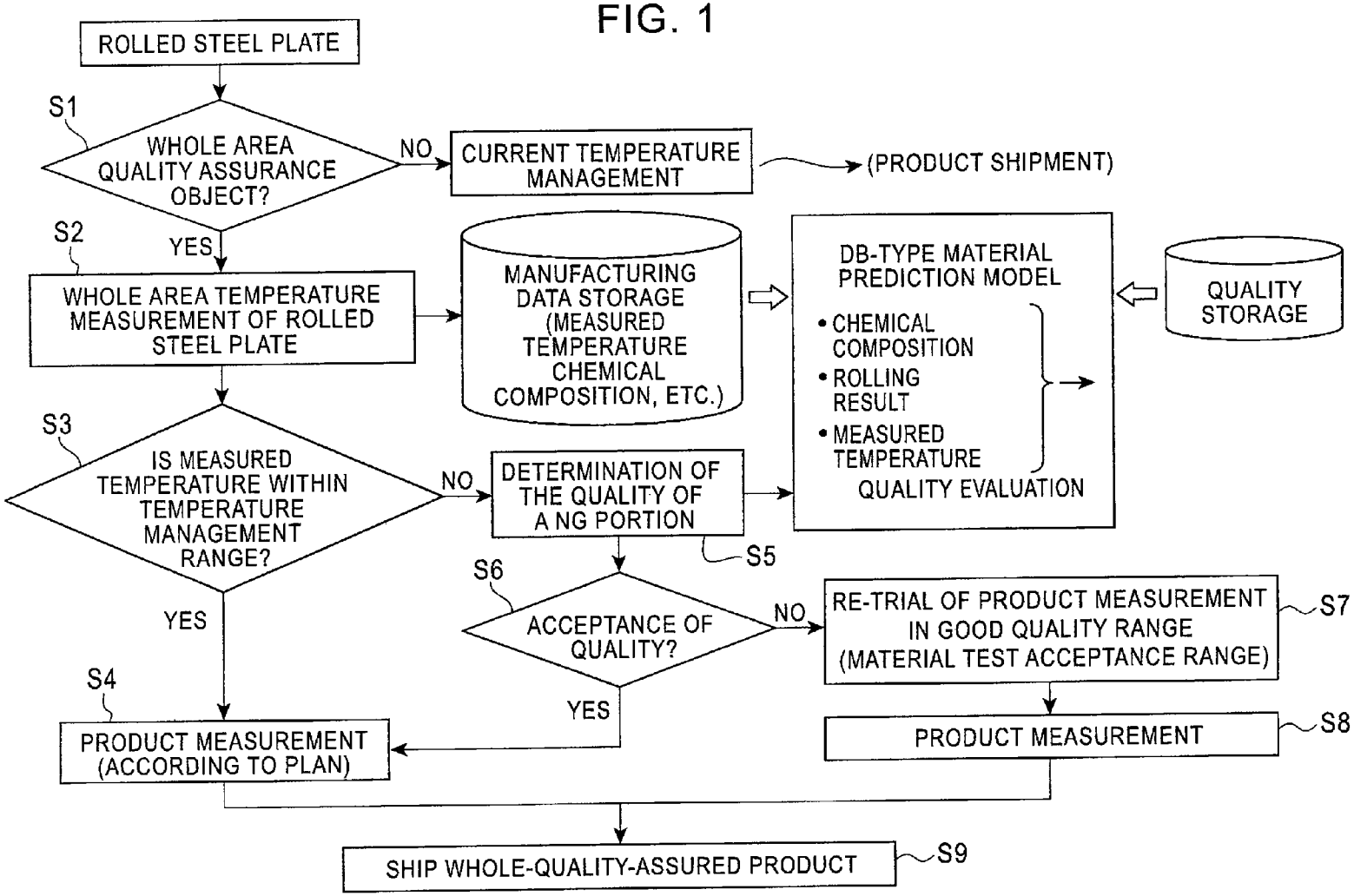
FIG. 1 is a diagram illustrating a flowchart of a quality assurance system of an embodiment of the present invention.

1: Heating furnace
2: Finishing mill
3: Steel plate
4: CR cooling shower (Controlled Rolling Cooling Shower)
5: Accelerated cooling equipment
6: Scanning radiation thermometer disposed on the upstream side of the finishing mill
6*a*, 6*b*, 6*c*, 6*d*: Scanning radiation thermometer
7: Spot type radiation thermometer disposed on the upstream side of the finishing mill
7*a*, 7*b*, 7*c*, 7*d*: Spot type radiation thermometer
8: Optical fiber radiation thermometer disposed on the lower surface of a steel plate of the upstream side of the finishing mill
8*a*, 8*b*, 8*c*, 8*d*: Two or more optical fiber radiation thermometers disposed in the width direction
11: Controlled rolling start temperature+finishing temperature collecting PC
12: Cooling start temperature collecting PC
13: Cooling stop temperature collecting PC
14, 14*a*: Measured temperature analyzing PC
15, 15*a*, 15*b*, 15*c*: Temperature collecting PC on the upper surface of a steel plate
16, 16*a*, 16*b*, 16*c*: Temperature collecting PC on the lower surface of a steel plate
17: Defective shape prevention control
18: Acceptance/rejection determining device
24: Large plate
25, 26, 27: Test plate
28, 29, 30, 31: Small plate
32, 33: Thick frame

DETAILED DESCRIPTION OF THE INVENTION

A quality assurance system according to an embodiment of the present invention includes temperature measurement means, temperature analysis means, and mechanical property determining means; a temperature MAP of the whole area of a steel plate is created by the temperature analysis means from steel plate temperature measured by the temperature measurement means, and based on the temperature MAP of the whole area of this steel plate; the quality of the whole area of the steel plate is evaluated by the mechanical property determining means.

FIG. 1 is a flowchart illustrating the outline of the quality assurance system according to an embodiment of the present invention; wherein first, determination is made whether or not rolled steel plate to be manufactured is an object plate for whole-area quality assurance (S1). Examples of an object plate for the whole-area quality assurance include a steel product of which the material is a DQ material such as line pipe base plate, shipbuilding 50K steel, DQ-type 9% Ni steel, or the like having a high manufacturing conditions sensitivity.

In the case of the whole-area quality assurance plate, the temperature measurement of the whole area of a rolled steel plate is executed using the temperature measurement means and the temperature analysis means (S2). With the quality assurance system, the temperature measurement means and the temperature analysis means are not restricted to a particular one, but means having the following configuration are suitable.

(Temperature Measurement Means and Temperature Collecting Means)

It is technically difficult to measure the temperature of the whole area of a steel plate in a manufacturing line, and accordingly, with the temperature measurement means, as thermometers, a spot type radiation thermometer and a scanning radiation thermometer are employed above a transportation line, a spot type radiation thermometer using an optical fiber (hereafter, optical fiber radiation thermometer) is employed below the transportation line, and accordingly, temperature measured by the multiple thermometers is collected, a process computer (hereafter, referred to as PC) being employed as temperature collecting means.

(Suitable Temperature Measurement Means)

With the temperature measurement means, the above thermometers are combined as appropriate, and in order to assure the temperature history of the whole area on the manufacturing line, indispensable temperature measurement positions are disposed on (1) at least the upstream side or downstream side of a finishing mill, and on (2) at least the upstream side or downstream side of cooling equipment.

Note that, with regard to the temperature of a steel plate, at least one of the upper and lower surfaces of a steel plate is measured, but in the event that temperature difference between the upper and lower surfaces of the steel plate is significant (e.g., the plate thickness of the steel plate is great), it can be conceived that the material properties of the upper and lower surfaces of the steel plate differ, and accordingly, the temperature of the steel plate is measured on the upper and lower surfaces of the steel plate. In this case, a spot type radiation thermometer and a scanning radiation thermometer are disposed above the transportation line, and a spot type radiation thermometer using an optical fiber (hereafter, referred to as optical fiber radiation thermometer) is disposed below the transportation line. Accordingly, with the steel plate manufacturing line, various thicknesses of steel plate are manufactured, but in order to perform quality assurance of these steel plates, it is desirable to dispose thermometers so as to measure temperature on the upper and lower surfaces of the steel plate.

Note that installing a thermometer on the upstream side of a finishing mill means that a thermometer is disposed at a position nearer the finishing mill than other devices, just proximal to the upstream side of the finishing mill as to the advancing direction (threading direction) of the steel plate manufacturing line. Also, installing a thermometer on the downstream side of the finishing mill means that a thermometer is disposed at a position nearer the finishing mill than other devices, just proximal to the downstream side of the finishing mill. This is true in the event of the accelerated cooling equipment. Hereafter, unless otherwise stated, the upstream side and the downstream side mean that, as to the advancing direction (also referred to as threading direction) of a steel plate manufacturing line, placement is made on the upstream side and downstream side, respectively.

(Installation of a High-Temperature Thermometer and a Low-Temperature Thermometer)

One feature of the quality assurance system equipment according to an embodiment of the present invention is that the number of spot type radiation thermometers and the number of scanning radiation thermometers to be disposed on the upstream side or downstream side of the accelerated cooling equipment for measuring a width-direction temperature distribution is a single thermometer on the upstream side, and two or more thermometers of two specifications for measurement of high-temperature and for measurement of low-temperature on the downstream side.

The steel plate temperature on the downstream side of the accelerated cooling equipment fluctuates from around 600° C. to room temperature, and in a wide range from low-temperature to high-temperature, and accordingly, temperature measurement needs to be performed in a wide range. However, with only a single existing thermometer, temperature measurement in a wide range from low-temperature to high-temperature (room temperature through 700° C. or so) cannot be performed with accurate resolution (preferably, ±5° C.). Therefore, it is desirable to install at least two types of thermometers for measurement of high-temperature and for measurement of low-temperature.

(Spot Type Radiation Thermometer)

It is desirable to dispose a spot type radiation thermometer at least on the upstream side or downstream side of the finishing mill, above the transportation line, and at least on the upstream side or downstream side of the accelerated cooling equipment.

The number of spot type radiation thermometers to be disposed on the upstream side and downstream side of the finishing mill is suitably two or more, respectively. This is because in the event that the number of thermometers is one, rolling has to be stopped when the thermometer causes abnormalities, and accordingly, if the number of thermometers is two or more, one normal thermometer may still be utilized, so with manufacturing of steel plates to be mass produced, trouble can be prevented so as not to mass produce defective plates. The installation positions of two or more thermometers thereof are not restricted to particular positions, however it is desirable to array these in the transportation direction of the steel plate.

(Scanning Radiation Thermometer)

It is desirable to dispose a scanning radiation thermometer on the upper surface of the transportation line and also on the downstream side of the finishing mill, and/or at least on the upstream side or downstream side of the accelerated cooling equipment for measuring a width-direction temperature distribution. Note that preferably, when the scanning radiation thermometer is disposed close to a spot type radiation thermometer, mutual thermometer values can be comparatively referred, and accurate measurement can be performed. Note that the finishing mill subjects a steel plate to reverse rolling, even in the event that a scanning radiation thermometer is installed on the upstream side of the finishing mill instead of the downstream side of the finishing mill, the advantage of the present invention is not changed. Accordingly, it is desirable to provide a scanning radiation thermometer on at least the upstream side or downstream side of the finishing mill.

The reason why a width-direction thermometer is installed on the downstream side of the finishing mill, and/or at least on the upstream side or downstream side of the accelerated cooling equipment is that these regions are temperature regions where the quality is greatly changed, and also a temperature distribution readily occurs in the width direction, controlled rolling start temperature+rolling finishing temperature, and steel plate temperature to be measured on at least the upstream side or downstream side of the accelerated cooling equipment have great influence on the quality, so quality uniformity needs to be assured by also performing temperature measurement in the steel plate width direction according to uniformity of the temperature of the whole of a steel plate.

Therefore, in order to realize quality uniformity across the whole area of a steel plate, temperature needs to be measured in the width direction as well.

Accordingly, a scanning radiation thermometer is installed on the downstream side (6*a*) of the finishing mill, and at least on the upstream side or downstream side (6*b*, 6*c*, 6*d*) of the accelerated cooling equipment, above the upper surface side of the steel plate of the transportation line so as to scan the width direction of the steel plate. This is because a scanning radiation thermometer is installed in the width direction, and the temperature measurement of the whole area may be performed by the steel plate being moved in the longitudinal direction. Also, preferably, it is desirable to install a scanning radiation thermometer close to a spot type radiation thermometer. Thus, a mutual check of thermometer malfunction detection may be performed, and the reliability of measured temperature can be improved.

Note that as a scanning thermometer an existing thermometer such as a spin mirror type, linear array type, or the like should be selected as appropriate in accordance with the location of temperature measurement.

Note that an infrared thermography device, which can capture luminance to perform temperature measurement of a surface, may be employed as a substitution for a scanning radiation thermometer, which can measure temperature in the width direction.

(Optical Fiber Radiation Thermometer)

One feature of the quality assurance system equipment according to an embodiment of the present invention is that an optical fiber radiation thermometer is installed at least on the upstream side or downstream side of the finishing mill, and at least on the upstream side or downstream side of the cooling equipment, and is installed on the lower surface side of the transportation line. Hereafter, embodiments the present invention will be described in detail.

It is desirable to dispose an optical fiber radiation thermometer below the manufacturing line. Below the manufacturing line has a bad temperature measurement environment particularly due to water, water vapor, or the like, and it is markedly difficult to install a scanning type radiation thermometer for measuring the temperature of the whole area of the lower surface of a steel plate. Particularly, just proximal to the finishing mill, cooling water is supplied massively, and accordingly, the environment of temperature measurement markedly deteriorates. Also, a great number of transportation rollers are installed on the manufacturing line, and accordingly, space where a thermometer is inserted is narrow, which is a reason for applying an optical fiber radiation thermometer.

Accordingly, it is desirable to dispose an optical fiber radiation thermometer at least on the upstream side or downstream side of the finishing mill, or at least on the upstream side or downstream side of the accelerated cooling equipment, and also below the transportation line, at a position facing a spot type radiation thermometer disposed on the upper surface of the steel plate sandwiching the transportation line. This is because the difference between the temperature on the upper surface of the steel plate and the temperature on the lower surface of the steel plate can be realized at the same place in the width direction, and accordingly, the quality in the plate thickness direction can be estimated, which is useful for quality assurance.

Alternatively, it is desirable to dispose two or more optical fiber radiation thermometers at a position facing a scanning radiation thermometer to be disposed on the downstream side of the finishing mill or at least on the upstream side or downstream side of the accelerated cooling equipment below the transportation line sandwiching the transportation line, in the scanning direction of the scanning radiation thermometer. Thus, the temperature distribution in the plate thickness direction can be realized two-dimensionally, and temperature measurement and analysis can be performed from the whole area of the upper surface of a steel plate to the whole area of the lower surface of a steel plate.

Note that in order to measure temperature in the width direction of the lower surface of a steel plate, the greater the number of optical fiber radiation thermometers is, the more the details can be realized quantitatively, but it is desirable from the aspect of cost and maintenance to provide optical fiber radiation thermometers with an interval of one location /m or so in the width direction.

The measured temperature data measured by these thermometers is input to a process computer (PC), temperature distributions of the whole area of the upper surface of a steel plate, and the whole area of the lower surface of the steel plate are mapped by the measured temperature data, and temperature data are analyzed and calculated based on the measured temperature data. Thus, the temperature of the whole area of a steel plate on the upstream side and downstream side of each device (finishing mill and accelerated cooling equipment) can be known at a glance.

(Quality Assurance System)

Hereafter, with regard to the quality assurance system according to an embodiment of the present invention, the outline of the system thereof will be described with reference to the drawings.

Figure 6:
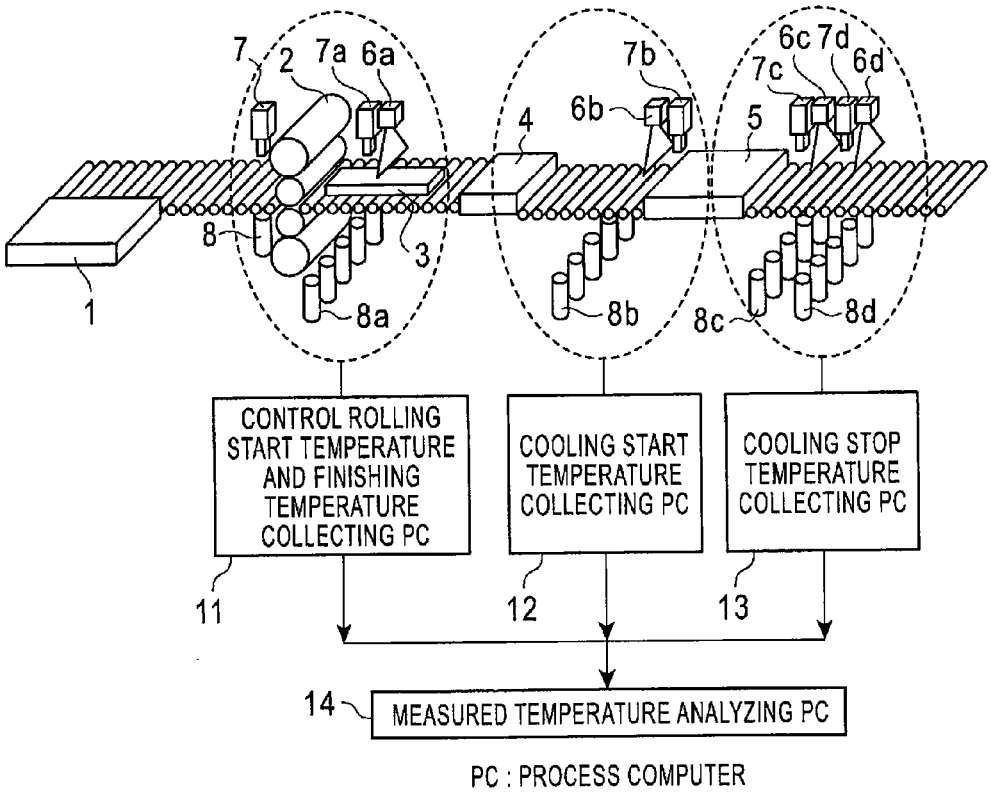
FIG. 6 is a diagram illustrating the outline of a temperature measurement system according to an embodiment of the present invention.

FIG. 6 illustrates the outline of the quality assurance system of this embodiment including the temperature measurement means (thermometer and temperature collecting means) and the temperature analysis means of a steel plate, and FIG. 6 illustrates a portion of the configuration of the temperature measurement means thereof. In FIG. 6, 1 denotes a heating furnace, 2 denotes a finishing mill, 3 denotes a steel plate, 4 denotes cooling equipment between rolling passes (cooling equipment for controlled rolling, hereafter, referred to as a CR cooling shower), 5 denotes accelerated cooling equipment, 6*a*, 6*b*, 6*c*, and 6*d* denote scanning radiation thermometers, 6*c* is for measurement of high-temperature, 6*d* is for measurement of low-temperature, 8, 8*a*, 8*b*, 8*c*, and 8*d* denote optical fiber radiation thermometers, 8*c* is for measurement of high-temperature, 8*d* is for measurement of low-temperature, 7, 7*a*, 7*b*, 7*c*, and 7*d* denote spot type radiation thermometers, 11 denotes a controlled rolling start temperature+finishing temperature collecting process computer, 12 denotes a cooling start temperature collecting process computer, 13 denotes a cooling stop temperature collecting process computer, 14 denotes a measured temperature analysis process computer, 15 denotes a temperature collecting process computer for the upper surface of a steel plate, and 16 denotes a temperature collecting process computer for the lower surface of a steel plate. However, in the drawing, a roughing mill is omitted.

A steel plate manufacturing line includes the heating furnace 1, finishing mill 2, CR cooling shower 4, and cooling equipment 5, and FIG. 6 illustrates a state in which the steel plate 3 is positioned between the finishing mill 2 and the CR cooling shower 4.

The temperature measured by the steel plate temperature measurement means, which comprises the spot type radiation thermometers 7 and 7*a* disposed at least on the upstream side and the downstream side of the finishing mill 2, the scanning radiation thermometer 6*a* disposed on the downstream side, and the optical fiber radiation thermometers 8 and 8*a*, is input to the controlled rolling start temperature+finishing temperature collecting process computer 11.

The temperature measured by the spot type radiation thermometer 7*b*, scanning radiation thermometer 6*b*, and optical fiber radiation thermometer 8*b* disposed on the upstream side of the accelerated cooling equipment 5 is input to the cooling start temperature collecting process computer 12.

The temperature measured by the temperature measurement means, which comprise the spot type radiation thermometers 7*c* and 7*d*, scanning radiation thermometers 6*c* and 6*d*, and optical fiber radiation thermometers 8*c* and 8*d* disposed on the downstream side of the accelerated cooling equipment 5, is input to the cooling stop temperature collecting process computer 13.

The temperature collecting means comprise the controlled rolling start temperature+finishing temperature collecting process computer 11, cooling start temperature collecting process computer 12, and cooling stop temperature collecting process computer 13, each of which comprises the temperature collecting process computer 15 of the upper surface of a steel plate, and the temperature collecting process computer 16 of the lower surface of the steel plate, and each of the collected temperatures of the upper surface of the steel plate, and the collected temperatures of the lower surface of the steel plate is input to the temperature analysis process computer 14, which is the measured temperature analysis means.

With the measured temperature analysis process computer 14, according to the measured temperature data input to the controlled rolling start temperature+finishing temperature collecting process computer 11, cooling start temperature collecting process computer 12, and cooling stop temperature collecting process computer 13, and temperature data analyzed and calculated based on the measured temperature data, temperature distributions of the whole area of the upper surface of the steel plate, and the whole area of the lower surface of the steel plate are mapped, and also in the event that desired quality is obtained through the temperature by quality prediction of a calculation model of a mechanical property as to the temperature MAP thereof, determination is made whether or not the temperature is included in a temperature range (allowable temperature range), and in the event that the temperature is included in the allowable temperature range, product measurement is performed from a large plate of the steel plate thereof.

Note that, with finishing rolling, even in the event that a thermometer is disposed on either the upstream side or the downstream side of the mill, the measured temperature can be utilized as the controlled rolling start temperature and rolling finishing temperature.

That is to say, controlled rolling is not necessarily started from the first pass of finishing rolling, and may frequently be executed after rolling of multiple passes. In this case, determination is made using a thermometer disposed on one of the upstream side and the downstream side of the finishing mill whether or not temperature suitable for controlled rolling has been obtained, and thus, temperature at the time of starting controlled rolling can be determined, and also the finishing rolling temperature at the time of ending rolling can be measured.

Further, there is a case of passing through the finishing mill without rolling, the pass at the time of starting controlled rolling is not restricted to the threading direction of the manufacturing line, and even in the event that a thermometer is disposed on either the upstream side or the downstream side of the mill, if the first rolling pass of controlled rolling is started from a thermometer installing side, the start temperature of controlled rolling can be measured, and, if the final pass ends in the thermometer installing side, the rolling finishing temperature can be measured.

Hereafter, specific embodiments of the steel plate quality assurance system and the equipment thereof will be described with reference to the drawings.

First Embodiment

Figure 2:
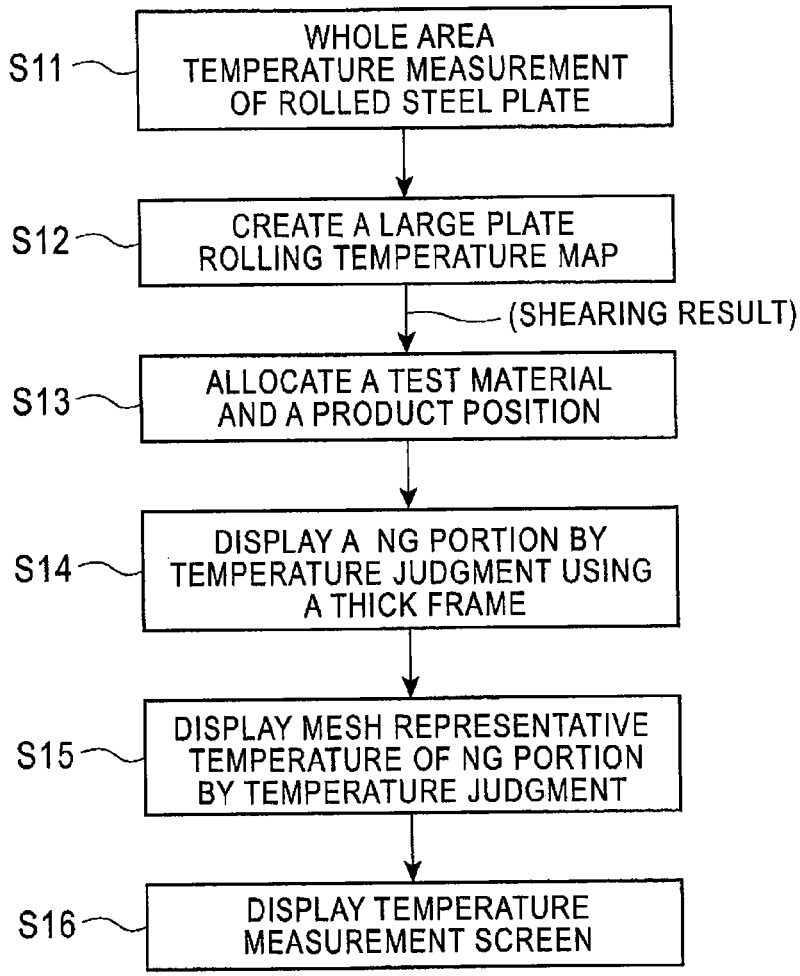
FIG. 2 is a diagram illustrating the procedure of temperature determination of an embodiment of the present invention.
Figure 3:
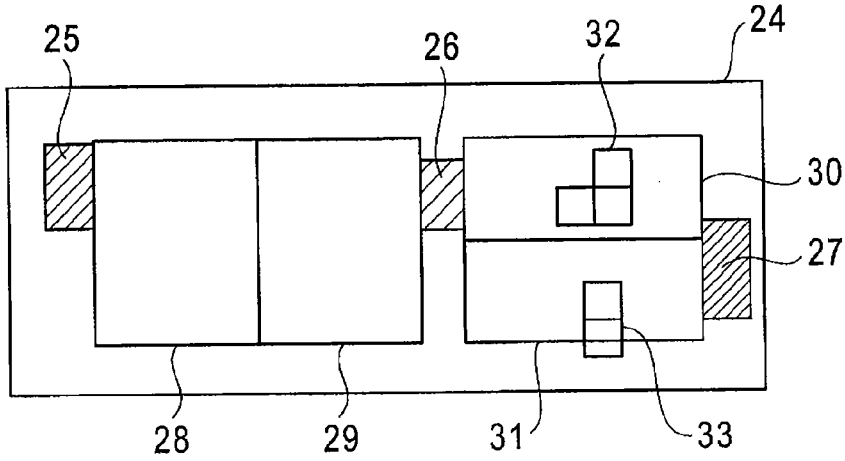
FIG. 3 is a diagram illustrating an example of a PC display screen (display screen image) supporting the temperature determination operation of an embodiment of the present invention.

FIGS. 2 and 3 describe a temperature determining operation for performing determination of product shipment by comparing operating control temperature, and measured temperatures input to the measured temperature analyzing PC 14*a* as the creation procedure (FIG. 2) for a PC display screen (FIG. 3) for supporting this operation.

First, the temperature of the whole area is measured by the temperature measurement means described above (S11), and a temperature MAP of the whole area of a steel plate, the large plate 14 is created by the temperature analysis means (S12).

Subsequently, based on shearing result, such as illustrated in FIG. 3, a blank layout is performed of a test material 25 from the top of this large plate 24, a test material 26 from the middle, a test material 27 from the bottom, and products (small plates 28, 29, 30, and 31) (S13).

Also, the temperature at the test material position is calculated from the temperature MAP, the test material result is correlated thereto, whereby the precision of a quality design, and a calculation model of the mechanical property can be improved.

A region where the measured temperature deviates from the operating control temperature, and a temperature determination NG (no-good) portion are surrounded with a thick frame 32 or 33 (S14), mesh representative temperature is obtained (S15), and these are displayed on the screen (S16). The average temperature within the mesh is taken as the mesh representative temperature, and the mesh is selected depending on applications as appropriate, but the size of the mesh is preferably 50 through 1000 mm.

Now, the mesh mentioned here indicates one small region at the time of dividing the whole area of a steel plate into small regions to create a temperature MAP of the whole area of the steel plate.

Figure 4:
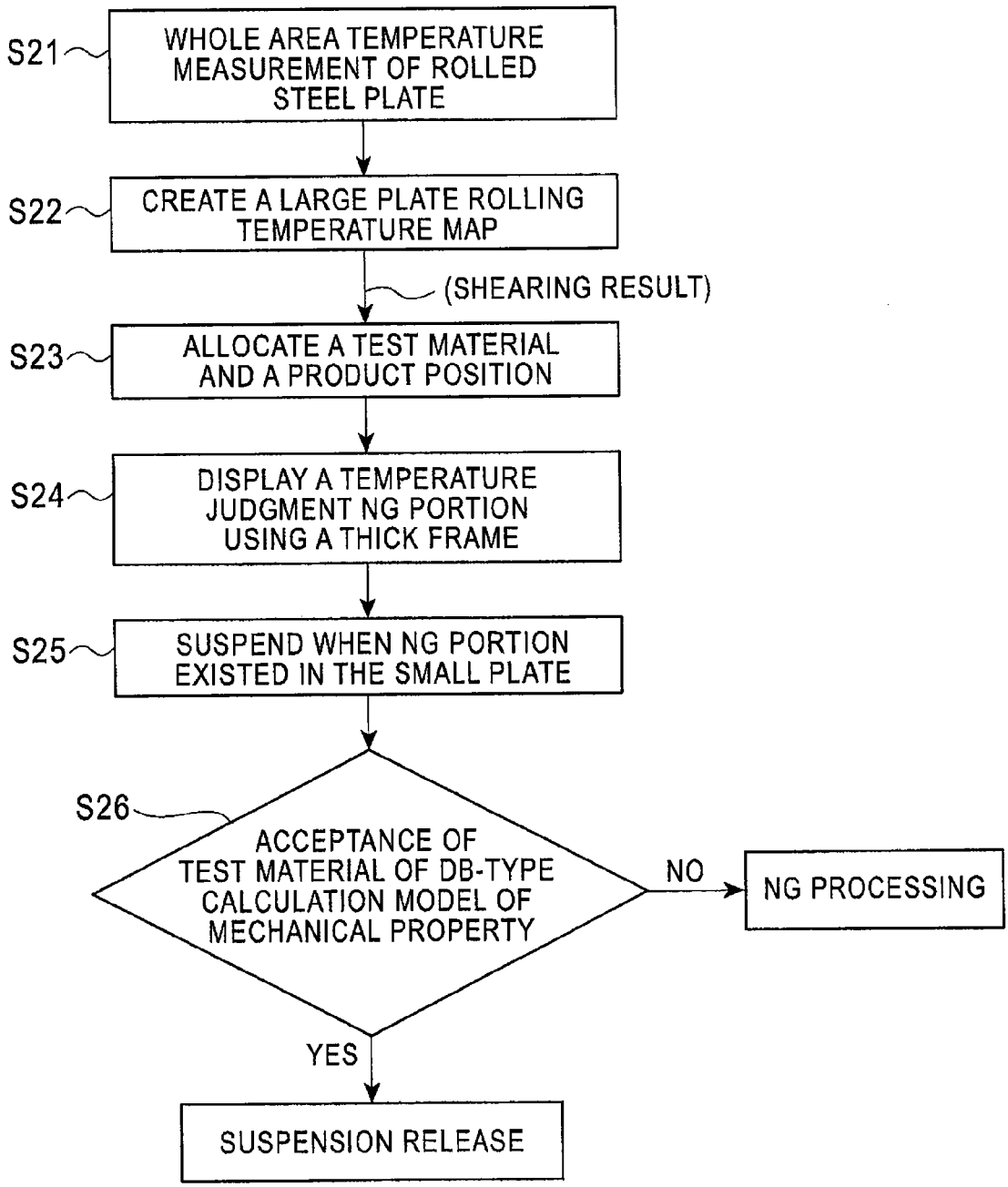
FIG. 4 is a diagram illustrating a flowchart of processing in the event that a temperature determination NG portion occurs.

FIG. 4 is a flowchart for describing a processing method for this portion in the event that a temperature determination NG portion has occurred on a small plate, steps S21 through S24 conform to steps S11 through S14 in FIG. 2. In the event that a temperature determination NG portion is included in a small plate, NG is suspended (S25), and quality acceptance/rejection determination is performed using a DB type (database type) calculation model of the mechanical property (S26), and in the case of acceptance, suspension is released to perform a blank layout.

Figure 5:
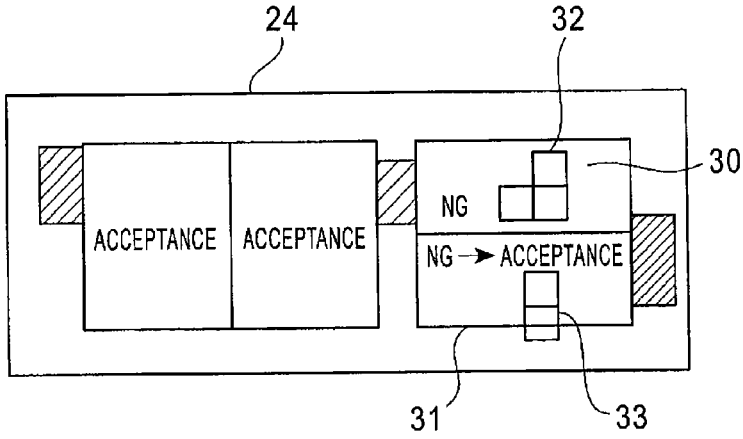
FIG. 5 is a diagram illustrating an example of a PC display screen in the event that a NG portion is passed by the flowchart illustrated in FIG. 4.

FIG. 5 illustrates an example of a PC display screen in the event that in accordance with the flowchart in FIG. 4, NG portions 32 and 33 within small plates 30 and 31 have been determined, and the NG portion 33 has passed.

On the other hand, in the event that a temperature determination NG portion is included in a large plate, this processing is taken as NG processing, and the blank layout is corrected so as to perform product measurement within a good quality range (S7), and product measurement is performed (S8).

Such as described above, the quality assurance system performs quality prediction based on the accurately measured temperature distribution of the whole area of a steel plate, and a result value, and a DB (database) type calculation model of mechanical property having high prediction precision is employed, so, a product of which the whole area has been subjected to quality assurance can be shipped (S9). Also, the shape may be improved across the whole area.

Note that FIG. 3 and FIG. 5 are an example of a PC display screen to be obtained from one procedure of the quality assurance system with the object of supporting an engineer to intervene in the present system, however all of the procedures may be performed by automatic control to realize a system in which no engineer intervenes.

According to aspects of the present invention, advantages are obtained such that the reject ratio of a material test decreases from 0.08% to 0.06%, curvature deformation correction time is reduced 20% as compared to that according to the related art, the defective shape of a steel plate is suppressed 10% as compared to that according to the related art, and so forth.

Second Embodiment

Figure 8:
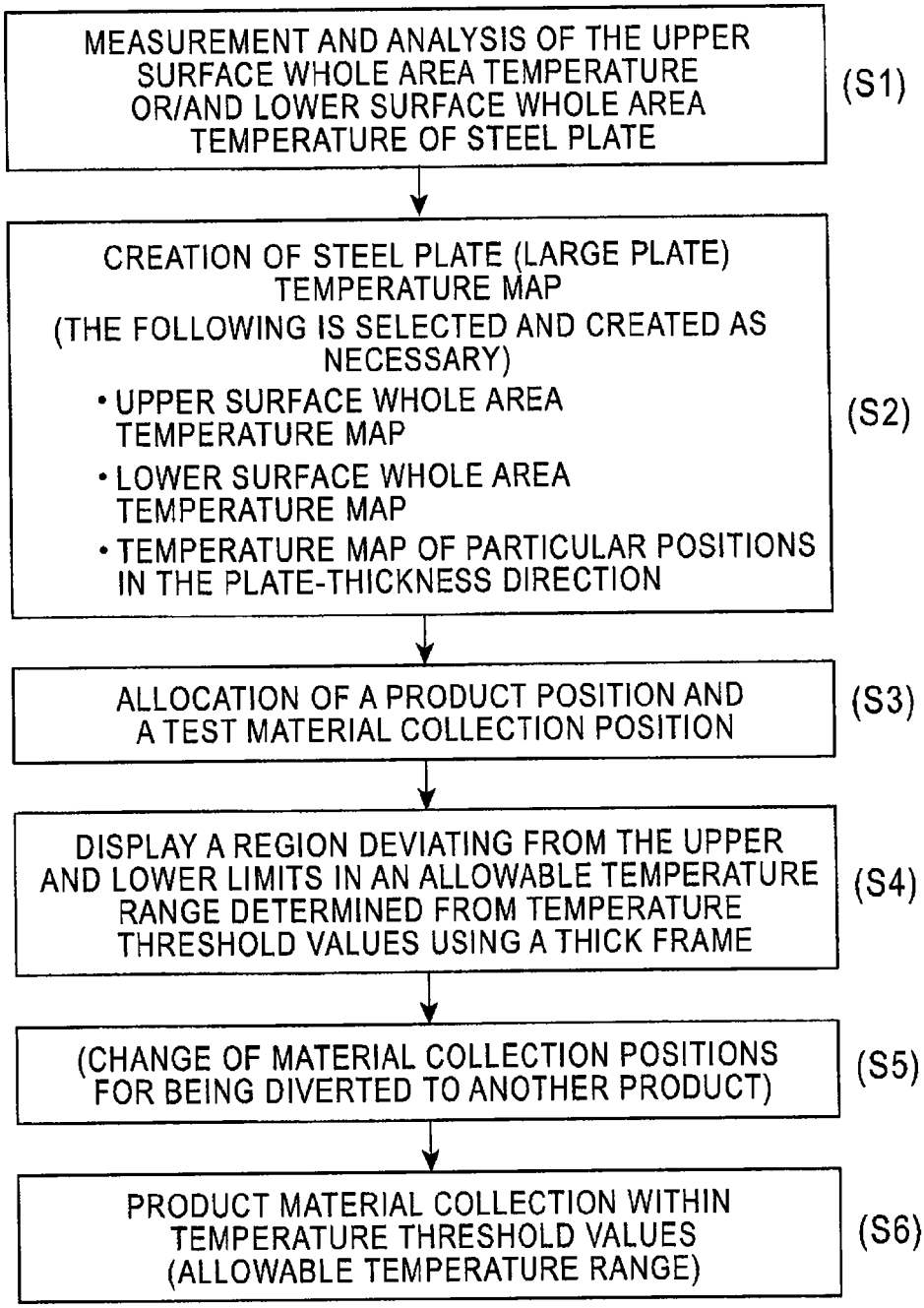
FIG. 8 is a diagram illustrating processing flow of an embodiment of the present invention.

The processing flow of the steel plate quality assurance system according to this embodiment is illustrated in FIG. 8. Here, temperature measurement input to and analyzed by the measured temperature analysis process computer 14, analysis results (temperature MAP), and temperature threshold values set thereto are compared to perform acceptance/rejection determination of product shipment. Note that FIG. 3 is a process computer screen for visually displaying this processing.

First, the temperatures of the whole area of the upper surface of a steel plate or the temperatures of the whole area of the lower surface of a steel plate are measured and analyzed by the above temperature measurement means and temperature analysis means (S1), and the temperature MAP of the whole area of the upper surface of the steel plate (large plate 24) or the temperature MAP of the whole area of the steel plate is created by the temperature analysis means (S2). Here, the size of the mesh of the temperature MAP is selected depending on applications as appropriate, but the size is preferably 50 through 1000 mm. Incidentally, the mesh of the temperature MAP means one small region when dividing the whole area of a steel plate into small regions to create the temperature MAP of the whole area of the steel plate.

Note that, in the event that the temperature distribution in the plate thickness direction is necessary, such as an extremely-steel plate having thick plate thickness, in the step above (S2) the temperature MAP of the whole area of the upper surface of a steel plate, the temperature MAP of the whole area of the lower surface of the steel plate, and the temperature MAP of a particular position in the plate thickness direction are created. At this time, in the step above (S1), the temperature of the whole area of the upper surface of the steel plate, and the temperature of the whole area of the lower surface of the steel plate are measured and analyzed.

Next, as illustrated in FIG. 3, allocation of a blank layout of a tip collecting material for a material test 25, a central portion collecting material for a material test 26, a tail tip collecting material for a material test 27, and products (small plates 28, 29, 30, and 31) is performed for a large plate 24 (S3).

Note that the temperature of a collecting position for a material test is calculated from the temperature MAP, and the material test results and the temperature MAP are correlated, whereby the precision of the quality design and quality prediction of a steel plate can be improved.

Next, temperature upper and lower limit values (temperature threshold values) indicating a particular allowable temperature range are set for each device on the upstream side or downstream side so as to correspond to the created temperature MAP, and a region of which the temperature deviates from the temperature threshold values is surrounded with a thick frame 32 or 33 (S4).

Note that in the event that a thick frame portion that deviates from the allowable temperature range may be diverted to another product having an unexacting request, reallocation may be made by changing the collecting position according to a product (S5).

Subsequently, a plate of which the temperature is included in the temperature threshold values is collected as a product (S6).

Thus, with the steel plate quality assurance system according to this embodiment, the temperature distribution of the whole area of a steel plate that is accurately measured and analyzed is mapped and used to perform quality prediction based on a measured temperature value (temperature measured value), and accordingly, a whole-area-quality-assured product can be shipped. Also, the shape (flatness or the like) may also be improved across the whole area. With a conventional quality determination and assurance method, a product needs to be recreated from a large plate when a quality defective portion is mixed into a product collected from the large plate to some extent (e.g., 0.8% or so), recollecting of a product takes a great deal of trouble, and recollected remaining material needs to be scrapped, so yield markedly deteriorates, but according to this embodiment, a quality defective portion at quality determination is markedly reduced to almost zero, and also a collected product can become a quality-assured product in a sure manner, efficiency is improved, yield is also good, and further, secondarily, an advantage is obtained such that the defective shape of a steel plate is prevented, and the advantage thereof is markedly great.

Third Embodiment

Figure 9:
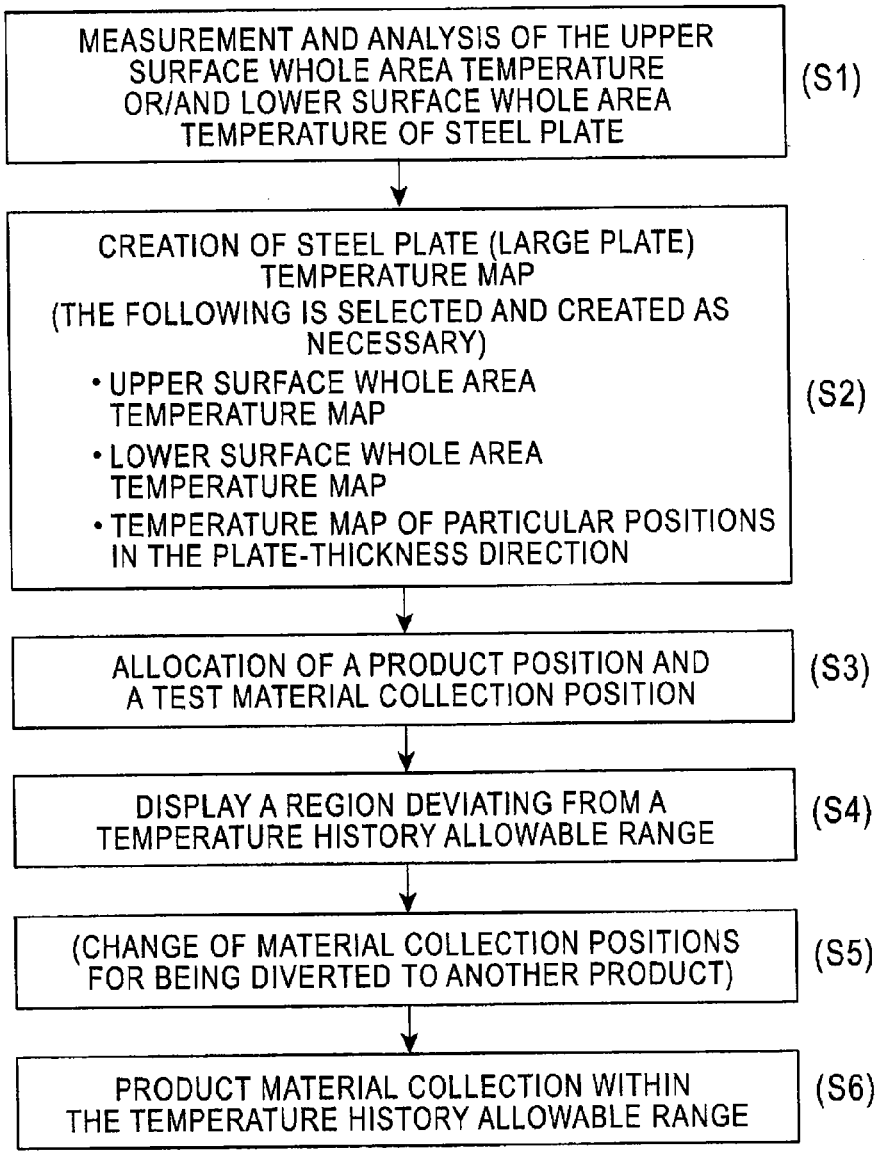
FIG. 9 is a diagram illustrating an example of processing flow of an embodiment of the present invention.

FIG. 9 illustrates an example of the processing flow of the steel plate quality assurance system according to this embodiment. Here, based on the temperature measurements input to and analyzed by the measured temperature analysis process computer 14, analysis results (temperature MAP), the temperature history obtained with creation of the temperature MAP, and an allowable range set to the temperature history thereof, acceptance/rejection of product shipment is performed. Note that FIG. 3 is a process computer screen for visually displaying this processing.

First, the temperatures of the whole area of the upper surface of a steel plate or the temperatures of the whole area of the lower surface of a steel plate are measured and analyzed by the above temperature measurement means and temperature analysis means (S1), and the temperature MAP of the whole area of the upper surface of the steel plate (large plate 24) and/or the temperature MAP of the whole area of the lower surface of the steel plate are created by the temperature analysis means (S2). Here, the size of the mesh of the temperature MAP is selected depending on applications as appropriate, but the size is preferably 50 through 1000 mm. Incidentally, the mesh of the temperature MAP means one small region when dividing the whole area of a steel plate into small regions to create the temperature MAP of the whole area of the steel plate.

Note that, in the event that a temperature distribution in the plate thickness direction is necessary, such as an extremely-thick steel plate having great plate thickness, in the step above (S2) the temperature MAP of the whole area of the upper surface of a steel plate, the temperature MAP of the whole area of the lower surface of the steel plate, and the temperature MAP of a particular position in the plate thickness direction are created. At this time, in the step above (S1), the temperature of the whole area of the upper surface of the steel plate, and the temperature of the whole area of the lower surface of the steel plate are measured and analyzed.

Next, as illustrated in FIG. 3, allocation of a blank layout of a tip collecting material for a material test 25, a central portion collecting material for a material test 26, a tail tip collecting material for a material test 27, and products (small plates 28, 29, 30, and 31) is performed for this large plate 24 (S3).

Next, the temperature history of the steel plate is obtained from the temperature data of the steel plate passing through the upstream side and/or downstream side of each device used for creation of the temperature MAP, and also the allowable range of the temperature history is set by combining the allowable temperature range at the upstream side and/or downstream side of each device, and a region of which the temperature history deviates from the allowable range is surrounded with a thick frame 32 or 33 (S4).

Note that in the event that a thin frame portion deviating from the allowable range of the temperature history may be diverted to another product having an unexacting request, reallocation may be made by changing the collecting position according to the product (S5).

Subsequently, a small plate of which the temperature is included in the allowable temperature range is collected as a product (S6).

Figure 10:
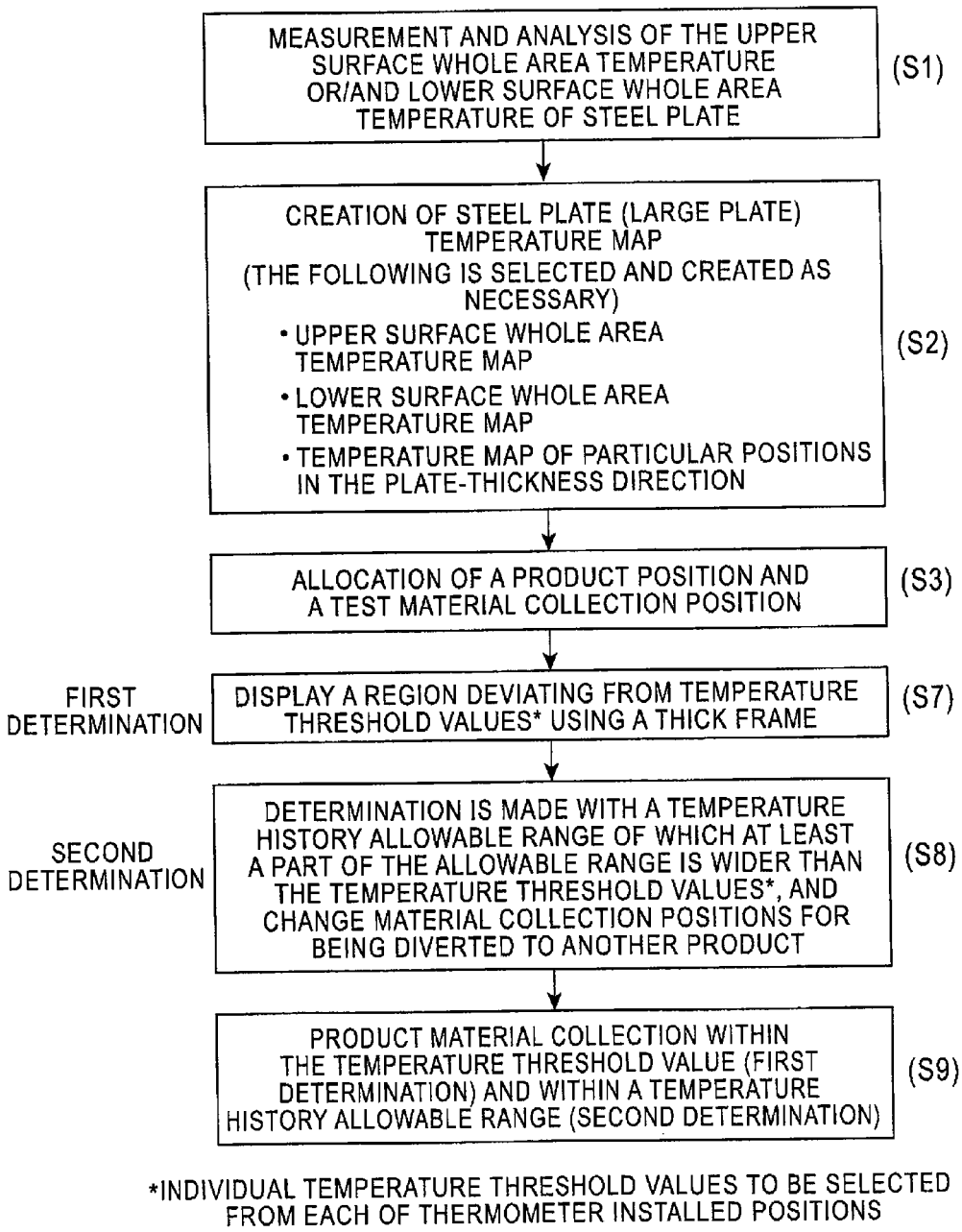
FIG. 10 is a diagram illustrating another example of processing flow of an embodiment of the present invention.

FIG. 10 illustrates another example of the processing flow of the steel plate quality assurance system according to this embodiment.

Here, as illustrated in FIG. 10, temperature measurement and analysis of the whole area (S1), creation of a temperature MAP (S2), allocation of a product position and a test specimen position (S3) are performed in the same way as in FIG. 9, and subsequently, as a first determination, temperature threshold values are set to perform quality determination regarding temperature of a particular position of the upstream side or downstream side of each device, and a region deviating from the temperature threshold values is displayed with a thick frame (S7). Subsequently, as a second determination, with regard to this thick frame portion, the allowable range of a temperature history partially having at least a wider allowable range than the above temperature threshold values is employed, the temperature history at two or more positions on the upstream side or downstream side of each device is obtained, and based on the allowable range of the above temperature history, a product collecting position is determined (S8), and may also be diverted to another product having an unexacting request.

Subsequently, a small plate of which the temperature is included in the temperature threshold values during the first determination, and a small plate of which the temperature history is included in the temperature history allowable range are collected as products (S9).

Figure 11:
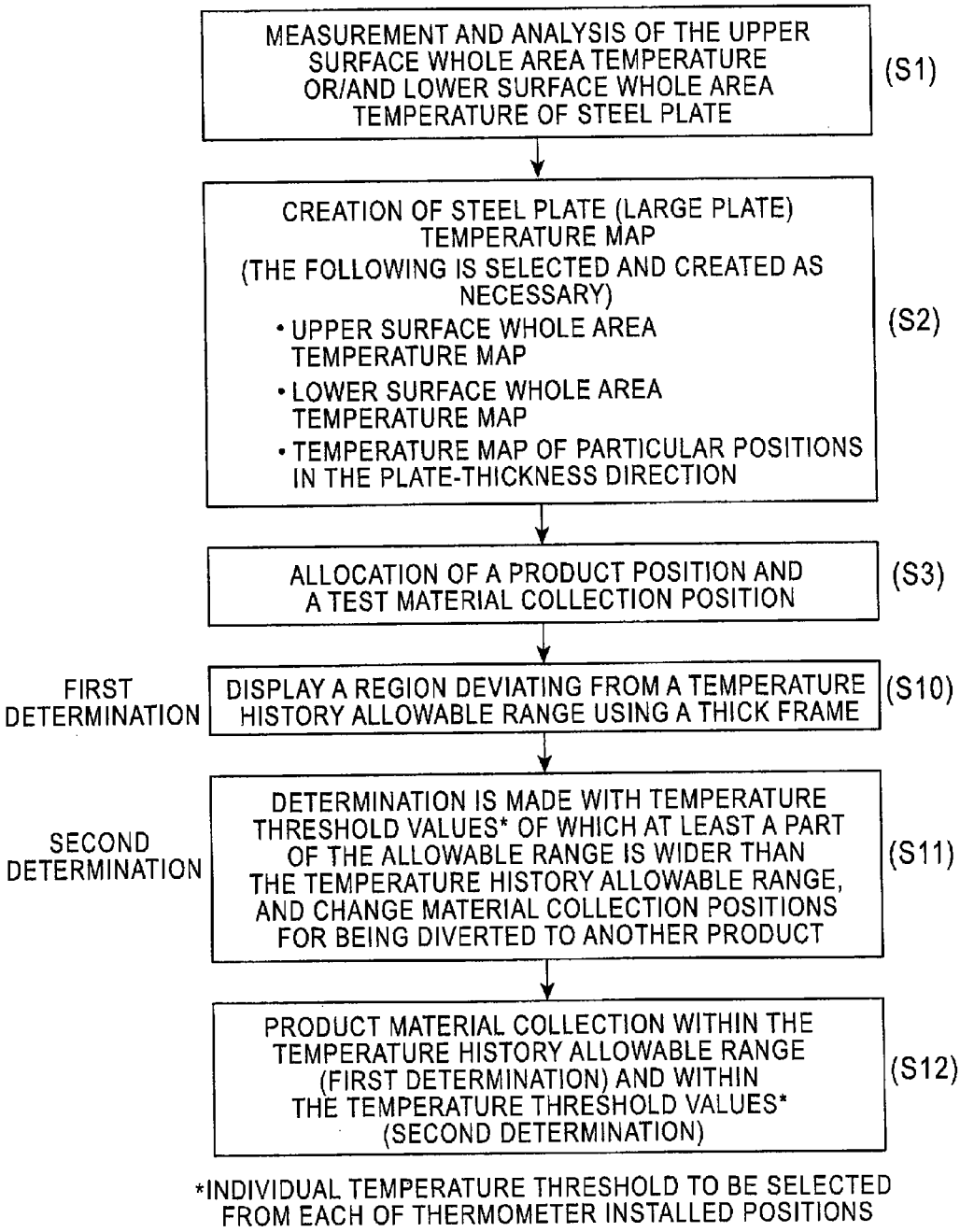
FIG. 11 is a diagram illustrating another example of processing flow of an embodiment of the present invention.

FIG. 11 illustrates another example of the processing flow of the steel plate quality assurance system according to this embodiment.

Here, as illustrated in FIG. 11, temperature measurement and analysis of the whole area (S1), creation of a temperature MAP (S2), allocation of a product position and a test specimen position (S3) are performed in the same way as in FIG. 9, and subsequently, as a first determination, a temperature history to be passed through the upstream side or downstream side of each device is obtained, a temperature history allowable range is set by combining the allowable temperature range of the upstream side or downstream side of each device to perform quality determination, and a region of which the temperature history deviates from the temperature history allowable range is displayed with a thick frame (S10). Subsequently, as a second determination, with regard to this thick frame portion, temperature threshold values having at least partially a wider allowable range than the above temperature history allowable range is newly employed, and based on the temperature at a particular position on the upstream side or downstream side of each device, and the above temperature threshold values, a product collecting position is determined (S11), and may also be diverted to another product having an unexacting request.

Subsequently, a small plate of which the temperature history is included in the temperature history allowable range during the first determination, and a small plate of which the temperature is included in the temperature threshold values are collected as products (S12).

Thus, with the steel plate quality assurance system according to this embodiment, the temperature distribution of the whole area of a steel plate that is accurately measured and analyzed is mapped and used to perform quality prediction based on a measured temperature value (temperature measured value), so a whole-area-quality-assured product can be shipped. Also, the shape (flatness or the like) may also be improved across the whole area.

With a conventional quality determination and assurance method, a product needs to be recreated from a large plate when a quality defective portion is mixed into a product collected from the large plate to some extent (e.g., 0.8% or so), recollecting of a product takes a great deal of trouble, recollected remaining material needs to be scrapped, and accordingly, yield is markedly deteriorated; however, according to this embodiment, quality defective portions during quality determination are markedly reduced to almost zero, and also a collected product can become a quality-assured product in a sure manner.

Fourth Embodiment

Figure 12:
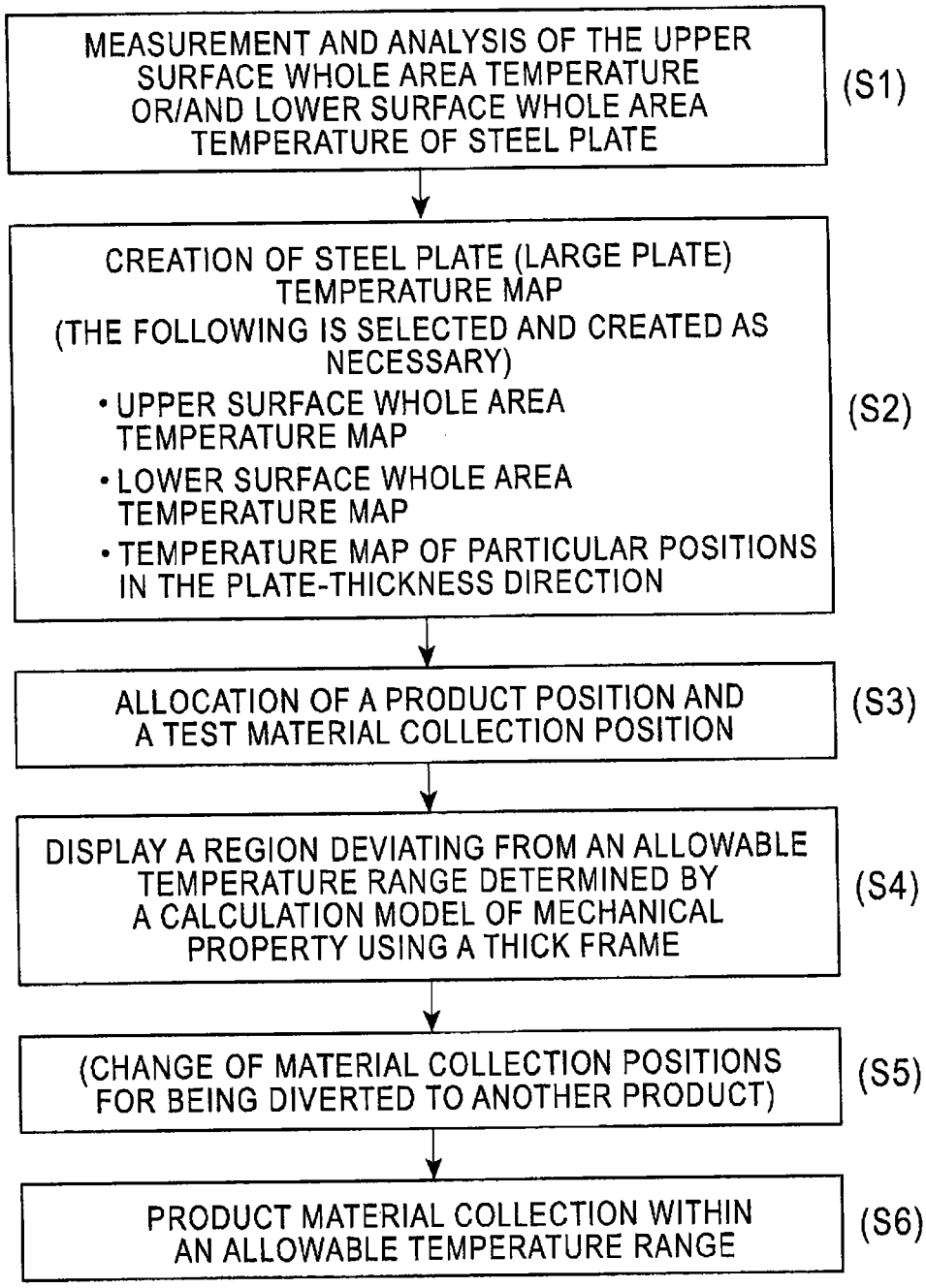
FIG. 12 is a diagram illustrating an example of processing flow of an embodiment of the present invention.

FIG. 12 illustrates an example of the processing flow of the steel plate quality assurance system according to this embodiment. Here, based on the temperature measurement input to and analyzed by the measured temperature analysis process computer 11, analysis results (temperature MAP), and quality prediction by a calculation model of the mechanical property, acceptance/rejection of product shipment is performed. Note that FIG. 3 is a process computer screen for visually displaying this processing.

First, the temperature of the whole area of the upper surface of a steel plate or the temperature of the whole area of the lower surface of a steel plate are measured and analyzed by the above temperature measurement means and temperature analysis means (S1), and the temperature MAP of the whole area of the upper surface of the steel plate (large plate 24) or the temperature MAP of the whole area of the steel plate are created by the temperature analysis means (S2). Here, the size of the mesh of the temperature MAP is selected depending on applications as appropriate, but the size is preferably 50 through 1000 mm. Incidentally, the mesh of the temperature MAP means one small region when dividing the whole area of a steel plate into small regions to create the temperature MAP of the whole area of the steel plate.

Note that, in the event that temperature distribution in the plate thickness direction is necessary, such as an extremely-thick steel plate having great plate thickness, in the step above (S2) the temperature MAP of the whole area of the upper surface of a steel plate, the temperature MAP of the whole area of the lower surface of the steel plate, and the temperature MAP of a particular position in the plate thickness direction are created. At this time, in the step above (S1), the temperature of the whole area of the upper surface of the steel plate, and the temperature of the whole area of the lower surface of the steel plate are measured and analyzed.

Next, as illustrated in FIG. 3, allocation of a blank layout of a tip collecting material for a material test 25, a central portion collecting material for a material test 26, a tail tip collecting material for a material test 27, and products (small plates 28, 29, 30, and 31) is performed as to this large plate 24 (S3).

Next, as to the created temperature MAP, the calculation model of a mechanical property is used to determine whether or not the temperature is included in a temperature range (allowable temperature range) whereby the desired quality can be predicted to be obtained, and a region of which the temperature deviates from the allowable temperature range is surrounded with a thick frame 32 or 33 (S4).

Note that in the event that a thick frame portion for temperatures deviating from the allowable temperature range may be diverted to another product having an unexacting request, reallocation may be made by changing the collecting position according to the product (S5).

Subsequently, a plate of which the temperature is included in the allowable temperature range is collected as a product (S6).

Figure 13:
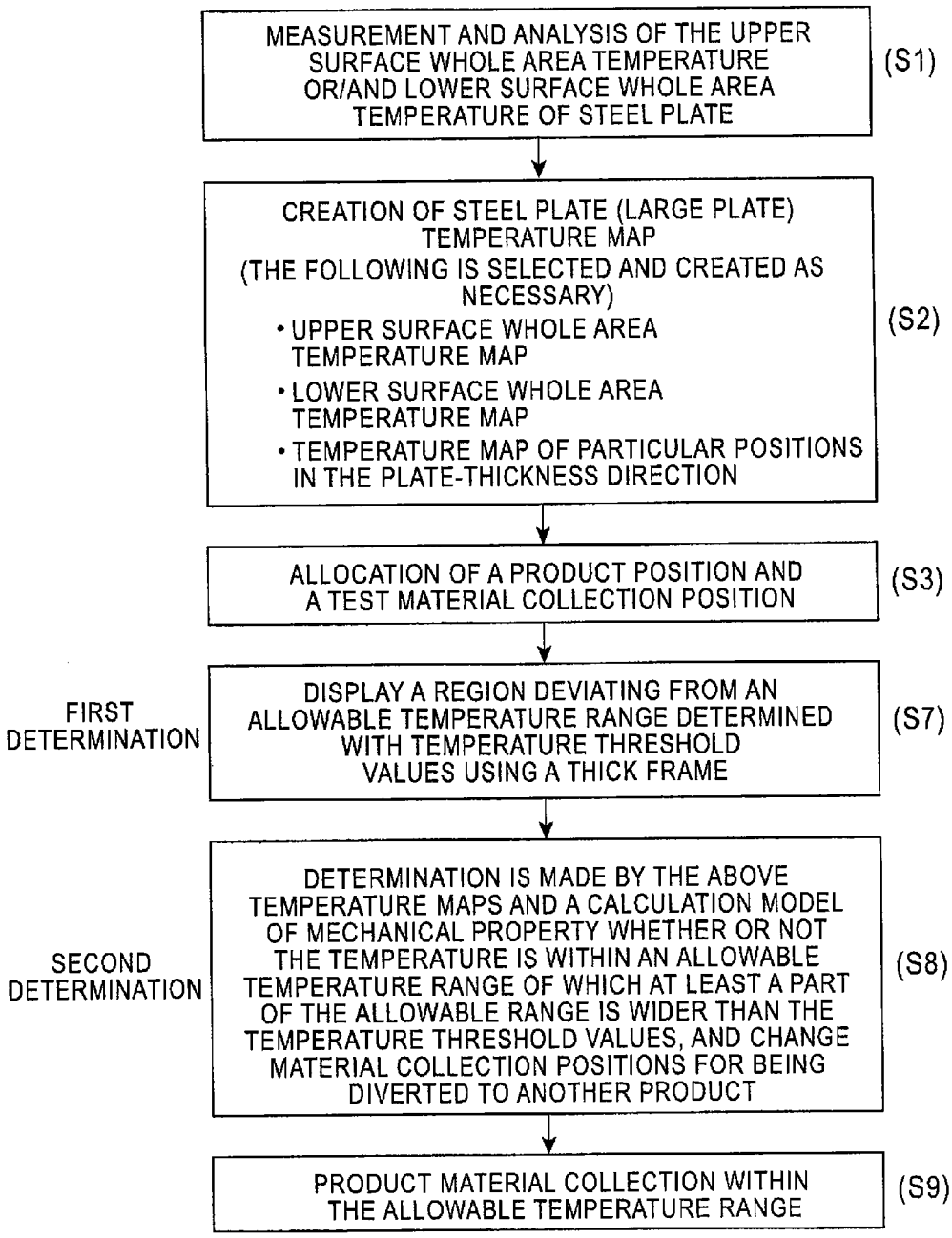
FIG. 13 is a diagram illustrating another example of processing flow of an embodiment of the present invention.

FIG. 13 illustrates another example of the processing flow of the steel plate quality assurance system according to this embodiment.

Here, as illustrated in FIG. 13, temperature measurement and analysis of the whole area (S1), creation of a temperature MAP (S2), allocation of a product position and a test specimen position (S3) are performed in the same way as in FIG. 12, and subsequently, as a first determination, temperature threshold values (first allowable temperature range) are set to perform quality determination regarding temperature of a particular position of the upstream side or downstream side of each device, and a region deviating from the first allowable temperature range determined by the temperature threshold values is displayed with a thick frame (S7). Subsequently, with regard to this thick frame portion, as a second determination, a second allowable temperature range at least partially having a wider allowable range than the first allowable temperature range is set, the above temperature MAP and the calculation model of a mechanical property are utilized to perform acceptance/rejection determination with the second allowable temperature range, and a product collecting position is determined (S8), and may also be diverted to another product having an unexacting request.

Subsequently, a small plate of which the temperature is included in the allowable temperature ranges (within the first allowable temperature range and within the second allowable temperature range) is collected as a product (S9).

Figure 14:
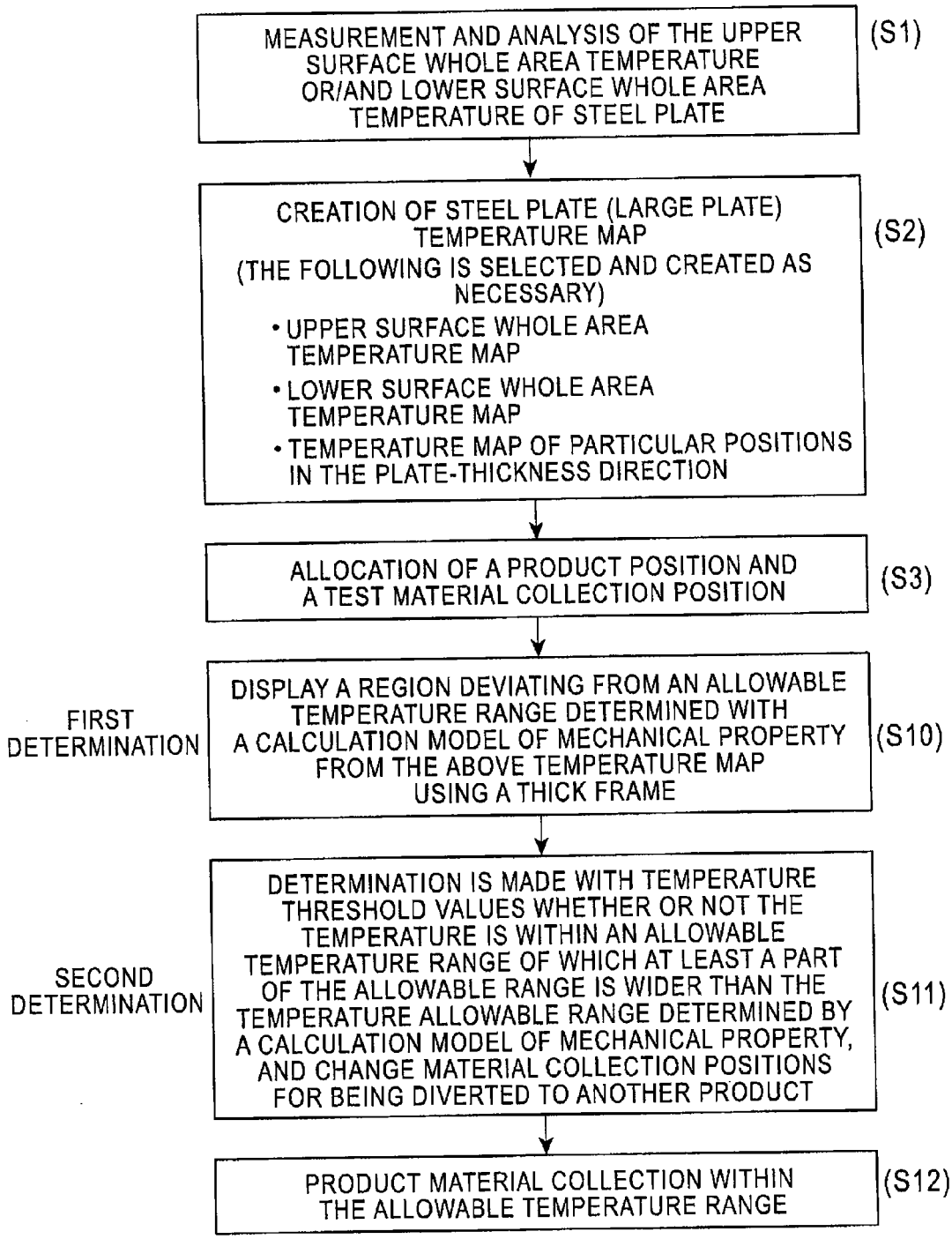
FIG. 14 is a diagram illustrating another example of processing flow of an embodiment of the present invention.

FIG. 14 illustrates another example of the processing flow of the steel plate quality assurance system according to this embodiment.

Here, as illustrated in FIG. 14, temperature measurement and analysis of the whole area (S1), creation of a temperature MAP (S2), allocation of a product position and a test specimen position (S3) are performed in the same way as in FIG. 12, and subsequently, as a first determination, regarding the temperature of a particular position on the upstream side or downstream side of each device, the above temperature MAP and the calculation model of mechanical property are utilized to perform acceptance/rejection determination, and a region deviating from the allowable temperature range (first allowable temperature range) is displayed with a thick frame (S10). Subsequently, regarding this thick frame portion, as a second determination, a second allowable temperature range (temperature threshold values) having a wider allowable range than the first allowable temperature range is set to perform acceptance/rejection determination, a product collecting position is determined (S11), and may also be diverted to another product having an unexacting request.

Subsequently, a small plate of which the temperature is included in the allowable temperature ranges (within the first allowable temperature range and within the second allowable temperature range) is collected as a product (S12).

Thus, with the steel plate quality assurance system according to this embodiment, the temperature distribution of the whole area of a steel plate accurately measured and analyzed is mapped and used to perform quality prediction based on a measured temperature value (measured temperature value), and accordingly, a whole-area-quality-assured product can be shipped. Also, the shape (flatness or the like) may also be improved across the whole area.

With a conventional quality determination and assurance method, a product needs to be recreated from a large plate when a quality defective portion is mixed into a product collected from the large plate to some extent (e.g., 0.8% or so), recollecting of a product takes a great deal of trouble, recollected remaining material needs to be scrapped, and accordingly, yield is markedly deteriorated, but according to this embodiment, the quality defective portion during quality determination is markedly reduced to almost zero, and also a collected product can become a quality-assured product in a sure manner.

Fifth Embodiment

Figure 23:
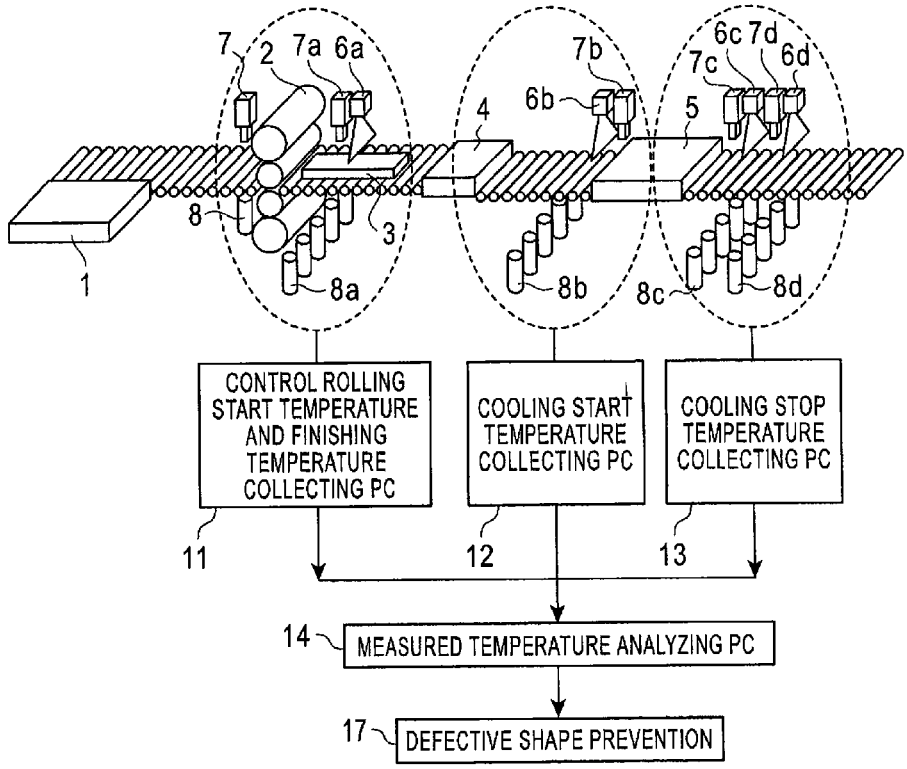
FIG. 23 is a diagram illustrating the outline of a temperature measurement system according to an embodiment of the present invention.

FIG. 23 illustrates the outline of a temperature measurement system according to an embodiment of the present invention including the above steel plate measurement means. In FIG. 23, 1 denotes a heating furnace, 2 denotes a finishing mill, 3 denotes a steel plate, 4 denotes a CR cooling shower, 5 denotes cooling equipment, 6*a*, 6*b*, 6*c*, and 6*d* denote scanning radiation thermometers, 6*c* is for measurement of high-temperature, 6*d* is for measurement of low-temperature, 8, 8*a*, 8*b*, 8*c*, and 8*d* denote optical fiber radiation thermometers, 8*c* is for measurement of high-temperature, 8*d* is for measurement of low-temperature, 7, 7*a*, 7*b*, 7*c*, and 7*d* denote spot type radiation thermometers, 11 denotes a controlled rolling start temperature+finishing temperature collecting PC, 12 denotes a cooling start temperature collecting PC, 13 denotes a cooling stop temperature collecting PC, 14 and 14*a* denote measured temperature analyzing PCs, and 17 denotes defective shape prevention control.

A steel plate manufacturing line includes the heating furnace 1, finishing mill 2, CR cooling shower 4, and cooling equipment 5, and the drawing illustrates a state in which the steel plate 3 is positioned between the finishing mill 2 and the CR cooling shower 4.

The temperature measured by the steel plate temperature measurement means made up of the spot type radiation thermometers (7 and 7*a*) disposed on the upstream side and the downstream side of the finishing mill, the scanning radiation thermometer 6*a* disposed on the downstream side, and the optical fiber radiation thermometer 8*a* is input to the controlled rolling start temperature+finishing temperature collecting PC 11.

The temperature measured by the spot type radiation thermometer (7*b*), scanning radiation thermometer 6*b*, and optical fiber radiation thermometer 8*b* disposed on the upstream side of the cooling equipment 5 is input to the cooling start temperature collecting PC 12.

The temperature measured by the steel plate temperature measurement means made up of the spot type radiation thermometers (7*c* and 7*d*), scanning radiation thermometers 6*c* and 6*d*, and optical fiber radiation thermometers 8*c* and 8*d* disposed on the downstream side of the cooling equipment 5 is input to the cooling stop temperature collecting PC 13.

The controlled rolling start temperature+finishing temperature collecting PC 11, cooling start temperature collecting PC 12, and cooling stop temperature collecting PC 13 are each made up of the temperature collecting PC 15 for the upper surface of a steel plate, and the temperature collecting PC 16 for the lower surface of the steel plate, and each of the temperatures of the upper surface of the steel plate, and the temperatures of the lower surface of the steel plate are input to the measured temperature analyzing PC 14*a*.

With actual equipment production, an operating control temperature (controlled rolling start temperature, steel plate finishing temperature, cooling start temperature, cooling stop temperature) range, and the measured temperature input to the measured temperature analyzing PC 14*a* are compared, and quality determination is performed, thereby assuring the quality of the whole area.

Figure 24:
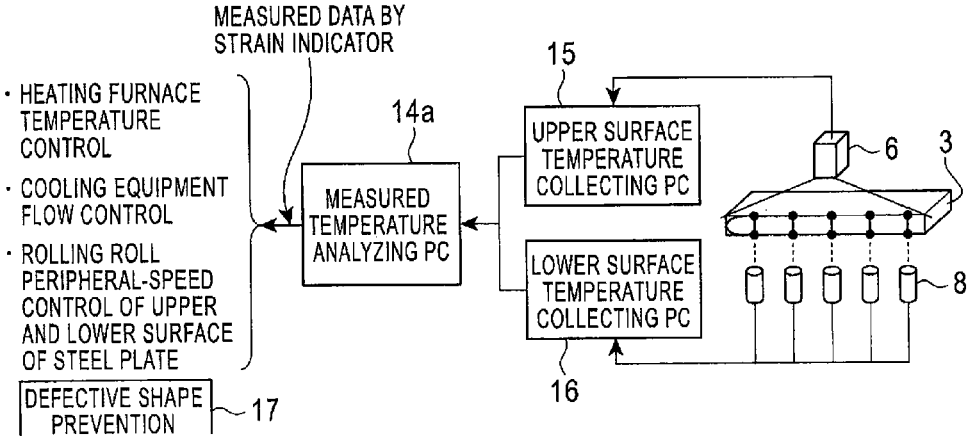
FIG. 24 is a diagram for describing a method for manufacturing a steel plate which excels in a dimensional shape using the temperature measurement means illustrated in FIG. 23.

FIG. 24 is a diagram for describing a method for manufacturing a steel plate which excels in dimensional shape using the temperature measurement means illustrated in FIG. 23, and illustrates an example wherein the temperature of the upper surface of a steel plate, and the temperature of the lower surface of the steel plate, on the downstream side near the mill 2 and the accelerated cooling equipment 5 are measured by the scanning radiation temperature 6 and the optical fiber radiation thermometer 8.

The temperature collecting PC 16 for the lower surface of the steel plate, the temperature collecting PC 15 for the upper surface of the steel plate, and the measured temperature analyzing PC 14*a* obtain a temperature distribution of the upper surface of the steel plate, and of the lower surface of the steel plate from the measured temperature.

A strain indicator (steel plate dimensional shape measurement device) is installed on the downstream side near the mill 2 and the accelerated cooling equipment 5 to measure the steel plate dimensional shape, and a temperature distribution whereby a suitable dimensional shape is obtained beforehand.

With actual manufacturing, in 17, first, a temperature distribution on the downstream side of the mill 2 and the cooling equipment 5 is obtained. In the event that this temperature distribution differs from the temperature distribution whereby a suitable dimensional shape is obtained, with manufacturing of the following plate, the operating conditions of the heat furnace, mill 2, CR cooling shower 4, and accelerated cooling equipment 5 are adjusted. With the heating furnace, temperature of upper and lower surface of steel plate and/or gas flow rate of upper and lower surface of steel plate within the heating furnace is controlled, with the mill 2, peripheral-speed of upper and lower surface of steel plate and/or descaling water flow rate of upper and lower surface of steel plate is controlled, and with the CR cooling shower 4 and the cooling equipment 5, at least one of water flow rate in the plate width direction, plate length direction or water flow rate of upper and lower surface of steel plate is controlled.

According to aspects of the present invention, advantages are obtained such that the reject ratio of a material test decreases from 0.08% to 0.06%, curvature deformation correction time is reduced 20% as compared to that according to the related art, the defective shape of a steel plate is suppressed 10% as compared to that according to the related art, and so forth.

Sixth Embodiment

Figure 25:
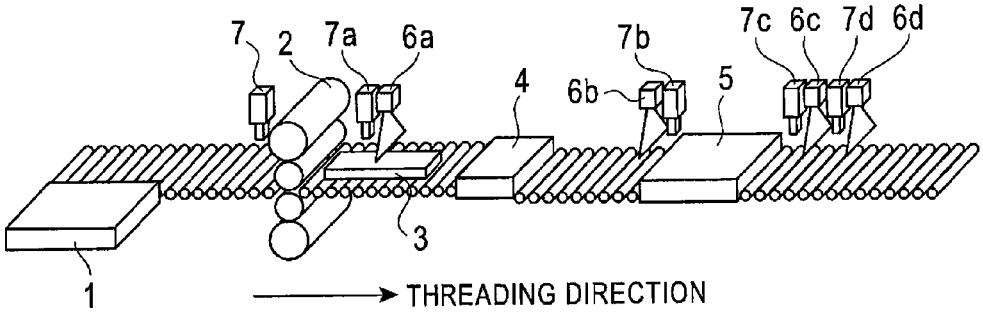
FIG. 25 is a diagram illustrating an embodiment of the outline of steel plate quality assurance equipment according to an embodiment of the present invention.

FIG. 25 illustrates the outline of a temperature measurement system according to an embodiment of the present invention including the above steel plate measurement means.

A steel plate manufacturing line includes the heating furnace 1, finishing mill 2, CR cooling shower 4, and accelerated cooling equipment 5, and FIG. 25 illustrates a state in which the steel plate 3 is positioned between the finishing mill 2 and the CR cooling shower 4.

Figure 26:
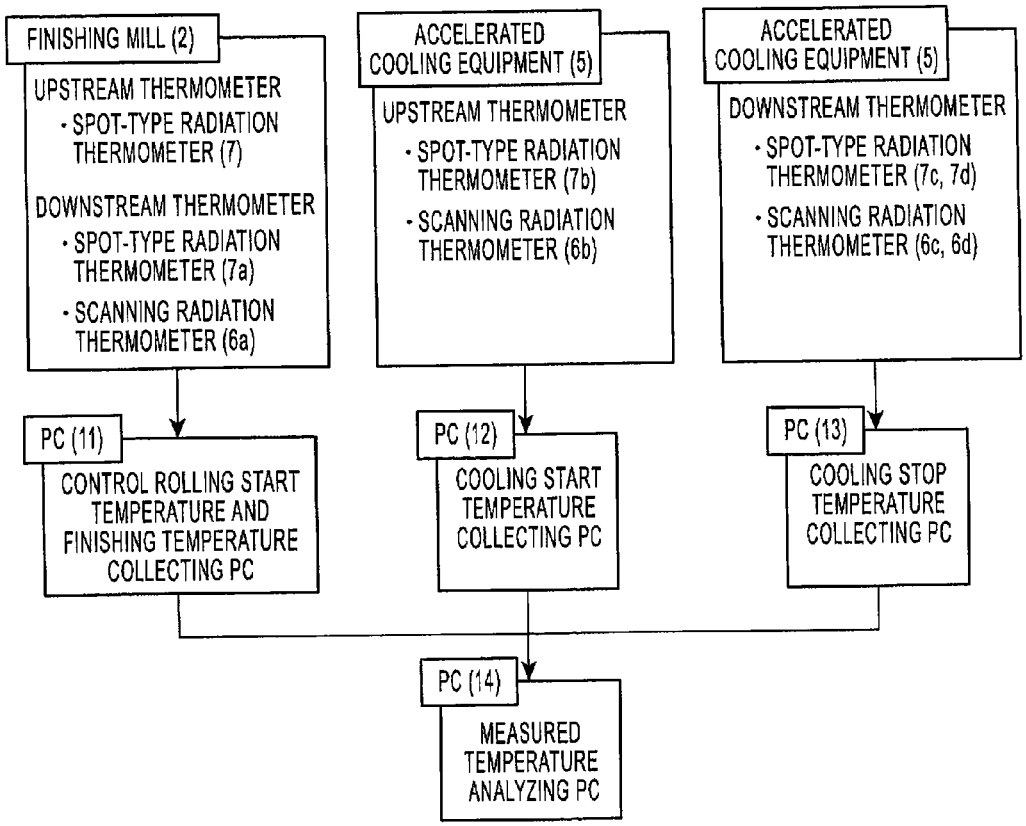
FIG. 26 is a diagram for describing a propagation step of temperature information according to an embodiment of the present invention.

6*a*, 6*b*, 6*c*, and 6*d* denote scanning radiation thermometers, 6*a* measures a temperature distribution in the width direction and the length direction of a steel plate immediately after finishing rolling, and the data thereof is, as illustrated in FIG. 26, transmitted to the controlled rolling start temperature+finishing temperature collecting PC (process computer) 11. 6*b* is installed on the upstream side of the accelerated cooling equipment, and measures a temperature distribution in the width direction and in the length direction of the upper surface of the steel plate immediately before accelerated cooling, and the data thereof is transmitted to the cooling start temperature collecting PC 12. 6*c* and 6*d* are installed on the downstream side of the accelerated cooling equipment, 6*c* denotes a high-temperature thermometer, 6*d* denotes a low-temperature thermometer, both of which measure a temperature distribution in the width direction and in the length direction of the upper surface of the steel plate immediately after accelerated cooling, and the data thereof is transmitted to the cooling stop temperature collecting PC 13. 6*c* is used for the temperature management of an accelerated cooling material, and 6*d* is used for the temperature management of a direct quenching material.

Next, a step wherein the steel plate temperature information measured at each thermometer is transmitted to a PC will be described with reference to FIG. 26. 11 denotes a controlled rolling start temperature+finishing temperature collecting PC, 12 denotes a cooling start temperature collecting PC, 13 denotes a cooling stop temperature collecting PC, and 14 denotes a measured temperature analyzing PC.

The steel plate temperature information measured by the spot type radiation thermometers 7 and 7*a* installed on the upstream side and the downstream side of the finishing mill, and the scanning radiation thermometer 6*a* installed on the downstream side of the finishing mill is transmitted to the controlled rolling start temperature+finishing temperature collecting PC 11, where rolling temperature management such as controlled rolling start temperature, rolled finishing temperature, and so forth, and management of the temperature distribution of the upper surface of the steel plate in the width direction and in the length direction of the steel plate immediately after rolling measured by the scanning radiation thermometer 6*a* are performed.

The steel plate temperature information measured by the spot type radiation thermometer 7*b* and the scanning radiation thermometer 6*b*, installed on the upstream side of the accelerated cooling equipment 5 is transmitted to the cooling start temperature collecting PC 12, where the steel plate temperature management before starting accelerated cooling, and management of a temperature distribution in the width direction and in the length direction of the steel plate are performed.

The steel plate temperature information measured by the spot type radiation thermometers 7*c* and 7*d* and the scanning radiation thermometers 6*c* and 6*d*, installed on the downstream side of the accelerated cooling equipment 5 is transmitted to the cooling stop temperature collecting PC 13, where accelerated cooling stop temperature management, and management of a temperature distribution in the width direction and in the length direction of the steel plate are performed. Note that 7*c* denotes a high-temperature thermometer, and 7*d* denotes a low-temperature thermometer.

Subsequently, the steel plate temperature information collected at the controlled rolling start temperature+finishing temperature collecting PC 11, the cooling start temperature collecting PC 12, and the cooling stop temperature collecting PC 13 is transmitted to the measured temperature analyzing PC 14.

With actual equipment production, an operating control temperature (controlled rolling start temperature, steel plate finishing temperature, cooling start temperature, cooling stop temperature transmitted from the spot type radiation thermometers 7, 7*a*, 7*b*, 7*c*, and 7*d*) range, and the measured temperature input to the measured temperature analyzing PC 14 are compared, and quality determination is performed, thereby assuring the quality of the whole of a steel plate.

Note that the measured temperature analyzing PC 14 recognizes the whole temperature on the upstream side and downstream side of the finishing mill, and on the upstream side and downstream side of the accelerated cooling equipment, determines the quality from a particular threshold value, a temperature allowable range, a calculation model of a mechanical property, or the like, and outputs information of a cut portion whereby desired quality can be secured from a large plate, or the like.

Also, the water flow rate of the accelerated cooling equipment is controlled in the steel-plate-width direction and in the steel-plate-longitudinal direction from the temperature distribution in the steel-plate-width direction and in the steel-plate-longitudinal direction, whereby defective shape and defective quality due to cooling unevenness can be reduced.

According to aspects of the present invention, advantages are obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Seventh Embodiment

Figure 27:
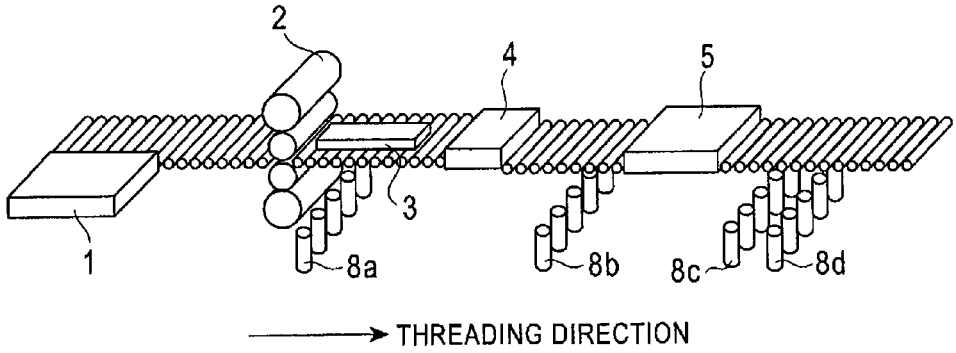
FIG. 27 is a diagram illustrating an embodiment of the outline of steel plate quality assurance equipment according to an embodiment of the present invention.

FIG. 27 illustrates the outline of a steel plate quality assurance system according to an embodiment of the present invention including the above steel plate measurement means.

Figure 28:
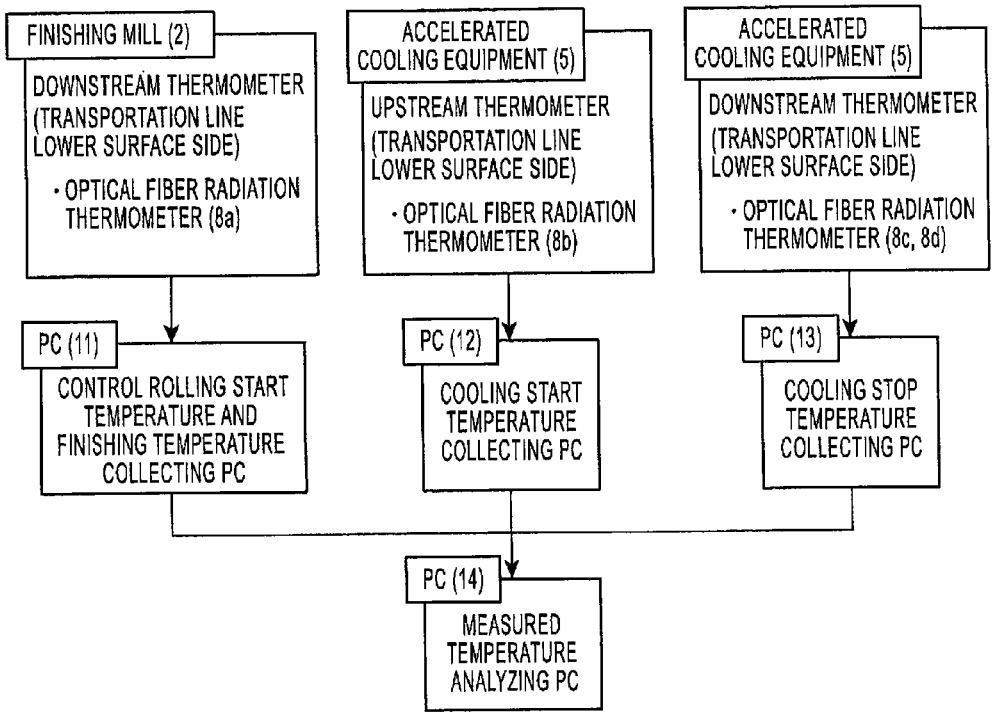
FIG. 28 is a diagram for describing a propagation step of temperature information according to an embodiment of the present invention.

A steel plate manufacturing line includes the heating furnace 1, finishing mill 2, CR cooling shower 4, and accelerated cooling equipment 5, and FIG. 27 illustrates a state in which the steel plate 3 is positioned between the finishing mill 2 and the CR cooling shower 4. 8*a*, 8*b*, 8*c*, and 8*d* denote optical fiber radiation thermometers, 8*a* measures a temperature distribution in the width direction and the length direction of the lower surface of a steel plate immediately after finishing rolling, and the data thereof is, such as illustrated in FIG. 28, transmitted to the controlled rolling start temperature+finishing temperature collecting PC 11. 8*b* is installed on the upstream side of the accelerated cooling equipment, and measures a temperature distribution in the width direction and in the length direction of the upper surface of the steel plate immediately before accelerated cooling, and the data thereof is transmitted to the cooling start temperature collecting PC 12. 8*c* and 8*d* are installed on the downstream side of the accelerated cooling equipment, 8*c* denotes a high-temperature thermometer, 8*d* denotes a low-temperature thermometer, both of which measure a temperature distribution in the width direction and in the length direction of the upper surface of the steel plate immediately after accelerated cooling, and the data thereof is transmitted to the cooling stop temperature collecting PC 13. 8*c* is used for the temperature management of an accelerated cooling material, and 8*d* is used for the temperature management of a direct quenching material.

Next, a step wherein the temperature information of the lower surface of the steel plate measured by each thermometer is transmitted to a PC will be described with reference to FIG. 28. 11 denotes a controlled rolling start temperature+finishing temperature collecting PC, 12 denotes a cooling start temperature collecting PC, 13 denotes a cooling stop temperature collecting PC, and 14 denotes a measured temperature analyzing PC. The temperature information of the lower surface of the steel plate measured by the optical fiber radiation thermometer 8*a* installed on the lower surface side of the transportation line and on the downstream side of the finishing mill is transmitted to the finishing temperature collecting PC 11, where rolling temperature management such as rolling temperature, finishing rolling temperature, and so forth, and management of the temperature distribution in the width direction and in the length direction of the lower surface of the steel plate immediately after rolling measured by the optical fiber radiation thermometer 8*a* are performed.

The temperature information of the lower surface of the steel plate measured by the optical fiber radiation thermometer 8*b* is transmitted to the cooling start temperature collecting PC 12, where the temperature management of the lower surface of the steel plate before starting accelerated cooling, and management of a temperature distribution in the width direction and in the length direction of the lower surface of the steel plate are performed.

The temperature information of the lower surface of the steel plate measured by the optical fiber radiation thermometers 8*c* and 8*d* installed on the downstream side of the accelerated cooling equipment 5 is transmitted to the cooling stop temperature collecting PC 13, where accelerated cooling stop temperature management, and management of a temperature distribution in the width direction and in the length direction of the lower surface of the steel plate are performed. Note that 8*c* denotes a high-temperature thermometer, and 8*d* denotes a low-temperature thermometer.

Subsequently, the temperature information of the lower surface of the steel plate collected by the controlled rolling start temperature+finishing temperature collecting PC 11, the cooling start temperature collecting PC 12, and the cooling stop temperature collecting PC 13 is transmitted to the measured temperature analyzing PC 14.

With actual equipment production, an operating control temperature (steel plate finishing temperature, cooling start temperature, cooling stop temperature obtained from the spot type radiation thermometers) range, and the measured temperature input to the measured temperature analyzing PC 14 are compared, and quality determination is performed, thereby assuring the quality of the whole steel plate. Note that the measured temperature analyzing PC 14 recognizes the whole temperature on the downstream side of the finishing mill (downstream side), and on the upstream side and downstream side of the accelerated cooling equipment (upstream side and downstream side), determines the quality from a particular threshold value, a temperature allowable range, a calculation model of a mechanical property, or the like, and outputs information of a cut portion whereby desired quality can be secured from a large plate, or the like.

Also, the water flow rate of the lower surface side of the steel plate of the accelerated cooling equipment is controlled in the width direction of the surface of the steel plate from the temperature distribution in the width direction and in the longitudinal direction of the lower surface of the steel plate, or the water flow rate of the accelerated cooling equipment is controlled in the steel-plate-width direction and in the steel-plate-longitudinal direction from the temperature distribution in the steel-plate-width direction and in the steel-plate-longitudinal direction, whereby defective shape and defective quality due to cooling unevenness can be reduced.

According to aspects of the present invention, advantages are obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Eighth Embodiment

Figure 29:
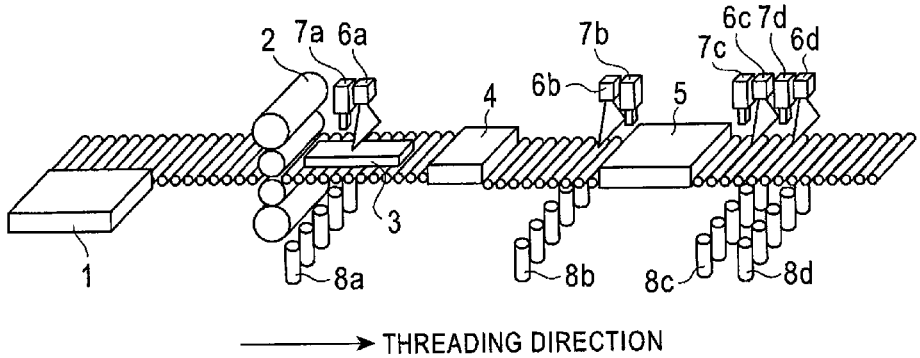
FIG. 29 is a diagram illustrating an embodiment of the outline of steel plate quality assurance equipment according to an embodiment of the present invention.
Figure 30:
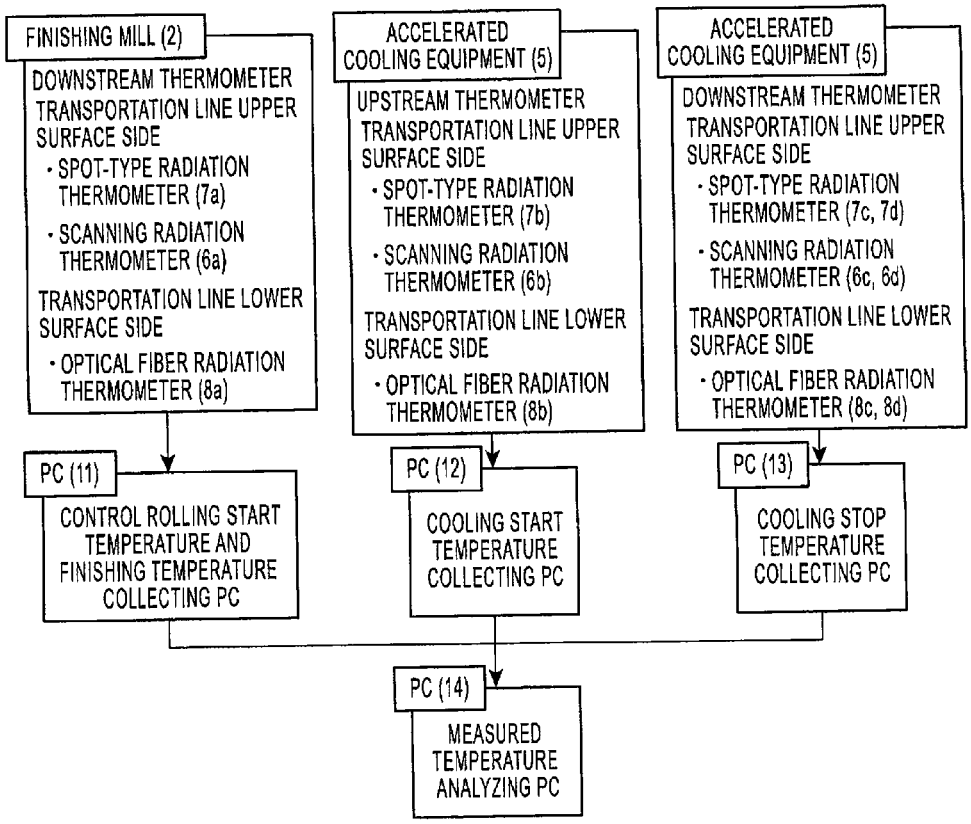
FIG. 30 is a diagram for describing propagation flow of temperature information according to an embodiment of the present invention.

FIG. 29 illustrates an embodiment of the outline of a steel plate quality assurance system according to an embodiment of the present invention including the above steel plate temperature measurement means, and FIG. 30 illustrates a portion of the configuration of the temperature measurement means according to an embodiment of the present invention.

A steel plate manufacturing line includes the heating furnace 1, finishing mill 2, CR cooling shower 4, and accelerated cooling equipment 5, and FIG. 29 illustrates a state in which the steel plate 3 is positioned between the finishing mill 2 and the CR cooling shower 4.

7*a* through 7*d* denote spot type radiation thermometers, 6*a* through 6*d* denote scanning radiation thermometers, 7*a* measures a temperature distribution in the steel-plate-length direction immediately after finishing rolling, 6*a* measures a temperature distribution in the width direction and in the length direction of the upper surface of the steel plate immediately after finishing rolling, and the data thereof is, such as illustrated in FIG. 30, transmitted to the controlled rolling start temperature+finishing temperature collecting PC 11. 7*b* and 6*b* are installed on the upstream side of the accelerated cooling equipment, 6*b* measures a temperature distribution in the width direction and in the length direction of the upper surface of the steel plate immediately before accelerated cooling, 7*b* measures a temperature distribution in the length direction, and the data thereof is transmitted to the cooling start temperature collecting PC 12. 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of the steel plate immediately after accelerated cooling, 7*c* and 7*d* measure a temperature distribution in the length direction, and the data thereof is transmitted to the cooling stop temperature collecting PC 13. 7*c* and 6*c* are used for the temperature management of an accelerated cooling material, and 7*d* and 6*d* are used for the temperature management of a direct quenching material.

8*a* through 8*d* denote optical fiber radiation thermometers, 8*a* measures a temperature distribution in the width direction and in the length direction of the lower surface of the steel plate immediately after finishing rolling, and the data thereof is transmitted to the controlled rolling start temperature+finishing temperature collecting PC 11. 8*b* is installed on the upstream side of the accelerated cooling equipment, and measures a temperature distribution in the width direction and in the length direction of the lower surface of the steel plate immediately before accelerated cooling, and the data thereof is transmitted to the cooling start temperature collecting PC 12. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is preferably used for the temperature management of an accelerated cooling material, and 8*d* is preferably used for the temperature management of a direct quenching material.

Next, a step wherein the steel plate temperature information measured at each thermometer is transmitted to each PC will be described with reference to FIG. 30 and FIG. 31. 11 denotes a controlled rolling start temperature+finishing temperature collecting PC, 12 denotes a cooling start temperature collecting PC, 13 denotes a cooling stop temperature collecting PC, and 14 denotes a measured temperature analyzing PC.

The temperature information of the upper surface of the steel plate measured by the spot type radiation thermometer 7*a* and the scanning radiation thermometer 6*a* installed on the downstream side of the finishing mill, and the temperature information of the lower surface of the steel plate measured by the optical fiber radiation thermometer 8*a* are transmitted to the finishing temperature collecting PC 11 via the temperature collecting PC 15*a* for the upper surface of the steel plate, and the temperature collecting PC 16*a* for the lower surface of the steel plate, where rolling temperature management such as rolling start temperature, rolling end temperature, and so forth, and management of the temperature distribution in the width direction and in the length direction of the lower surface of the steel plate are performed.

The temperature information of the upper surface of the steel plate measured by the spot type radiation thermometer 7*b* and the scanning radiation thermometer 6*b*, installed on the upstream side of the accelerated cooling equipment 5, and the temperature information of the lower surface of the steel plate measured by the optical fiber radiation thermometer 8*b*, are transmitted to the cooling start temperature collecting PC 12 via the temperature collecting PC 15*b* for the upper surface of the steel plate, and the temperature collecting PC 16*b* for the lower surface of the steel plate, where the steel plate temperature management before starting accelerated cooling, and management of a temperature distribution in the width direction and in the length direction of the steel plate are performed.

The temperature information of the upper surface of the steel plate measured by the spot type radiation thermometers 7*c* and 7*d*, and the scanning radiation thermometers 6*c* and 6*d*, installed on the downstream side of the accelerated cooling equipment 5, and the temperature information of the lower surface of the steel plate measured by the optical fiber radiation thermometers 8*c* and 8*d*, are transmitted to the cooling stop temperature collecting PC 13 via the temperature collecting PC 15*c* for the upper surface of the steel plate, and the temperature collecting PC 16*c* for the lower surface of the steel plate, where accelerated cooling stop temperature management, and management of a temperature distribution in the width direction and in the length direction of the steel plate are performed.

Figure 31:
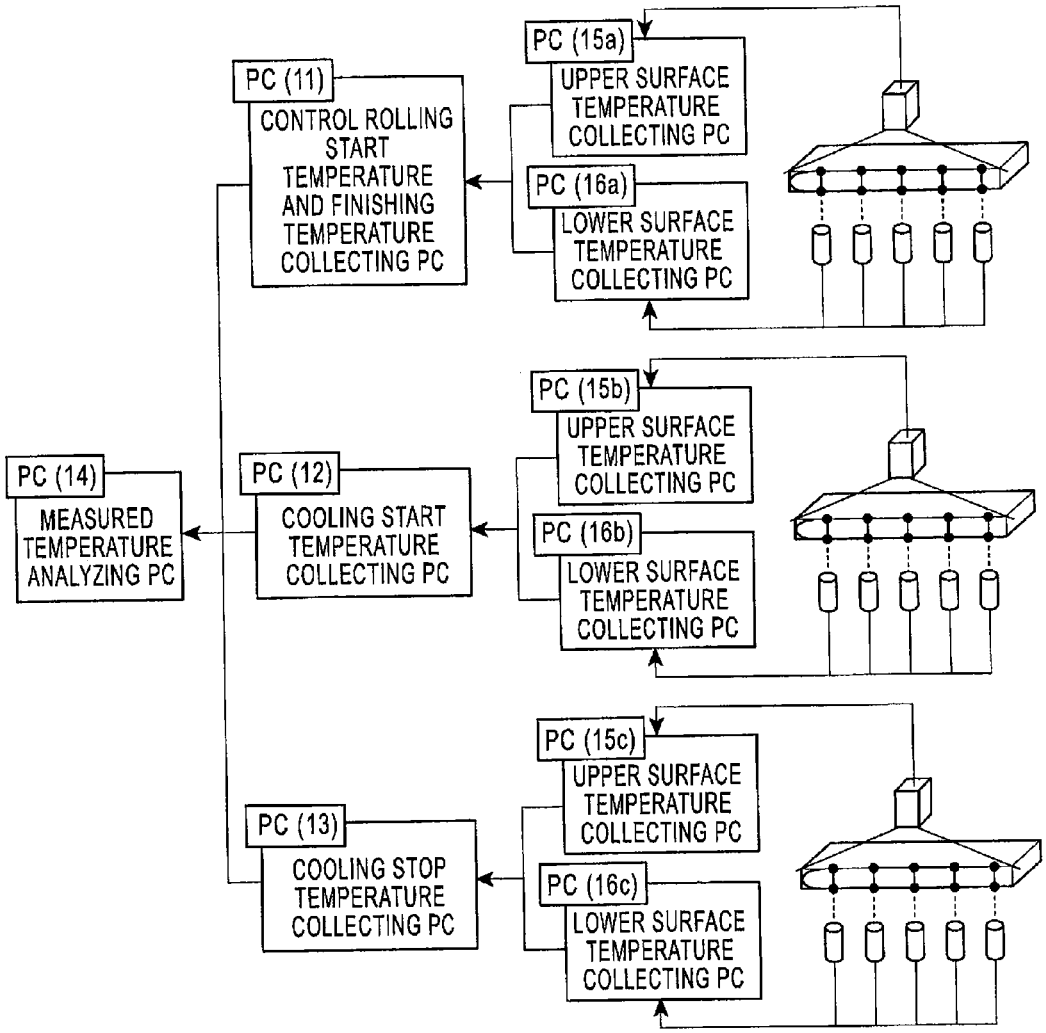
FIG. 31 is a diagram for describing propagation flow of temperature information of the upper and lower surfaces of a steel plate according to an embodiment of the present invention.

With regard to the controlled rolling start temperature+finishing temperature collecting PC 11, cooling start temperature collecting PC 12, and cooling stop temperature collecting PC 13, as illustrated in FIG. 31, the controlled rolling start temperature+finishing rolling temperature collecting PC 11 is made up of the temperature collecting PC 15*a* for the upper surface of the steel plate, and the temperature collecting PC 16*a* for the lower surface of the steel plate, the cooling start temperature collecting PC 12 is made up of the temperature collecting PC 15*b* for the upper surface of the steel plate, and the temperature collecting PC 16*b* for the lower surface of the steel plate, and the cooling stop temperature collecting PC 13 is made up of the temperature collecting PC 15*c* for the upper surface of the steel plate, and the temperature collecting PC 16*c* for the lower surface of the steel plate; the steel plate temperature collected by the temperature collecting PCs of each of the lower and upper surfaces is input to the measured temperature analyzing PC 14 via the controlled rolling start temperature+finishing temperature collecting PC 11, cooling start temperature collecting PC 12, and cooling stop temperature collecting PC 13.

With the actual equipment production, the operating control temperature (controlled rolling start temperature, steel plate finishing temperature, cooling start temperature, and cooling stop temperature) range, and the measured temperature input to the measured temperature analyzing PC 14 are compared, and quality determination is carried out, whereby the quality of the whole area of a steel plate can be assured.

Note that the measured temperature analyzing PC 14 recognizes the whole temperature on the downstream side of the finishing mill, and on the input downstream side of the accelerated cooling equipment, determines the quality from a particular threshold value, allowable temperature range, a calculation model of a mechanical property, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, the water flow rate of the accelerated cooling equipment is controlled in the width direction and in the longitudinal direction from the temperature distribution in the width direction and in the longitudinal direction of a steel plate, whereby poor shape of steel plate can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Ninth Embodiment

Figure 32:
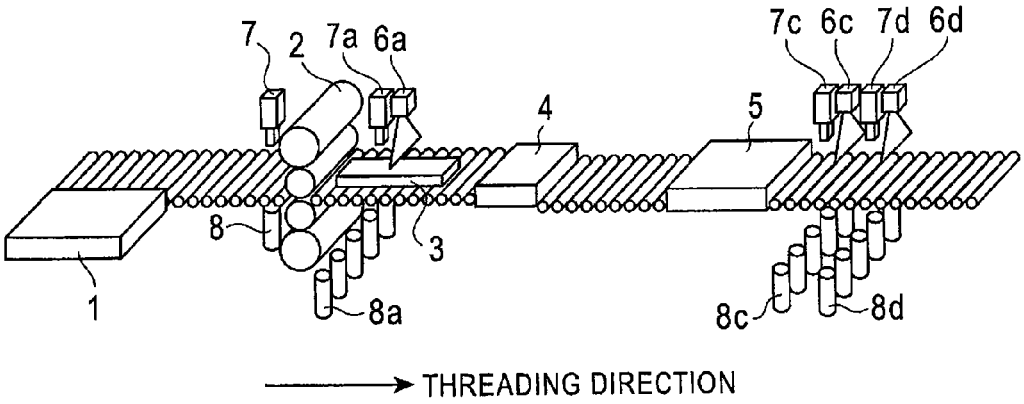
FIG. 32 is a diagram illustrating an embodiment of the outline of steel plate quality assurance equipment according to an embodiment of the present invention.
Figure 33:
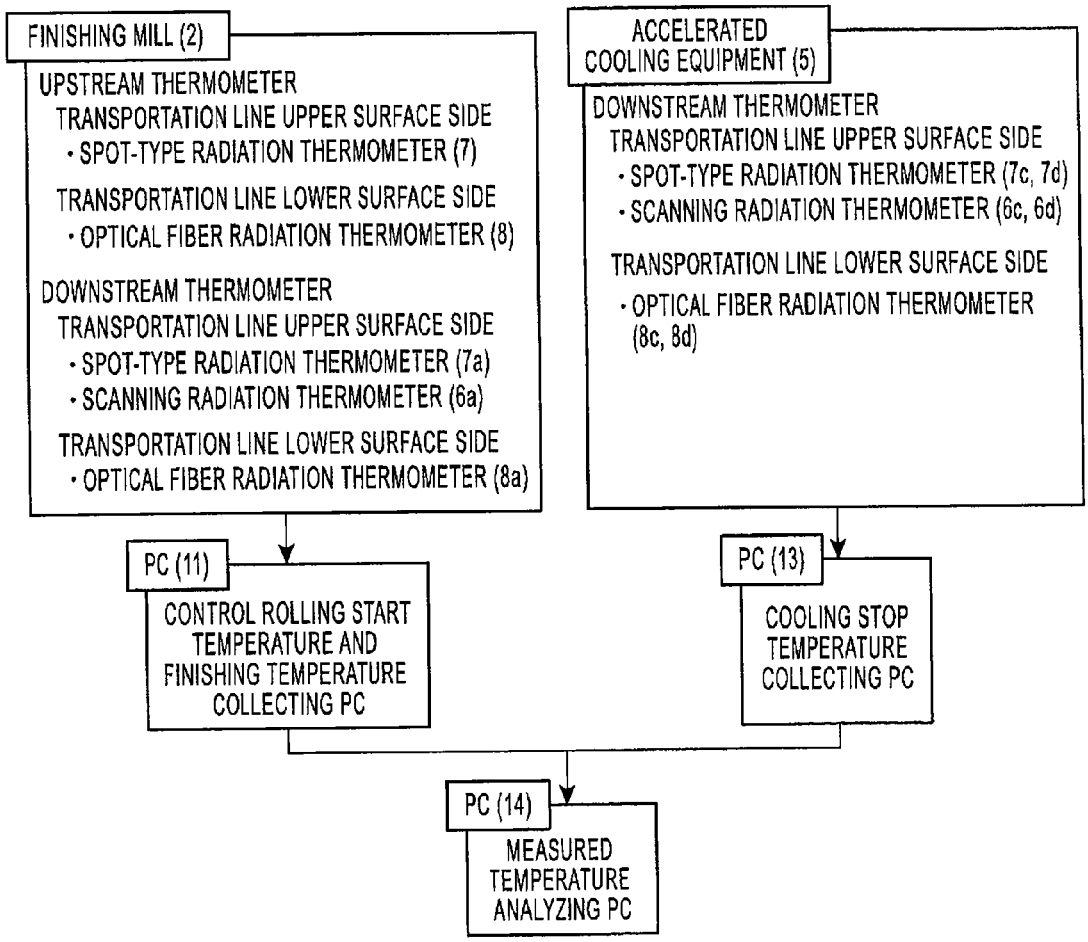
FIG. 33 is a diagram for describing propagation flow of temperature information according to an embodiment of the present invention.

FIG. 32 illustrates an embodiment of the outline of a steel plate quality assurance system according to the present invention including the above steel plate temperature measurement means, and FIG. 33 illustrates propagation flow of temperature information according to an embodiment of the present invention.

A steel plate manufacturing line includes the heating furnace 1, finishing mill 2, CR cooling shower 4, and accelerated cooling equipment 5, and FIG. 32 illustrates a state in which the steel plate 3 is positioned between the finishing mill 2 and the CR cooling shower 4.

7, 7*a*, 7*c*, and 7*d* denote spot type radiation thermometers, 6*a*, 6*c*, and 6*d* denote scanning radiation thermometers, 7 and 7*a* are installed near the finishing mill, and measure rolling end temperature during rolling, 6*b* measures a temperature distribution in the width direction, and in the length direction of the upper surface of a steel plate immediately after finishing rolling, and the data thereof is, such as illustrated in FIG. 33, transmitted to the controlled rolling start temperature+finishing temperature collecting PC 11. 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of the steel plate immediately before accelerated cooling, 7*c* and 7*d* measure a temperature distribution in the length direction, and the data thereof is transmitted to the cooling stop temperature collecting PC 13. 7*c* and 6*c* are used for the temperature management of an accelerated cooling material, and 7*d* and 6*d* are used for the temperature management of a direct quenching material.

8, 8*a*, 8*c*, and 8*d* denote optical fiber radiation thermometers, 8*a* measures a temperature distribution in the width direction and in the length direction of the lower surface of the steel plate immediately after finishing rolling, and the data thereof is transmitted to the controlled rolling start temperature+finishing temperature collecting PC 11 along with 8. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is preferably used for the temperature management of an accelerated cooling material, and 8*d* is preferably used for the temperature management of a direct quenching material.

Next, propagation flow wherein the steel plate temperature information measured by each thermometer is transmitted to each PC will be described with reference to FIG. 33 and FIG. 34. 11 denotes a controlled rolling start temperature+finishing temperature collecting PC, 13 denotes a cooling stop temperature collecting PC, and 14 denotes a measured temperature analyzing PC.

The temperature information of the upper surface of the steel plate measured by the spot type radiation thermometers 7 and 7*a* and the scanning radiation thermometer 6*a* installed on the upstream side and the downstream side of the finishing mill, and the temperature information of the lower surface of the steel plate measured by the optical fiber radiation thermometers 8 and 8*a* are transmitted to the finishing temperature collecting PC 11 via the temperature collecting PC 15*a* for the upper surface of the steel plate, and the temperature collecting PC 16*a* for the lower surface of the steel plate, where rolling temperature management such as rolling start temperature, rolling end temperature, and so forth, and management of the temperature distribution in the width direction and in the length direction of the steel plate are performed.

The temperature information of the upper surface of the steel plate measured by the spot type radiation thermometers 7*c* and 7*d* and the scanning radiation thermometers 6*c* and 6*d*, installed on the downstream side of the accelerated cooling equipment 5, and the temperature information of the lower surface of the steel plate measured by the optical fiber radiation thermometer 8*c* and 8*d*, are transmitted to the cooling stop temperature collecting PC 13 via the temperature collecting PC 15*c* for the upper surface of the steel plate, and the temperature collecting PC 16*c* for the lower surface of the steel plate, where accelerated cooling stop temperature management, and management of a temperature distribution in the width direction and in the length direction of the steel plate are performed.

Figure 34:
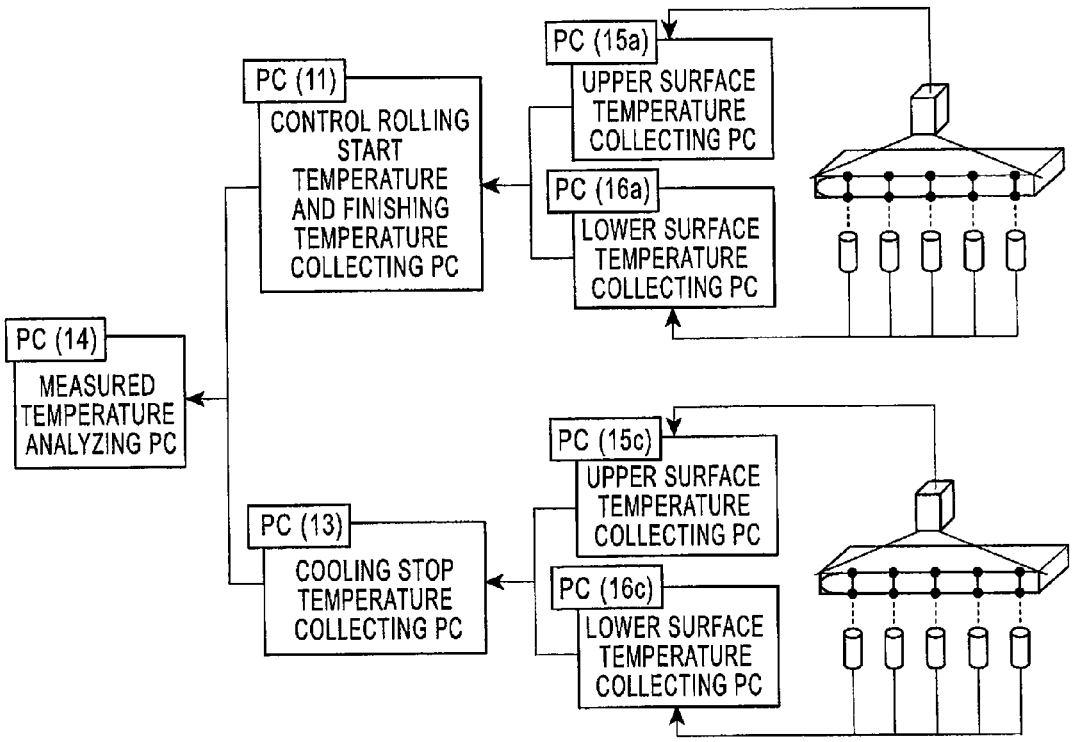
FIG. 34 is a diagram for describing propagation flow of temperature information of the upper and lower surfaces of a steel plate according to an embodiment of the present invention.

The controlled rolling start temperature+finishing temperature collecting PC 11, and cooling stop temperature collecting PC 13 are, such as illustrated in FIG. 34, made up of the temperature collecting PCs 15*a* and 15*c* for the upper surface of the steel plate, and the temperature collecting PCs 16*a* and 16*c* for the lower surface of the steel plate respectively, and each of the temperatures of the lower surface of the steel plate, and the temperatures of the lower surface of the steel plate is input to the measured temperature analyzing PC 14.

With the actual equipment production, the operating control temperature (controlled rolling start temperature, rolling finishing temperature, cooling start temperature, and cooling stop temperature) range, and the measured temperature input to the measured temperature analyzing PC 14 are compared, and quality determination is carried out, whereby the quality of the whole area of a steel plate can be assured.

Note that the measured temperature analyzing PC 14 recognizes the whole temperature on the downstream side of the finishing mill, and on the downstream side of the accelerated cooling equipment, determines the quality from a particular threshold value, allowable temperature range, a calculation model of a mechanical property, and so forth, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby steel plate defective shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the relate art, and so forth.

Tenth Embodiment

Figure 35:
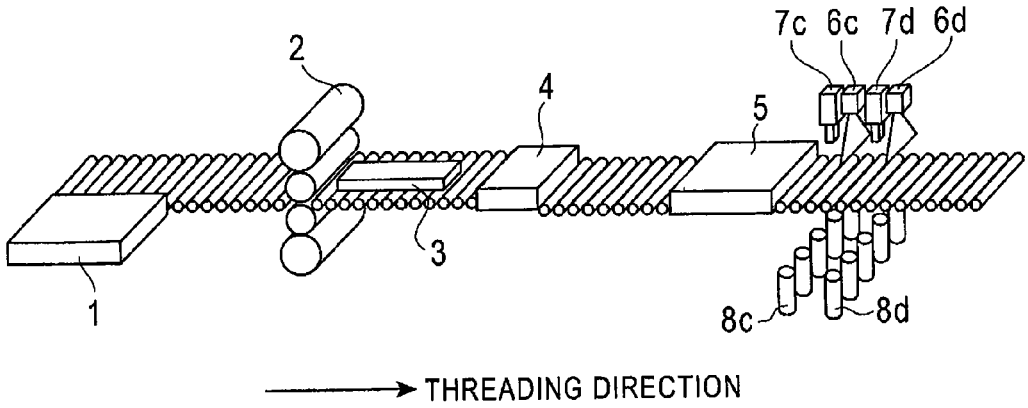
FIG. 35 is a diagram illustrating an embodiment of the outline of steel plate quality assurance equipment according to the present invention.
Figure 36:
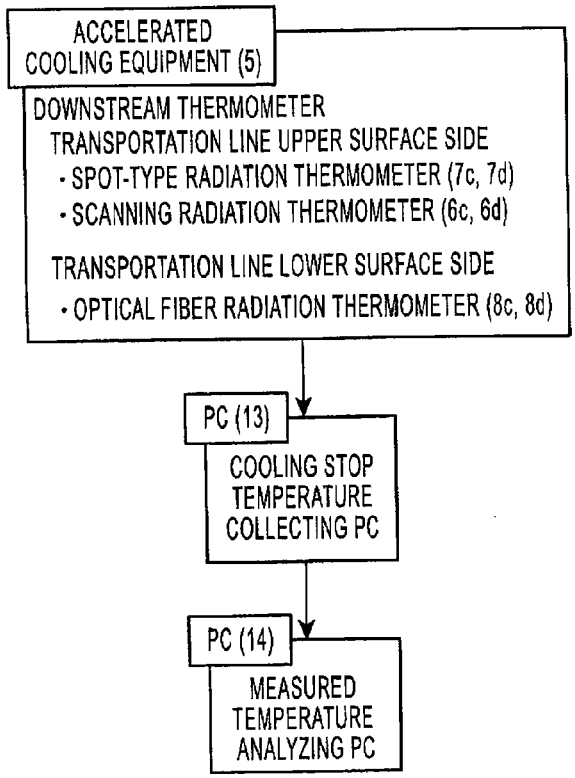
FIG. 36 is a diagram for describing propagation flow of temperature information according to an embodiment of the present invention.

FIG. 35 illustrates an embodiment of the outline of steel plate quality assurance equipment according to the present invention including the above steel plate temperature measurement means, and FIG. 36 illustrates propagation flow of temperature information according to the present invention.

A steel plate manufacturing line includes the heating furnace 1, finishing mill 2, CR cooling shower 4, and accelerated cooling equipment 5, and FIG. 35 illustrates a state in which the steel plate 3 is positioned between the finishing mill 2 and the CR cooling shower 4.

7*c* and 7*d* denote spot type radiation thermometers, 6*c* and 6*d* denote scanning radiation thermometers, 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of a steel plate immediately after accelerated cooling, 7*c* and 7*d* measure a temperature distribution in the length direction, and the data thereof is transmitted to the cooling stop temperature collecting PC 13. 7*c* and 6*c* are used for the temperature management of an accelerated cooling material, and 7*d* and 6*d* are used for the temperature management of a direct quenching material.

8*c* and 8*d* denote optical fiber radiation thermometers, which are installed on the downstream side of the accelerated cooling equipment, 8*c* is a high-temperature thermometer, 8*d* is a low-temperature thermometer, both measure a temperature distribution in the width direction and in the length direction of the lower surface of a steel plate immediately after accelerated cooling, and the data thereof is transmitted to the cooling stop temperature collecting PC 13. 8*c* is preferably used for the temperature management of an accelerated cooling material, and 8*d* is preferably used for the temperature management of a direct quenching material.

Next, propagation flow wherein the steel plate temperature information measured by each thermometer is transmitted to each PC will be described with reference to FIG. 36. 13 denotes a cooling stop temperature collecting PC, and 14 denotes a measured temperature analyzing PC.

The temperature information of the upper surface of the steel plate measured by the spot type radiation thermometers 7*c* and 7*d* and the scanning radiation thermometers 6*c* and 6*d* installed on the downstream side of the accelerated cooling equipment 5, and the temperature information of the lower surface of the steel plate measured by the optical fiber radiation thermometers 8*c* and 8*d* are transmitted to the cooling stop temperature collecting PC 13, where accelerated cooling stop temperature management, and management of the temperature distribution in the width direction and in the length direction of the steel plate are performed.

Figure 37:
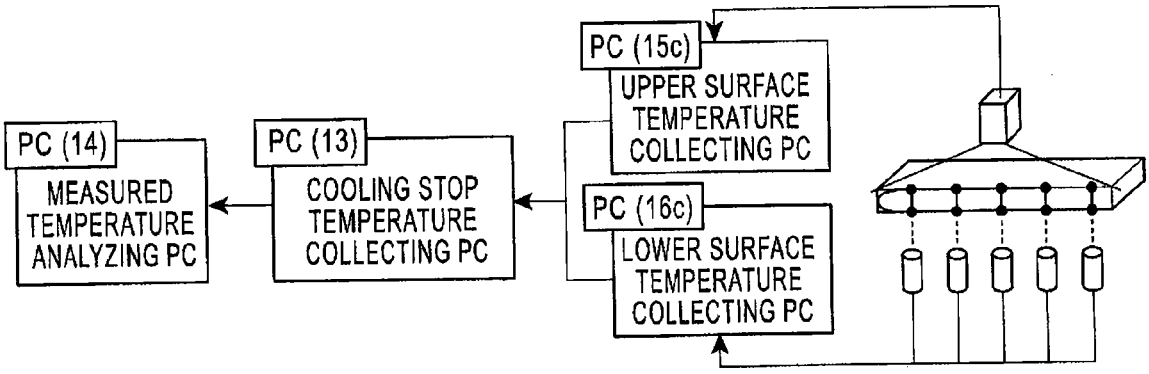
FIG. 37 is a diagram for describing propagation flow of temperature information of the upper and lower surfaces of a steel plate according to an embodiment of the present invention.

The cooling stop temperature collecting PC 13 is, such as illustrated in FIG. 37, made up of the temperature collecting PC 15*c* for the upper surface of the steel plate, and the temperature collecting PC 16*c* for the lower surface of the steel plate, and each of the temperatures of the upper surface of the steel plate, and the temperatures of the lower surface of the steel plate is input to the measured temperature analyzing PC 14.

With the actual equipment production, the operating control temperature (cooling stop temperature) range, and the measured temperature input to the measured temperature analyzing PC 14 are compared, and quality determination is carried out, whereby the quality of the whole area of a steel plate can be assured.

Note that the measured temperature analyzing PC 14 recognizes the whole temperature on the downstream side of the accelerated cooling equipment, determines the quality from a particular threshold value, allowable temperature range, a calculation model of a mechanical property, and so forth, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby steel plate defective shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Eleventh Embodiment

Figure 38:
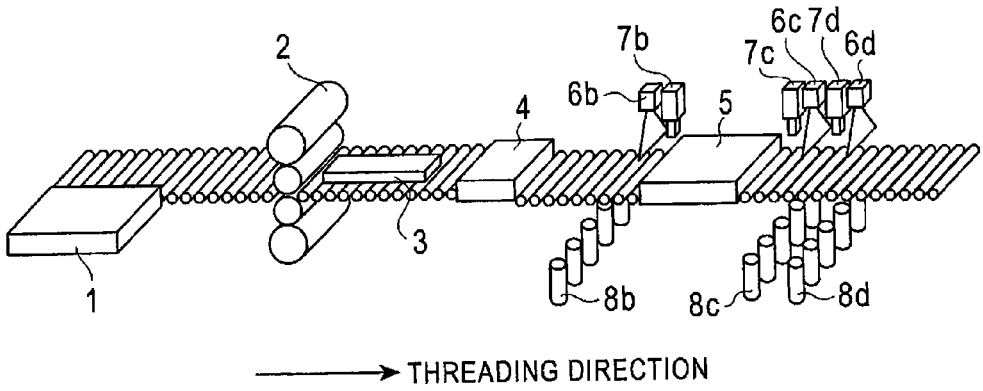
FIG. 38 is a diagram illustrating an embodiment of the outline of steel plate quality assurance equipment according to an embodiment of the present invention.
Figure 39:
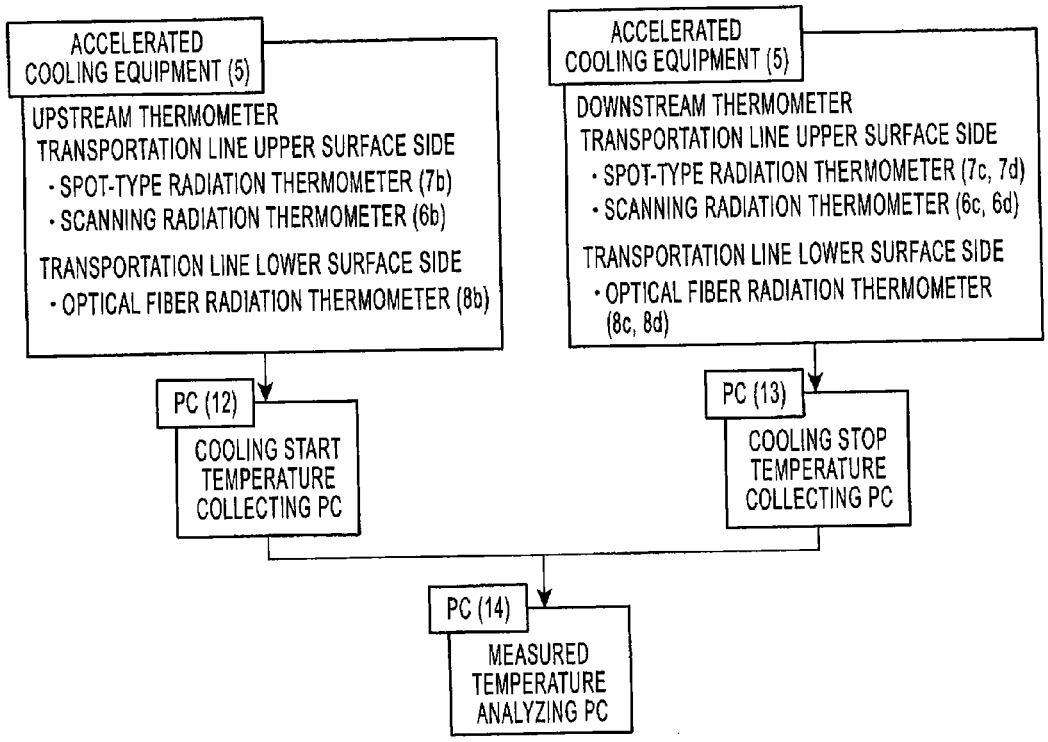
FIG. 39 is a diagram for describing propagation flow of temperature information according to an embodiment of the present invention.

FIG. 38 illustrates an embodiment of the outline of steel plate quality assurance equipment according to the present invention including the above steel plate temperature measurement means, and FIG. 39 illustrates propagation flow of temperature information according to an embodiment of the present invention.

A steel plate manufacturing line includes the heating furnace 1, finishing mill 2, CR cooling shower 4, and accelerated cooling equipment 5, and FIG. 38 illustrates a state in which the steel plate 3 is positioned between the finishing mill 2 and the CR cooling shower 4.

7*b*, 7*c*, and 7*d* denote spot type radiation thermometers, 6*b*, 6*c*, and 6*d* denote scanning radiation thermometers, 7*b* and 6*b* are installed on the upstream side of the accelerated cooling equipment, 6*b* measures a temperature distribution in the width direction and in the length direction of the upper surface of a steel plate immediately after accelerated cooling, 7*b* measures a temperature distribution in the length direction, and the data thereof is transmitted to the cooling start temperature collecting PC 12. 7*c*, 7*d*, 6*c*, and 6*d* are installed on the downstream side of the accelerated cooling equipment, 7*c* and 6*c* are high-temperature thermometers, 6*c* and 6*d* are low-temperature thermometers, 6*c* and 6*d* measure a temperature distribution in the width direction and in the length direction of the upper surface of a steel plate immediately after accelerated cooling, 7*c* and 7*d* measure a temperature distribution in the length direction, and the data thereof is transmitted to the cooling stop temperature collecting PC 13. 7*c* and 6*c* are preferably used for the temperature management of an accelerated cooling material, and 7*d* and 6*d* are preferably used for the temperature management of a direct quenching material.

8*b*, 8*c*, and 8*d* denote optical fiber radiation thermometers, 8*b* measures a temperature distribution in the width direction and in the length direction of the lower surface of a steel plate immediately before accelerated cooling, and the data thereof is transmitted to the cooling start temperature collecting PC 12. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is preferably used for the temperature management of an accelerated cooling material, and 8*d* is preferably used for the temperature management of a direct quenching material.

Next, propagation flow wherein the steel plate temperature information measured by each thermometer is transmitted to each PC will be described with reference to FIG. 39 and FIG. 40. 12 denotes a cooling start temperature collecting PC, 13 denotes a cooling stop temperature collecting PC, and 14 denotes a measured temperature analyzing PC.

The temperature information of the upper surface of the steel plate measured by the spot type radiation thermometer 7*b* and the scanning radiation thermometer 6*b* installed on the upstream side of the accelerated cooling equipment 5, and the temperature information of the lower surface of the steel plate measured by the optical fiber radiation thermometer 8*b* are input to the cooling start temperature collecting PC 12 via the temperature collecting PC 15*b* for the upper surface of the steel plate, and the temperature collecting PC 16*b* for the lower surface of the steel plate, and are transmitted to the measured temperature analyzing PC 14, where steel plate temperature management before starting accelerated cooling, and management of the temperature distribution in the width direction and in the length direction of the steel plate are performed.

The temperature information of the upper surface of the steel plate measured by the spot type radiation thermometers 7*c* and 7*d* and the scanning radiation thermometers 6*c* and 6*d* installed on the downstream side of the accelerated cooling equipment 5, and the temperature information of the lower surface of the steel plate measured by the optical fiber radiation thermometer 8*c* and 8*d* are input to the cooling stop temperature collecting PC 13 via the temperature collecting PC 15*c* for the upper surface of the steel plate, and the temperature collecting PC 16*c* for the lower surface of the steel plate, and are transmitted to the measured temperature analyzing PC 14, where accelerated cooling stop temperature management, and management of the temperature distribution in the width direction and in the length direction of the steel plate are performed.

Figure 40:
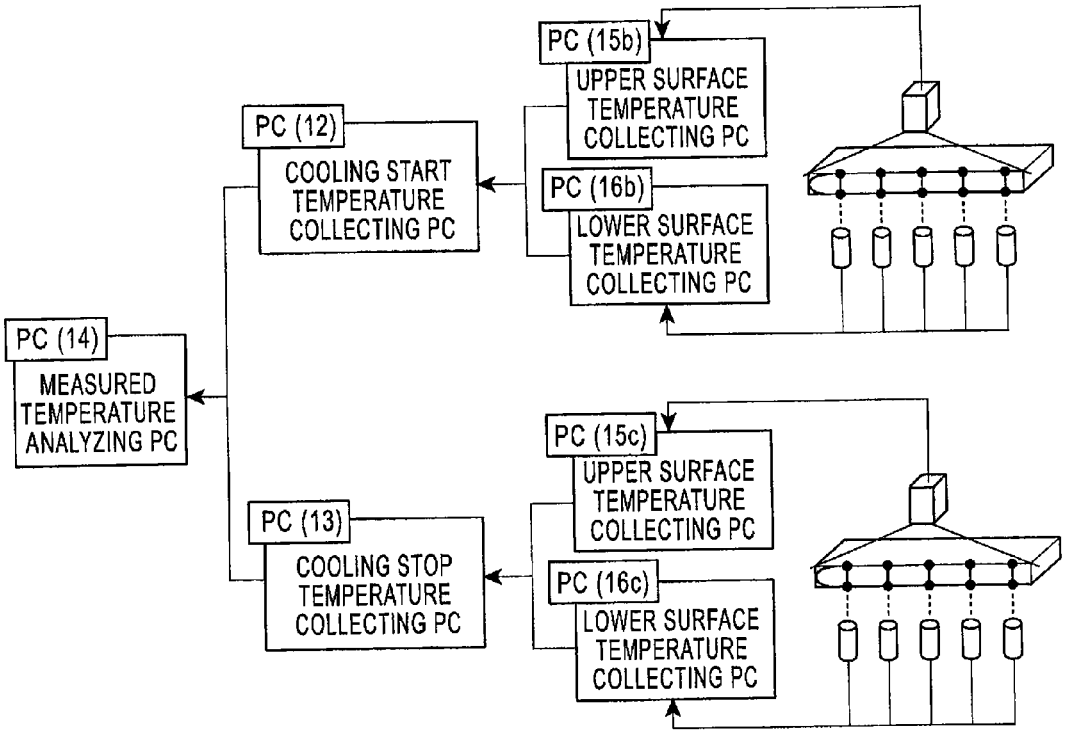
FIG. 40 is a diagram for describing propagation flow of temperature information of the upper and lower surfaces of a steel plate according to an embodiment of the present invention.

With regard to the cooling start temperature collecting PC 12 and the cooling stop temperature collecting PC 13, as illustrated in FIG. 40, the cooling start temperature collecting PC 12 is made up of the temperature collecting PC 15*b* for the upper surface of the steel plate, and the temperature collecting PC 16*b* for the lower surface of the steel plate, the cooling stop temperature collecting PC 13 is made up of the temperature collecting PC 15*c* for the upper surface of the steel plate, and the temperature collecting PC 16*c* for the lower surface of the steel plate, and each of the temperatures of the upper surface of the steel plate, and the temperatures of the lower surface of the steel plate is input to the measured temperature analyzing PC 14 via the cooling start temperature collecting PC 12 and the cooling stop temperature collecting PC 13.

With the actual equipment production, the operating control temperature (cooling start temperature and cooling stop temperature) range, and the measured temperature input to the measured temperature analyzing PC 14 are compared, and quality determination is carried out, whereby the quality of the whole area of a steel plate can be assured.

Note that the measured temperature analyzing PC 14 recognizes the whole temperature on the downstream side of the accelerated cooling equipment, determines the quality from a particular threshold value, allowable temperature range, a calculation model of a mechanical property, and so forth, and outputs the information of a trimmed portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby steel plate defective shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Twelfth Embodiment

Figure 41:
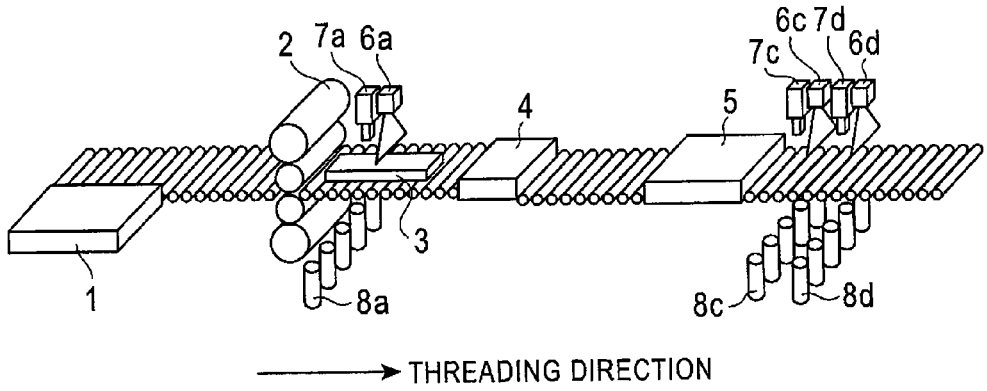
FIG. 41 is a diagram illustrating an embodiment of the outline of steel plate quality assurance equipment according to the present invention.
Figure 42:
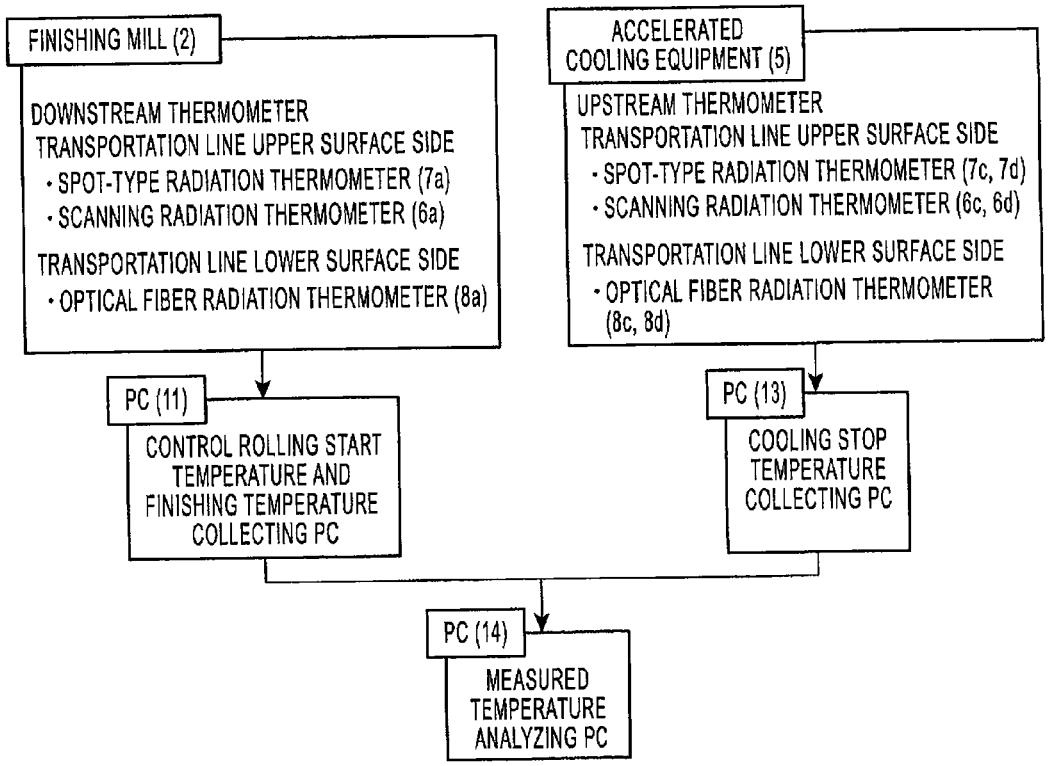
FIG. 42 is a diagram for describing propagation flow of temperature information according to an embodiment of the present invention.

FIG. 41 illustrates an embodiment of the outline of steel plate quality assurance equipment according to the present invention including the above steel plate temperature measurement means, and FIG. 42 illustrates propagation flow of temperature information according to an embodiment of the present invention.

A steel plate manufacturing line includes the heating furnace 1, finishing mill 2, CR cooling shower 4, and accelerated cooling equipment 5, and FIG. 41 illustrates a state in which the steel plate 3 is positioned between the finishing mill 2 and the CR cooling shower 4.

7*a*, 7*c*, and 7*d* denote spot type radiation thermometers, 6*a*, 6*c*, and 6*d* denote scanning radiation thermometers, 7*a* measures a temperature distribution in the length direction of the upper surface of a steel plate immediately after finishing rolling, and as illustrated in FIG. 42, the data thereof is transmitted to the controlled rolling start temperature+finishing rolling temperature collecting PC 11. 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of the steel plate immediately accelerated cooling, 7*c* and 7*d* measure a temperature distribution in the length direction, and the data thereof is transmitted to the cooling stop temperature collecting PC 13. 7*c* and 6*c* are preferably used for the temperature management of an accelerated cooling material, and 7*d* and 6*d* are preferably used for the temperature management of a direct quenching material.

8*a*, 8*c*, and 8*d* denote optical fiber radiation thermometers, 8*a* measures a temperature distribution in the width direction and in the length direction of the lower surface of a steel plate immediately after finishing rolling, and the data thereof is transmitted to the controlled rolling start temperature+finishing temperature collecting PC 11. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is preferably used for the temperature management of an accelerated cooling material, and 8*d* is preferably used for the temperature management of a direct quenching material.

Next, propagation flow wherein the steel plate temperature information measured by each thermometer is transmitted to each PC will be described with reference to FIG. 42 and FIG. 43. 11 denotes a controlled rolling start temperature+finishing temperature collecting PC, 13 denotes a cooling stop temperature collecting PC, and 14 denotes a measured temperature analyzing PC.

The temperature information of the upper surface of the steel plate measured by the spot type radiation thermometer 7*a* and the scanning radiation thermometer 6*a* installed on the downstream side of the finishing mill, and the temperature information of the lower surface of the steel plate measured by the optical fiber radiation thermometer 8*a* are transmitted to the controlled rolling start temperature+finishing temperature collecting PC 11 via the temperature collecting PC 15*a* for the upper surface of the steel plate, and the temperature collecting PC 16*a* for the lower surface of the steel plate, where rolling temperature management such as controlled rolling start temperature, rolling end temperature, and so forth, and management of the temperature distribution in the width direction and in the length direction of the steel plate are performed.

The temperature information of the upper surface of the steel plate measured by the spot type radiation thermometers 7*c* and 7*d* and the scanning radiation thermometers 6*c* and 6*d* installed on the downstream side of the accelerated cooling equipment 5, and the temperature information of the lower surface of the steel plate measured by the optical fiber radiation thermometer 8*c* and 8*d* are transmitted to the cooling stop temperature collecting PC 13 via the temperature collecting PC 15*c* for the upper surface of the steel plate, and the temperature collecting PC 16*c* for the lower surface of the steel plate, where accelerated cooling stop temperature management, and management of the temperature distribution in the length direction of the steel plate are performed.

Figure 43:
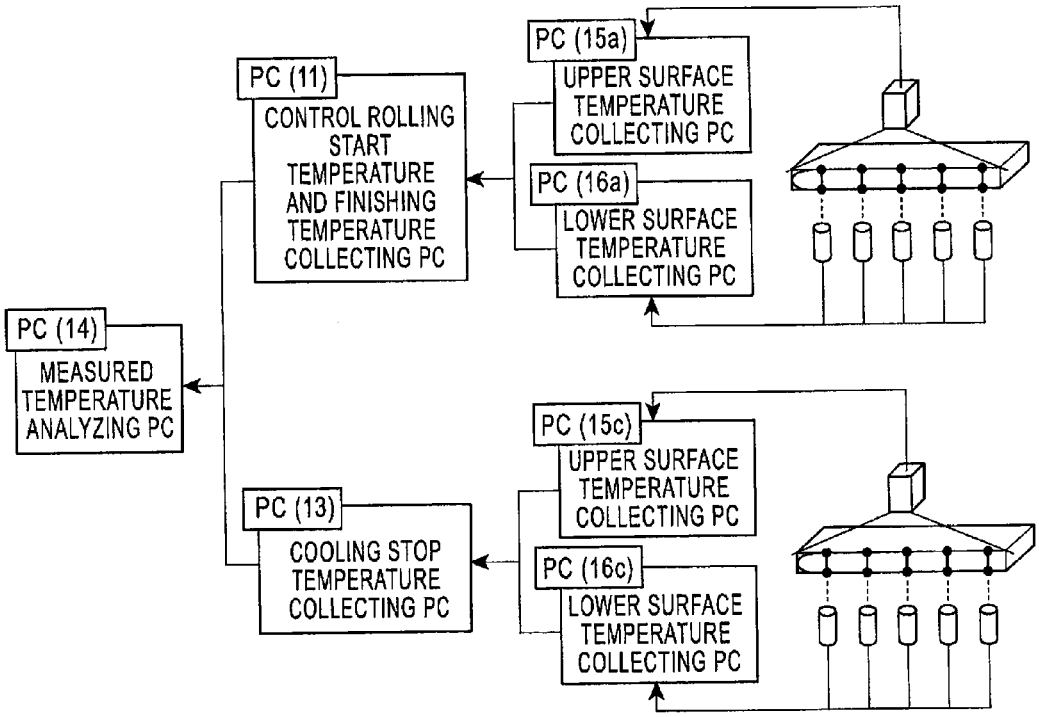
FIG. 43 is a diagram for describing propagation flow of temperature information of the upper and lower surfaces of a steel plate according to an embodiment of the present invention.

With regard to the controlled rolling start temperature+finishing temperature collecting PC 11 and the cooling stop temperature collecting PC 13, as illustrated in FIG. 43, the controlled rolling start temperature+finishing temperature collecting PC 11 is made up of the temperature collecting PC 15*a* for the upper surface of the steel plate, and the temperature collecting PC 16*a* for the lower surface of the steel plate, the cooling stop temperature collecting PC 13 is made up of the temperature collecting PC 15*c* for the upper surface of the steel plate, and the temperature collecting PC 16*c* for the lower surface of the steel plate, and the steel plate temperature collected by each of the temperature collecting PCs of the upper and lower surfaces is input to the measured temperature analyzing PC 14 via the controlled rolling start temperature+finishing temperature collecting PC 11 and the cooling stop temperature collecting PC 13.

With the actual equipment production, the operating control temperature (controlled rolling start temperature+finishing temperature and cooling stop temperature) range, and the measured temperature input to the measured temperature analyzing PC 14 are compared, and quality determination is carried out, whereby the quality of the whole area of a steel plate can be assured.

Note that the measured temperature analyzing PC 14 recognizes the whole temperature on the downstream side of the finishing mill, and on the downstream side of the accelerated cooling equipment, determines the quality from a particular threshold value, allowable temperature range, a calculation model of a mechanical property, and so forth, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby defective steel plate shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Thirteenth Embodiment

Figure 44:
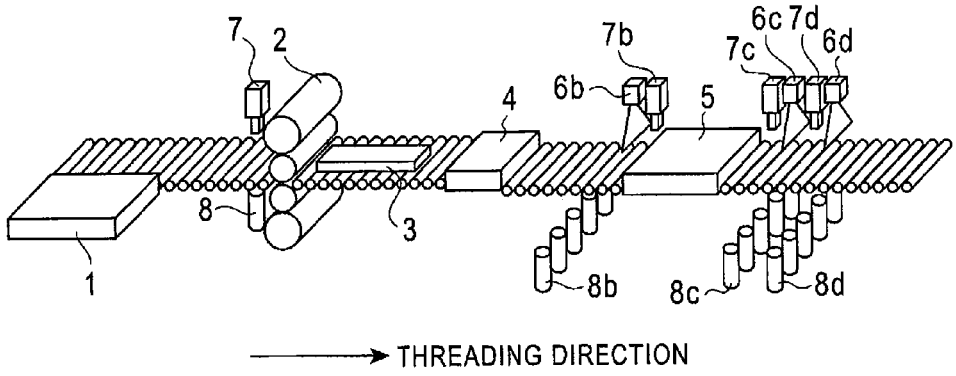
FIG. 44 is a diagram illustrating an embodiment of the outline of steel plate quality assurance equipment according to the present invention.
Figure 45:
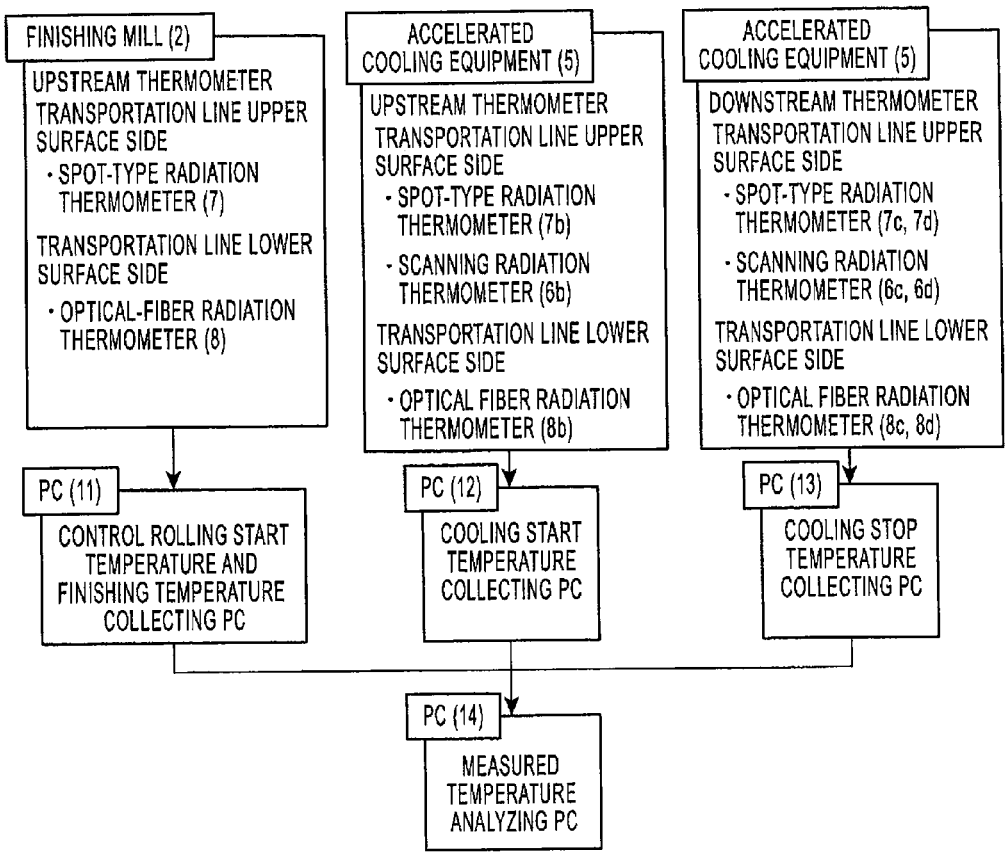
FIG. 45 is a diagram for describing propagation flow of temperature information according to an embodiment of the present invention.

FIG. 44 illustrates an embodiment of the outline of steel plate quality assurance equipment according to the present invention including the above steel plate temperature measurement means, and FIG. 45 illustrates a propagation flow of temperature information according to an embodiment of the present invention.

A steel plate manufacturing line includes the heating furnace 1, finishing mill 2, CR cooling shower 4, and accelerated cooling equipment 5, and FIG. 44 illustrates a state in which the steel plate 3 is positioned between the finishing mill 2 and the CR cooling shower 4.

7, 7*b*, 7*c*, and 7*d* denote spot type radiation thermometers, 6*b*, 6*c*, and 6*d* denote scanning radiation thermometers, 7 and 8 are installed near the finishing mill, and measure finishing rolling temperature during rolling, and the data thereof is transmitted to the controlled rolling start temperature+finishing temperature collecting PC 11. 7*b* and 6*b* are installed on the upstream side of the accelerated cooling equipment, 6*b* measures a temperature distribution in the width direction and in the length direction of the upper surface of a steel plate immediately before accelerated cooling, 7*b* measures a temperature distribution in the length direction, and the data thereof is transmitted to the cooling start temperature collecting PC 12. 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of the steel plate immediately after accelerated cooling, 7*c* and 7*d* measure a temperature in the length direction, and the data thereof is transmitted to the cooling stop temperature PC13. 7*c* and 6*c* are preferably used for the temperature management of an accelerated cooling material, and 7*d* and 6*d* are preferably used for the temperature management of a direct quenching material.

8, 8*b* through 8*d* denote optical fiber radiation thermometers, 8*b* measures a temperature distribution in the width direction and in the length direction of the lower surface of a steel plate immediately before accelerated cooling, and the data thereof is transmitted to the cooling start temperature collecting PC 12. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is used for the temperature management of an accelerated cooling material, and 8*d* is used for the temperature management of a direct quenching material.

Next, propagation flow wherein the steel plate temperature information measured by each thermometer is transmitted to each PC will be described with reference to FIG. 45 and FIG. 46. 11 denotes a controlled rolling start temperature+finishing temperature collecting PC, 12 denotes a cooling start temperature collecting PC, 13 denotes a cooling stop temperature collecting PC, and 14 denotes a measured temperature analyzing PC.

The temperature information of the upper surface of the steel plate measured by the spot type radiation thermometer 7 and the optical fiber radiation thermometer 8 installed on the upstream side of the finishing mill is transmitted to the controlled rolling start temperature+finishing temperature collecting PC 11 via the temperature collecting PC 15*a* for the upper surface of the steel plate, and the temperature collecting PC 16*a* for the lower surface of the steel plate, where rolling temperature management such as controlled rolling start temperature, rolling finishing temperature, and so forth, and management of the temperature distribution in the width direction and in the length direction of the steel plate are performed.

The temperature information of the upper surface of the steel plate measured by the spot type radiation thermometer 7*b* and the scanning radiation thermometer 6*b* installed on the upstream side of the accelerated cooling equipment 5, and the temperature information of the lower surface of the steel plate measured by the optical fiber radiation thermometer 8*b* are transmitted to the cooling start temperature collecting PC 12 via the temperature collecting PC 15*b* for the upper surface of the steel plate, and the temperature collecting PC 16*b* for the lower surface of the steel plate, where steel plate temperature management before accelerated cooling, and management of the temperature distribution in the length direction of the steel plate are performed.

The temperature information of the upper surface of the steel plate measured by the spot type radiation thermometers 7*c* and 7*d*, and the scanning radiation thermometers 6*c* and 6*d* installed on the downstream side of the accelerated cooling equipment 5, and the temperature information of the lower surface of the steel plate measured by the optical fiber radiation thermometers 8*c* and 8*d* are transmitted to the cooling stop temperature collecting PC 13 via the temperature collecting PC 15*c* for the upper surface of the steel plate, and the temperature collecting PC 16*c* for the lower surface of the steel plate, where accelerated cooling stop temperature management, and management of the temperature distribution in the length direction of the steel plate are performed.

Figure 46:
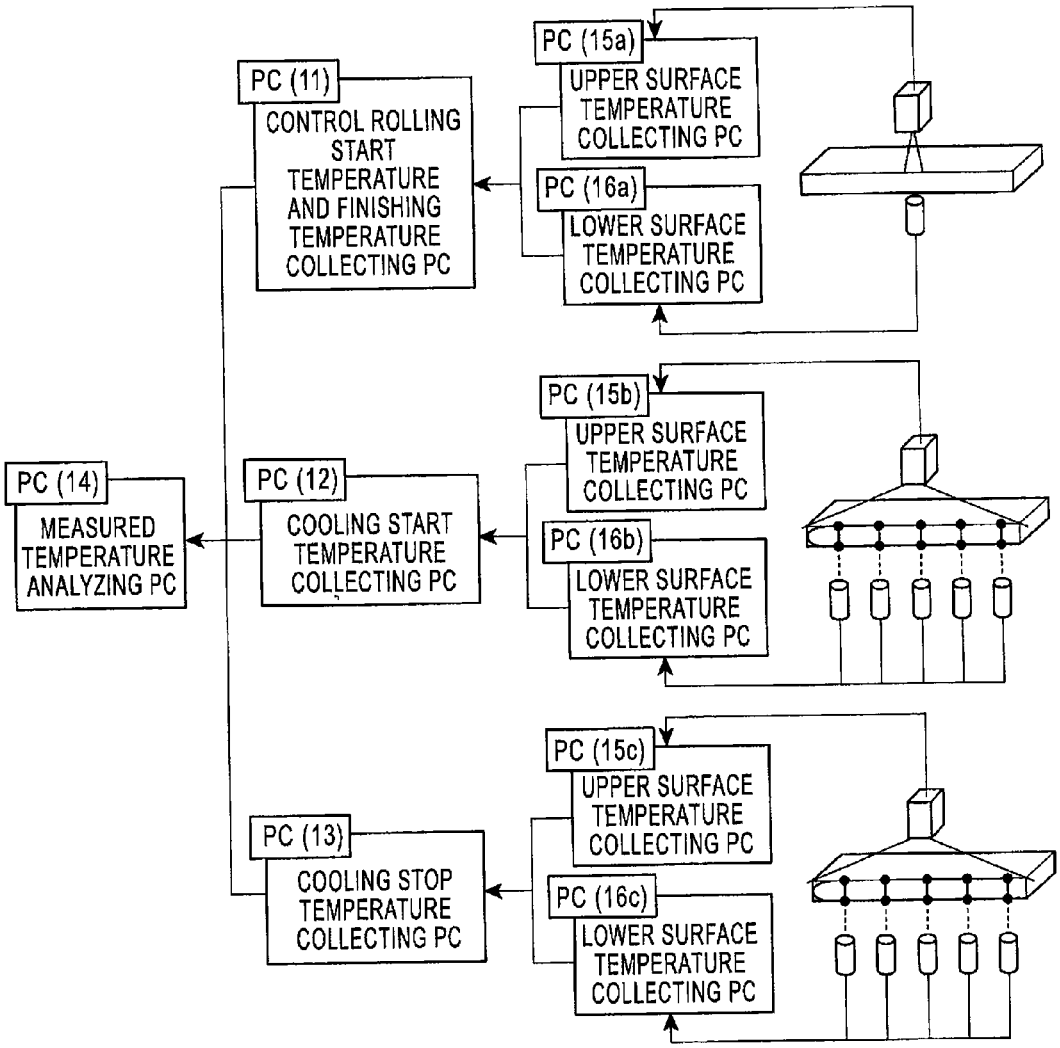
FIG. 46 is a diagram for describing propagation flow of temperature information of the upper and lower surfaces of a steel plate according to an embodiment of the present invention.

With regard to the controlled rolling start temperature+finishing temperature collecting PC 11, the cooling start temperature collecting PC 12, and the cooling stop temperature collecting PC 13, as illustrated in FIG. 46, the controlled rolling start temperature+finishing temperature collecting PC 11 is made up of the temperature collecting PC 15*a* for the upper surface of the steel plate, and the temperature collecting PC 16*a* for the lower surface of the steel plate, the cooling start temperature collecting PC 12 is made up of the temperature collecting PC 15*b* for the upper surface of the steel plate, and the temperature collecting PC 16*b* for the lower surface of the steel plate, the cooling stop temperature collecting PC 13 is made up of the temperature collecting PC 15*c* for the upper surface of the steel plate, and the temperature collecting PC 16*c* for the lower surface of the steel plate, and the steel plate temperature collected by each of the temperature collecting PCs of the upper and lower surfaces is input to the measured temperature analyzing PC 14 via the controlled rolling start temperature+finishing temperature collecting PC 11, the cooling start temperature collecting PC 12, and the cooling stop temperature collecting PC 13.

With the actual equipment production, the operating control temperature (controlled rolling start temperature+finishing temperature, cooling start temperature, and cooling stop temperature) range, and the measured temperature measurement input to the measured temperature analyzing PC 14 are compared, and quality determination is carried out, whereby the quality of the whole area of a steel plate can be assured. Note that the measured temperature analyzing PC 14 recognizes the whole temperature on the downstream side of the finishing mill, and on the downstream side of the accelerated cooling equipment, determines the quality from a particular threshold value, allowable temperature range, a calculation model of a mechanical property, and so forth, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby steel plate defective shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Fourteenth Embodiment

Figure 47:
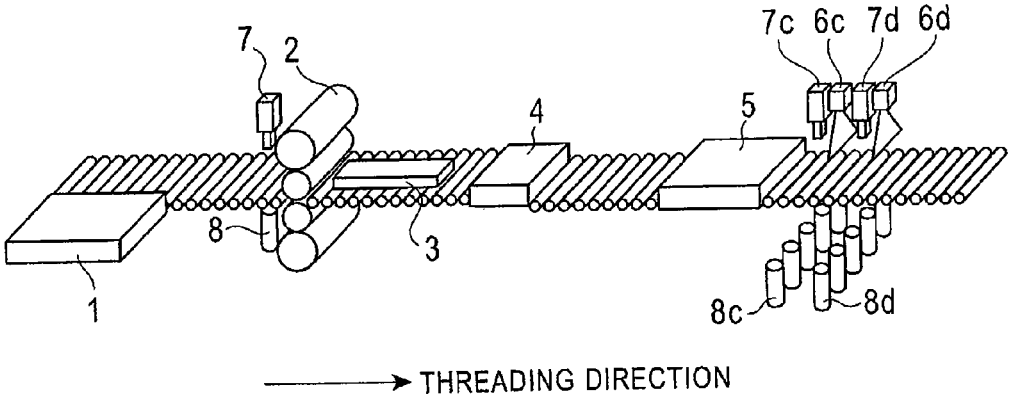
FIG. 47 is a diagram illustrating an embodiment of the outline of steel plate quality assurance equipment according to the present invention.
Figure 48:
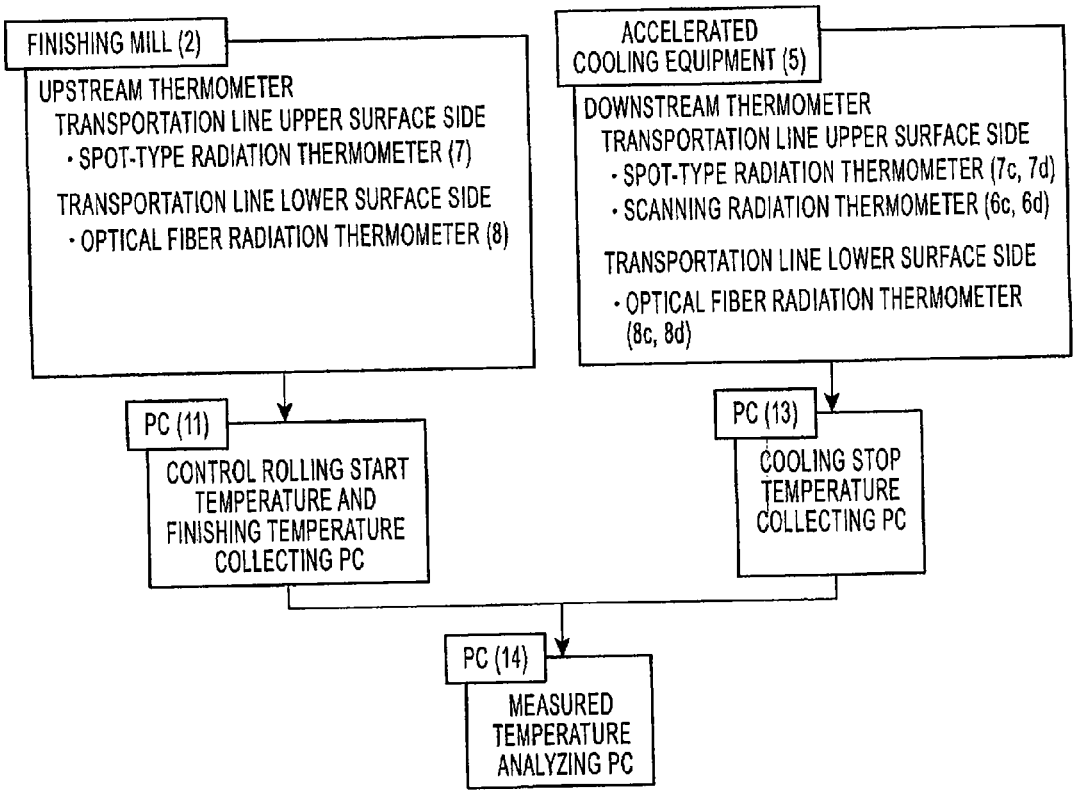
FIG. 48 is a diagram for describing propagation flow of temperature information according to an embodiment of the present invention.

FIG. 47 illustrates an embodiment of the outline of steel plate quality assurance equipment according to the present invention including the above steel plate temperature measurement means, and FIG. 48 illustrates propagation flow of temperature information according to an embodiment of the present invention.

A steel plate manufacturing line includes the heating furnace 1, finishing mill 2, CR cooling shower 4, and accelerated cooling equipment 5, and FIG. 47 illustrates a state in which the steel plate 3 is positioned between the finishing mill 2 and the CR cooling shower 4.

7, 7*c*, and 7*d* denote spot type radiation thermometers, 6*c* and 6*d* denote scanning radiation thermometers, 7 is installed just approximate to the finishing mill, and measures controlled rolling start temperature during rolling, and the data thereof is transmitted to the controlled rolling start temperature+finishing temperature collecting PC 11. 7*c*, 7*d*, 6*c*, and 6*d* are installed on the downstream side of the accelerated cooling equipment, 7*c* and 6*c* are high-temperature thermometers, 7*d* and 6*d* are low-temperature thermometers, 6*c* and 6*d* measure a temperature distribution in the width direction and in the length direction of the upper surface of the steel plate immediately after accelerated cooling, 7*c* and 7*d* measure a temperature in the length direction, and the data thereof is transmitted to the cooling stop temperature PC13. 7*c* and 6*c* are used for the temperature management of an accelerated cooling material, and 7*d* and 6*d* are used for the temperature management of a direct quenching material.

8, 8*c*, and 8*d* denote optical fiber radiation thermometers, 8 measures temperature in the length direction of the lower surface of a steel plate of the finishing mill, and the data thereof is transmitted to the controlled rolling start temperature+finishing temperature collecting PC 11. 8*c* and 8*d* are installed on the downstream side of the accelerated cooling equipment, 8*c* is a high-temperature thermometer, 8*d* is a low-temperature thermometer, both measure a temperature distribution in the width direction and in the length direction of the lower surface of the steel plate immediately after accelerated cooling, and the data thereof is transmitted to the cooling stop temperature collecting PC 13. 8*c* is used for the temperature management of an accelerated cooling material, and 8*d* is used for the temperature management of a direct quenching material.

Next, propagation flow wherein the steel plate temperature information measured by each thermometer is transmitted to each PC will be described with reference to FIG. 48 and FIG. 49. 11 denotes a controlled rolling start temperature+finishing temperature collecting PC, 13 denotes a cooling stop temperature collecting PC, and 14 denotes a measured temperature analyzing PC.

The temperature information of the upper surface of the steel plate measured by the spot type radiation thermometer 7 installed on the upstream side of the finishing mill is transmitted to the controlled rolling start temperature+finishing temperature collecting PC 11 via the temperature collecting PC 15*a* for the upper surface of the steel plate, and the temperature collecting PC 16*a* for the lower surface of the steel plate, where rolling temperature management such as controlled rolling start temperature, rolling finishing temperature, and so forth, and management of the temperature distribution in the length direction of the steel plate are performed.

The temperature information of the upper surface of the steel plate measured by the spot type radiation thermometers 7*c* and 7*d*, and the scanning radiation thermometers 6*c* and 6*d* installed on the downstream side of the accelerated cooling equipment 5, and the temperature information of the lower surface of the steel plate measured at the optical fiber radiation thermometers 8*c* and 8*d* are transmitted to the cooling stop temperature collecting PC 13 via the temperature collecting PC 15*c* for the upper surface of the steel plate, and the temperature collecting PC 16*c* for the lower surface of the steel plate, where accelerated cooling stop temperature management, and management of the temperature distribution in the width direction and in the length direction of the steel plate are performed.

Figure 49:
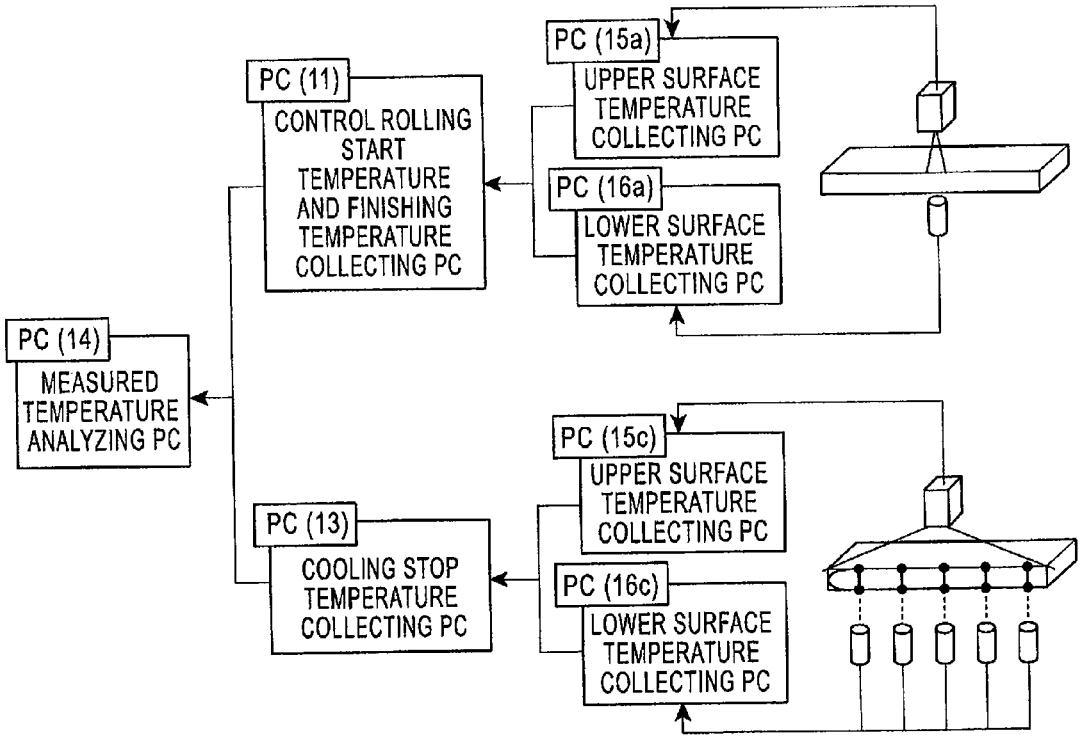
FIG. 49 is a diagram for describing propagation flow of temperature information of the upper and lower surfaces of a steel plate according to an embodiment of the present invention.

Each of the controlled rolling start temperature+finishing temperature collecting PC 11, and the cooling stop temperature collecting PC 13, as illustrated in FIG. 49, is made up of the temperature collecting PCs 15*a* and 15*c* for the upper surface of the steel plate, and the temperature collecting PCs 16*a* and 16*c* of the lower surface for the steel plate, and each of the temperatures of the upper surface of the steel plate, and the temperatures of the lower surface of the steel plate is input to the measured temperature analyzing PC 14.

With the actual equipment production, the operating control temperature (controlled rolling start temperature+finishing rolling temperature, and cooling stop temperature) range, and the measured temperature input to the measured temperature analyzing PC 14 are compared, and quality determination is carried out, whereby the quality of the whole area of a steel plate can be assured. Note that the measured temperature analyzing PC 14 recognizes the whole temperature on the upstream side of the finishing mill, and on the downstream side of the accelerated cooling equipment, determines the quality from a particular threshold value, allowable temperature range, a calculation model of a mechanical property, and so forth, and outputs the information of a cut portion whereby desired quality can be secured from a large plate.

Also, the temperature of the upper and lower surfaces of a slab in the heating furnace of the following plate and thereafter is adjusted from the temperature difference result of the upper and lower surfaces, and the water flow rate of the accelerated cooling equipment is controlled in the width direction and in the longitudinal direction from the temperature distribution in the width direction and in the longitudinal direction of a steel plate, whereby steel plate defective shape can be reduced.

According to aspects of the present invention, advantages have been obtained such that the reject ratio of a material test decreases around 30% as compared to that according to the related art, curvature deformation correction time is reduced around 20% as compared to that according to the related art, the defective shape of a steel plate is suppressed around 10% as compared to that according to the related art, and so forth.

Fifteenth Embodiment

Figure 7:
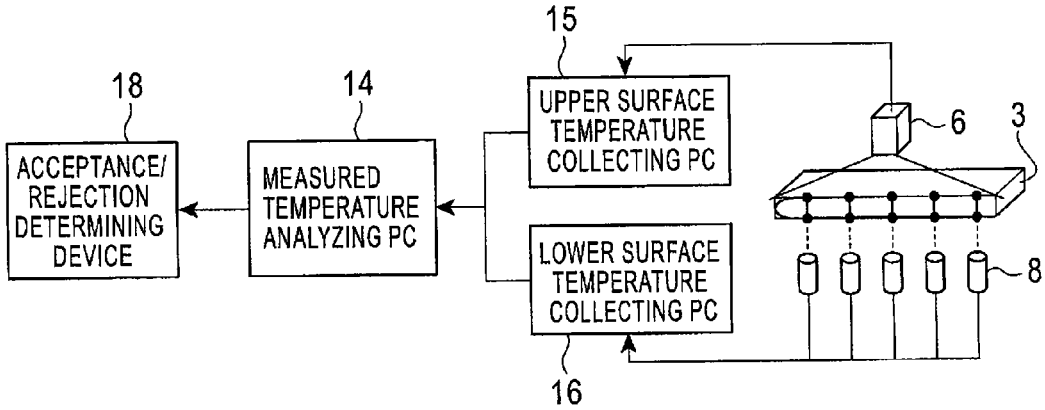
FIG. 7 is a diagram for describing the configuration of the temperature measurement system illustrated in FIG. 6.

FIG. 6 is a diagram for describing the outline of a whole equipment example for applying the present invention. FIG. 7 is a diagram illustrating a portion of the configuration of an acceptance/rejection determining device from temperature collection. In FIG. 6, 1 denotes a heating furnace, 2 denotes a finishing mill, 3 denotes a steel plate, 5 denotes cooling equipment, 6*a*, 6*b*, 6*c*, and 6*d* denote scanning radiation thermometers, 7, 7*a*, 7*b*, 7*c*, and 7*d* denote spot type radiation thermometers, 8, 8*a*, 8*b*, 8*c*, and 8*d* denote optical fiber radiation thermometers, 11 denotes a controlled rolling start temperature collecting PC, 13 denotes a cooling stop temperature collecting PC, 15 denotes a temperature collecting PC for the upper surface of a steel plate, 16 denotes a temperature collecting PC for the lower surface of a steel plate, 14 denotes a measured temperature analyzing PC, and 18 denotes an acceptance/rejection determining device. A steel plate manufacturing line includes the heating furnace 1, finishing mill 2, and accelerated cooling equipment 5, and FIG. 6 illustrates a state in which the steel plate 3 is positioned on the downstream side of the finishing mill 2 (downstream side).

For example, the temperature measured by the steel plate temperature measurement means made up of a scanning radiation thermometer 6*a* and an optical fiber radiation thermometer 8*a* disposed on the downstream side of the finishing mill is input to the controlled rolling start temperature+finishing temperature collecting PC 11. Also, the temperature measured by the temperature measurement means made up of a scanning radiation thermometer 6*c* and an optical fiber radiation thermometer 8*c* disposed on the downstream side of the cooling equipment 5 is input to the cooling stop temperature collecting PC 13.

The temperature collecting means are made up of the controlled rolling start temperature+finishing temperature collecting PC 11, and the cooling stop temperature collecting PC 13, each of which is made up of the temperature collecting PC 15 for the upper surface of a steel plate, and the temperature collecting PC 16 for the lower surface of the steel plate, each of the temperature of the upper surface of the steel plate, and the temperature of the lower surface of the steel plate is input to the measured temperature analyzing PC 14 that is temperature analyzing means (see FIG. 7). The measured temperature analyzing PC 14 calculates the temperature of the whole area of the upper and lower surfaces of the steel plate from the measured temperature input to the finishing temperature collecting PC 11 and the cooling stop temperature collecting PC 13.

With the manufacturing line, it is difficult due to occurrence of cooling water, falling of foreign objects, water vapor, or the like to measure the temperature distribution of the whole area particularly on the lower surface side of the steel plate of the transportation line. Therefore, as temperature measurement means, a scanning radiation thermometer capable of measuring a temperature distribution in the width direction is disposed on the upper surface (steel plate upper surface) side of the steel plate of the transportation line having a relatively good environment, but two or more (e.g., five) optical fiber radiation thermometers are disposed on the lower surface (lower surface of steel plate) of he transportation line having a poor environment. With regard to the lower surface of steel plate, the temperature distribution of the whole area cannot be measured, and accordingly, with the temperature calculating PC 13 for the whole area, the temperature distribution of the whole surface on the steel plate lower surface side is obtained by calculation from the temperature distribution measurement value of the whole area on the steel plate upper surface side, and the temperature measurement values of two or more points on the lower surface of steel plate side.

Subsequently, the acceptance/rejection determining device 18 compares the calculated temperature of the whole area of the steel plate upper and lower surfaces, and the operating control temperature (steel plate finishing rolling temperature of steel plate, cooling stop temperature) to perform acceptance/rejection determination regarding whether or not the calculated temperature is include in a range.

Figure 16:
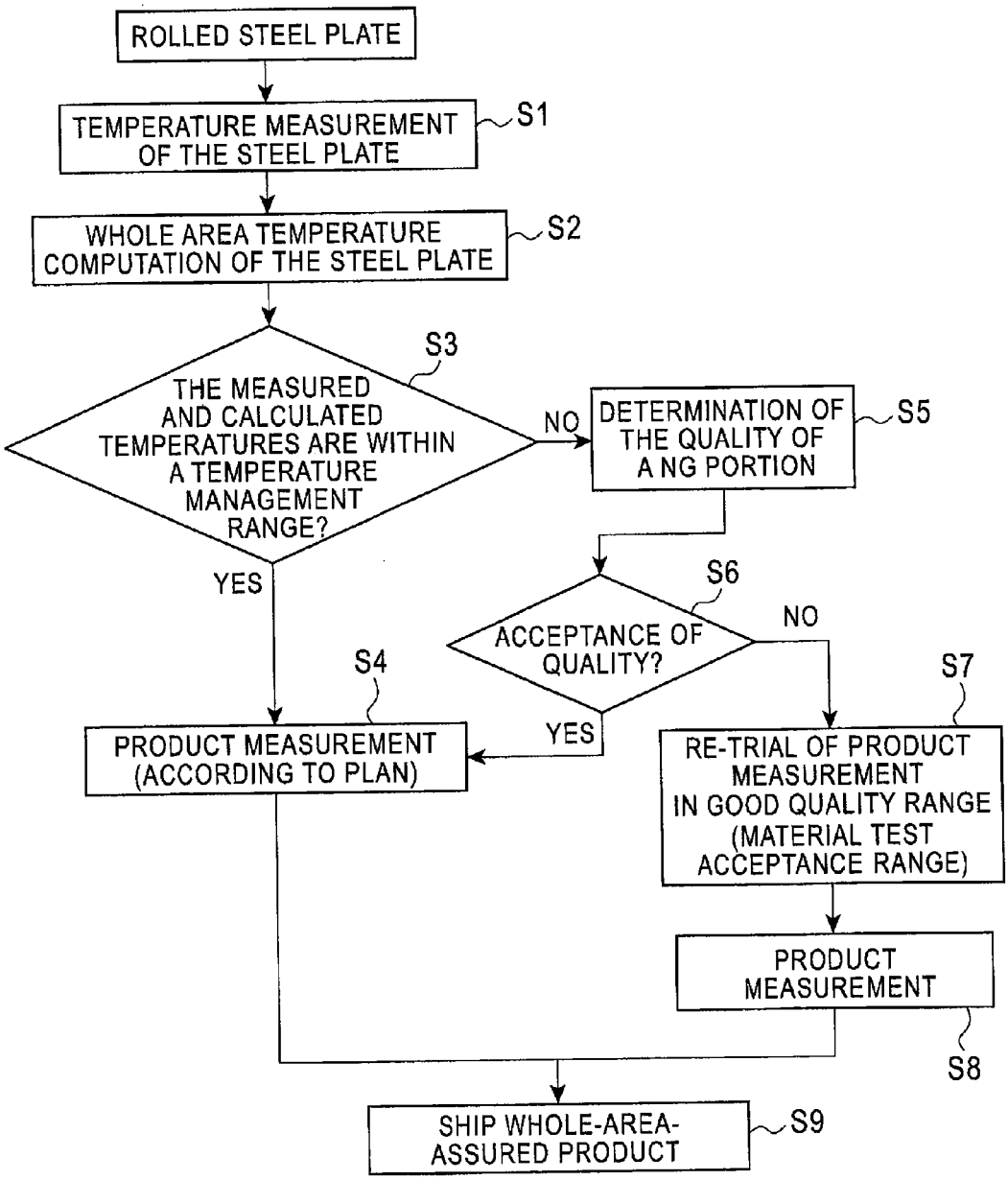
FIG. 16 is a flowchart illustrating a processing procedure of a steel plate quality determination method according to an embodiment of the present invention.

FIG. 16 is a flowchart illustrating a processing procedure example of a steel plate quality determining method according to an embodiment of the present invention. First, after the temperature distributions of the upper and lower surfaces of a rolled steel plate are measured by the temperature measurement means (the upper surface side of the steel plate is measured by a scanning radiation thermometer, the lower surface side of the steel plate is measured by an optical fiber radiation thermometer), and is input to the temperature collecting PC (finishing temperature collecting PC or cooling temperature collecting PC) (S1).

In S1, the temperature of the whole area has been measured regarding the steel plate upper surface side, but the temperature of the whole area has not been measured, and accordingly, the temperature of the whole area on the steel plate lower surface side is calculated by the temperature analyzing means (measured temperature analyzing PC) (S2). Subsequently, the (later-described) calculated temperature of the whole area of the steel plated upper and lower surface sides are compared with the operating control temperature (steel plate finishing temperature, cooling stop temperature) to perform acceptance/rejection determination regarding whether or not the calculated temperature is included in an allowable temperature range (S3).

Subsequently, if the calculated temperature is included in an allowable temperature range at all of the locations thereof (Yes in S3), product measurement is performed (S4), and in the event of being out of range (No in S3), quality determination of this out-of-range region is performed (S5). With regard to the quality determination of this out-of-range region, quality determination is performed using past result data indicating the relationship between test results by the past quality test device, and steel plate manufacturing conditions including other than the temperature measurement value. In the event that there is a location of which the quality has not been passed in S6, in order to avoid the rejected portion, the blank layout size is corrected so as to perform product measurement within a good quality range (S7), and product measurement is performed (S8).

Also, in the event that the quality has been passed in S6, product measurement is performed with the blank layout size according to plan (S4). Thus, a whole-area-quality-assured product may be shipped (S9). Also, the shape may be improved across the whole area of the shape.

Figure 17:
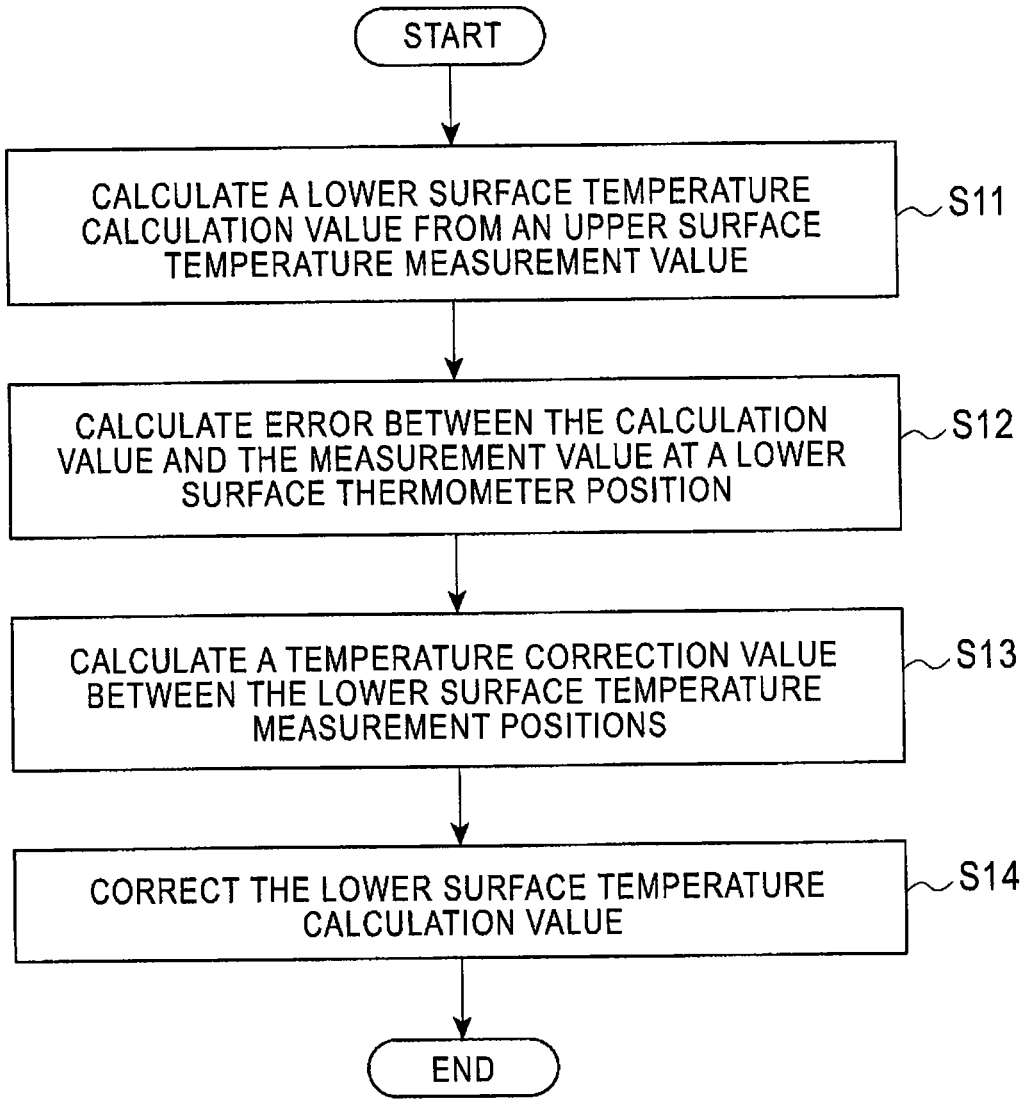
FIG. 17 is a flowchart illustrating a processing procedure of temperature calculation of the whole area of the upper and lower surfaces of a steel plate.

FIG. 17 is a flowchart illustrating a processing procedure example of the temperature calculation of the whole area of the steel plate lower surface indicated in S2 in FIG. 16.

Description will be made in the following in accordance with the drawing. Description will be made regarding an example in the event that the temperature on the steel plate upper surface side is measured by a scanning temperature thermometer, and the temperature on the steel plate lower surface side is measured in the width direction at five points.

Figure 18:
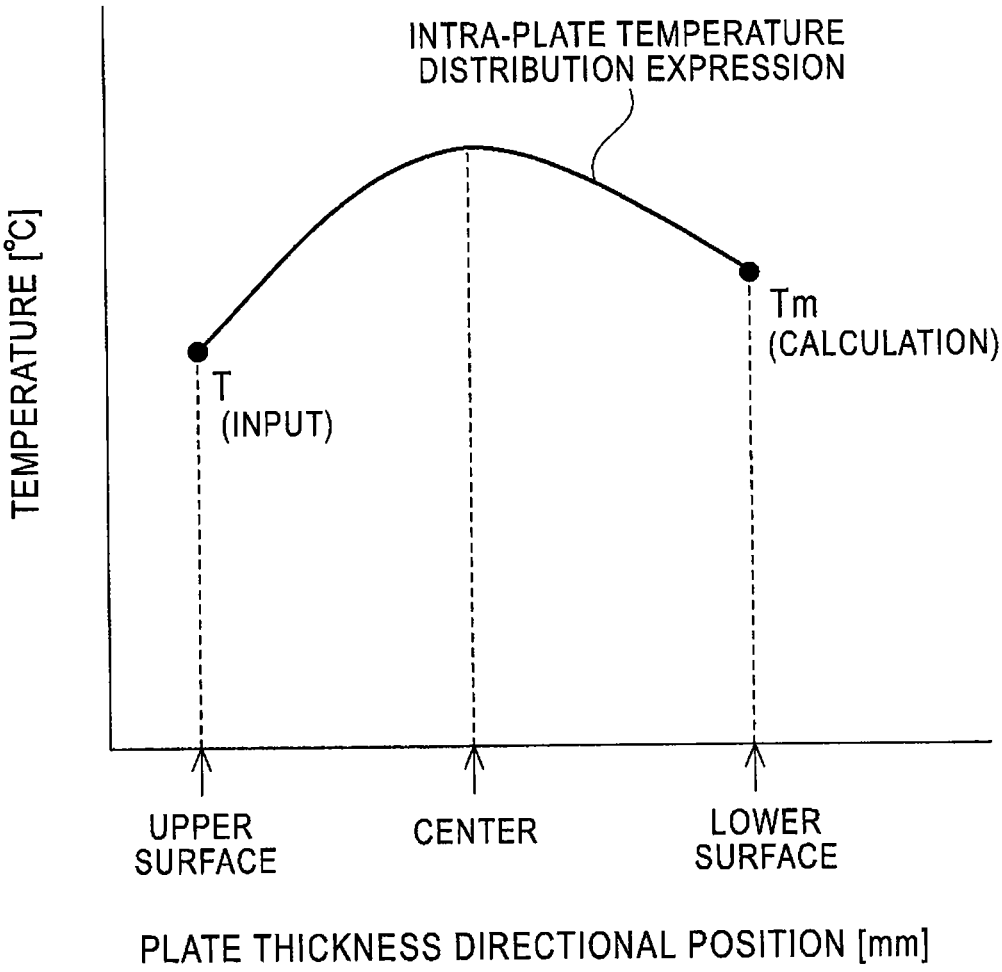
FIG. 18 is a diagram for describing a calculation method of the temperature calculation value of the lower surface of a steel plate.

First, an intra-plate temperature distribution expression is used to calculate a temperature calculation value Tm on the lower surface of a steel plate from a temperature measurement value T on the steel plate upper surface side (S11). FIG. 18 is a diagram for describing a calculation method of a temperature calculation value on the lower surface of the steel plate. Here, the intra-plate temperature distribution expression is an expression for providing an intra-plate temperature distribution in the plate thickness direction, and accordingly, a solution method expression of a theoretical heat transfer expression, or a regression expression of measured temperature should be employed. The temperature measurement value on the upper surface side of the steel plate, and the plate thickness are input to this temperature distribution expression to calculate the temperature of a position on the lower surface side of the steel plate corresponding to a position where temperature has been measured on the upper surface side of the steel plate (the positions in the longitudinal direction and in the width direction are the same as those on the upper surface side of the steel plate).

Figure 19:
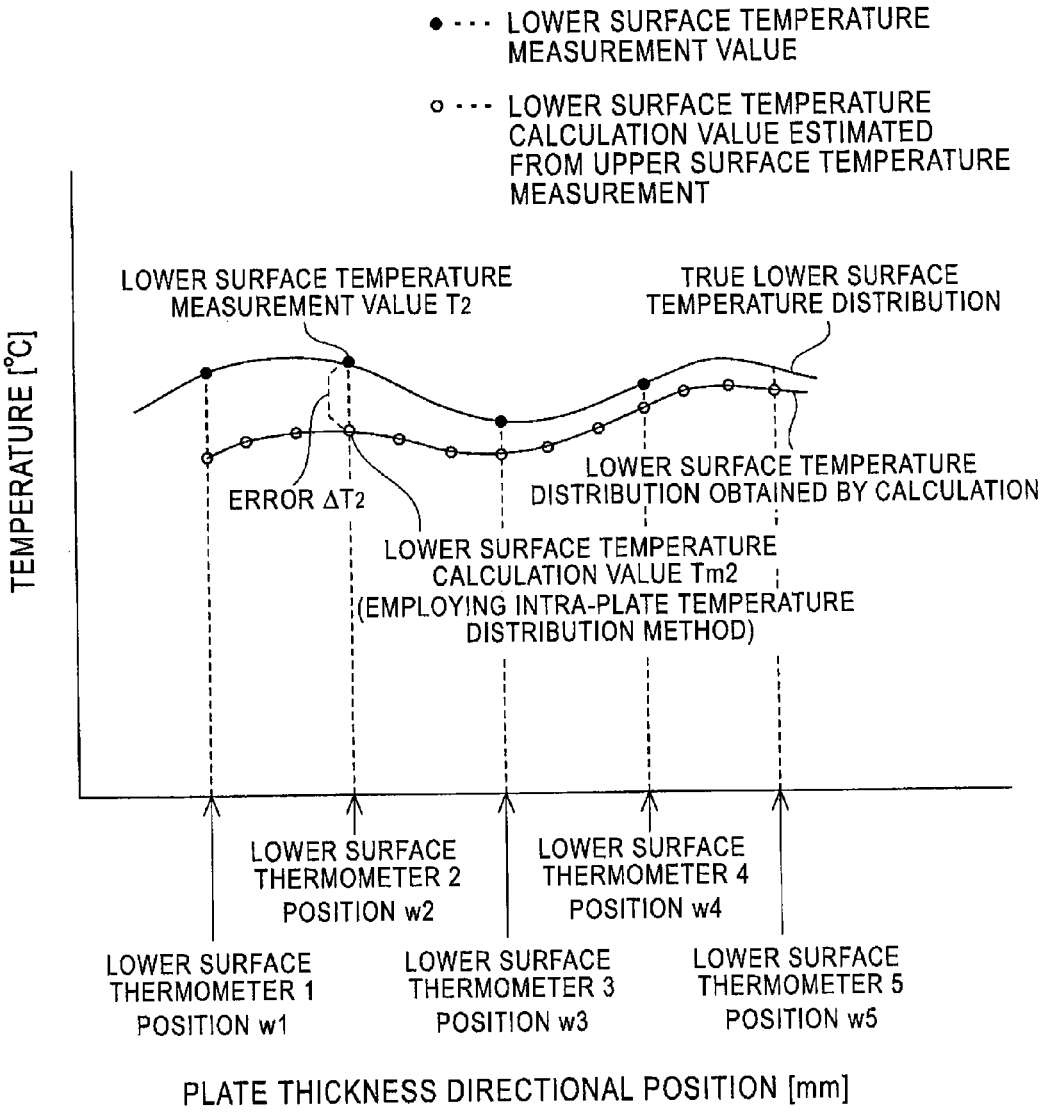
FIG. 19 is a diagram illustrating a positional relationship between the temperature measurement value and the temperature calculation value of the lower surface of a steel plate in the plate-width direction.

Next, the error of the temperature measurement value on the lower surface side of the steel plate calculated in S11 is obtained (S12). FIG. 19 is a diagram illustrating the positional relationship between the temperature measurement value on the lower surface of the steel plate in the plate width direction, and the temperature calculated value. The temperature calculation value on the lower surface side of the steel plate is calculated from a measured value on the upper surface side of the steel plate measured by a scanning radiation thermometer, the calculation values of a great number of positions (e.g., several millimeter interval) may be obtained (representative points alone are displayed in FIG. 19). Among of these, error as to the temperature measurement value is obtained regarding a temperature calculation value of which the position is matched with a temperature measurement value on the lower surface side of the steel measured by an optical fiber radiation thermometer (five points in the width direction). Subsequently, this error becomes the temperature correction value of the temperature calculation value at this position. Note that the temperature measurement positions on the upper surface side of the steel plate and on the lower surface side of the steel plate are preferably as close as possible.

Next, the correction value of a temperature calculation value at other than a temperature measurement position on the lower surface side of the steel plate is obtained from the error (correction value) obtained in S12 (S13). FIG. 20 is a diagram illustrating a procedure example for calculating the correction values of temperature calculation values between adjacent temperature measurement positions $w_i$, $w_{i+1}$ (i=1, 2, . . . ) on the lower surface side of the steel plate. Here, a temperature collection value ΔTw at a width position w is calculated from error at positions $w_i$, $w_{i+1}$ by being interpolated through linear interpolation according to the width direction w, and specifically is calculated by the following Expression (1).

[Equation 1]

$$\Delta Tw = \frac{\Delta T_{i+1} - \Delta T_i}{w_{i+1} - w_i} \times (w - w_i) + \Delta T_i \quad (1)$$

Here, w: width position where the temperature calculation value is obtained, $Tm_i$: temperature calculation value at the width position $w_i$, $Tm_{i+i}$: temperature calculation value at the width position $w_{i+1}$, Ti: temperature measurement value at the width position $w_i$ on the lower surface side of the steel plate, $T_{i+1}$: temperature measurement value at the width position $w_{i+1}$ on the lower surface side of the steel plate, ΔT: error at the width position $w_i$ on the lower surface side of the steel plate, $\Delta T_{i+1}$: error at the width position $w_{i+1}$ on the lower surface side of the steel plate.

Note that description has been made regarding an example wherein interpolation is performed by linear interpolation using two points, but various interpolation methods may be employed such that the error change amount is obtained by linear interpolation.

Next, the correction value ΔTw obtained in S13 is used to perform correction of the temperature calculation value on the lower surface of the steel plate by the following Expression (2), thereby obtaining the temperature distribution on the lower surface of the steel plate (S14). At this time, with regard to the measurement position of an optical fiber radiation thermometer, error in S12 becomes a correction value.

[Equation 2]

$$Tmw' = Tmw + \Delta Tw \quad (2)$$

Here, Tmw': temperature calculation value after correction at the width position w, Tmw: temperature calculation value before correction at the width position w.

Sixteenth Embodiment

Figure 15:
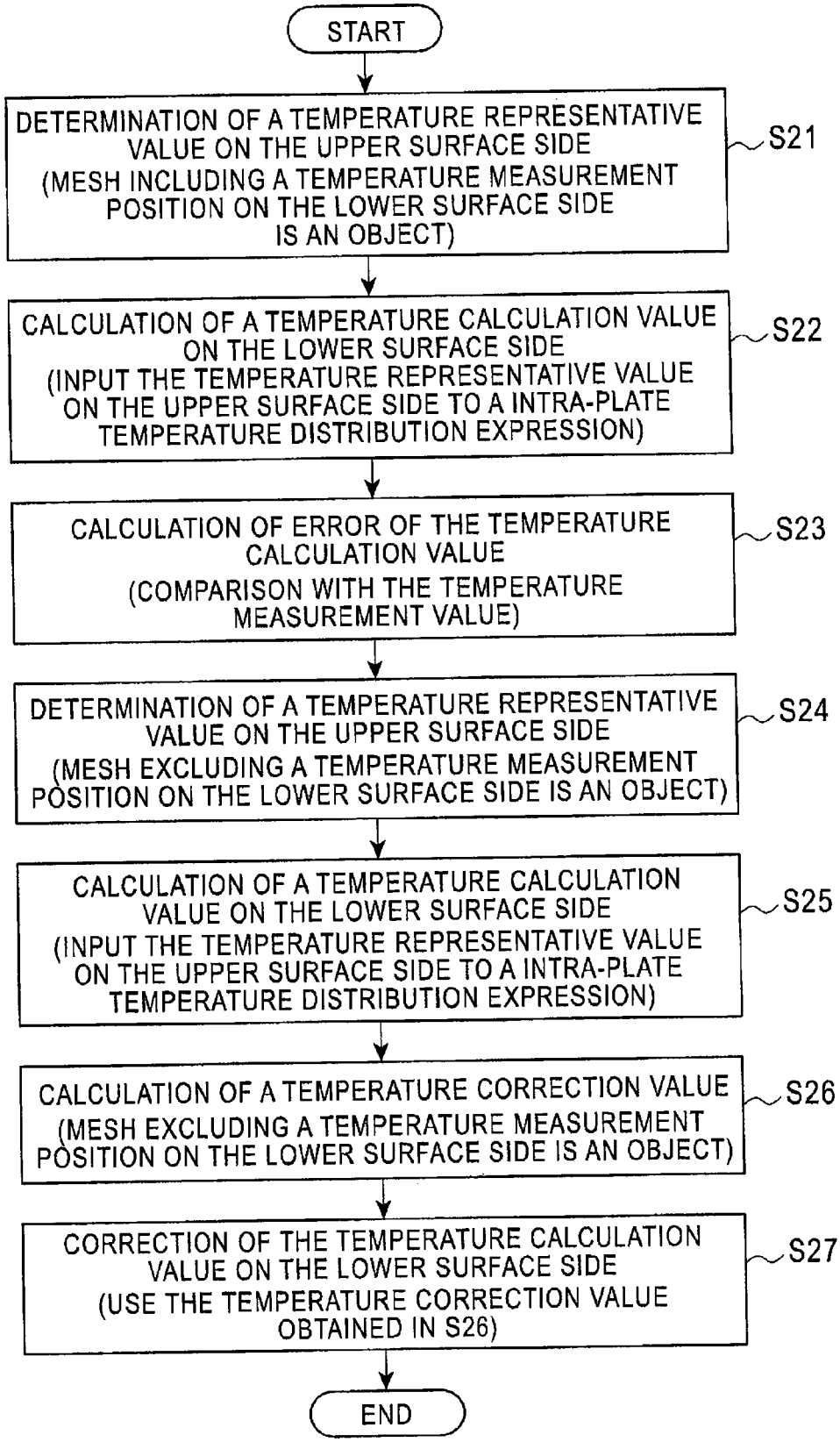
FIG. 15 is a flowchart illustrating a procedure for measuring and calculating temperature of the whole area of the upper and lower surfaces of a steel plate.

The present embodiment differs from the first embodiment in that, with the calculation processing, the whole area of the steel plate is delimited by mesh and divided into two or more regions, and other points are the same, and accordingly, the different points will be described with reference to FIGS. 21, 15, and 22.

Figure 21:
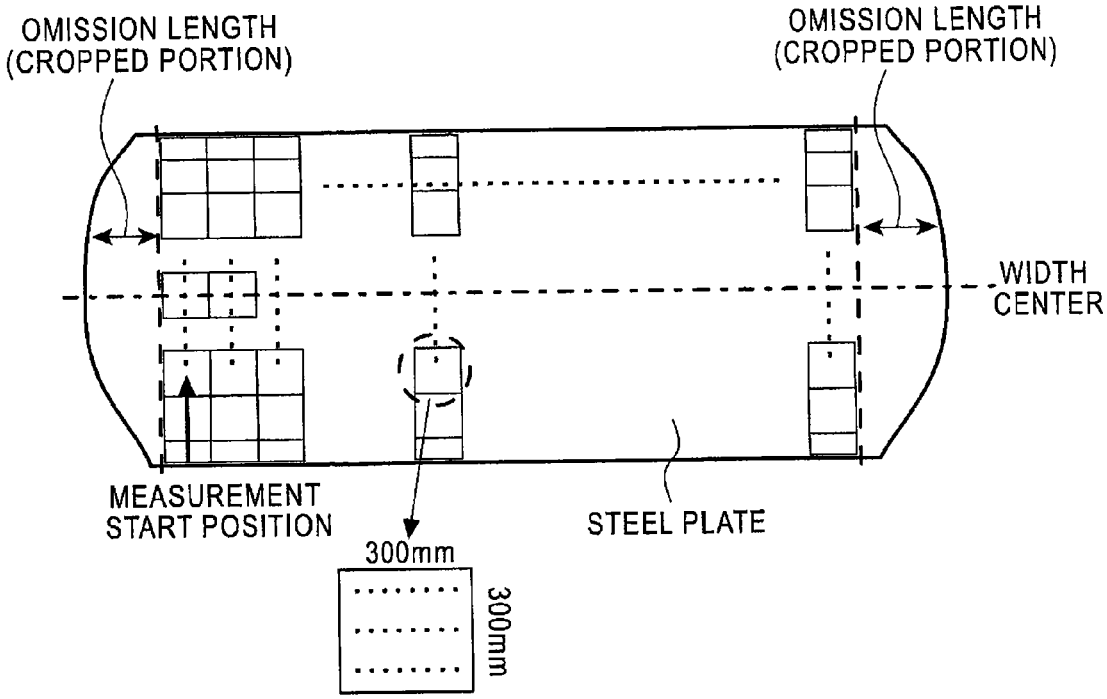
FIG. 21 is a diagram for describing how to cut mesh on a steel plate.
Figure 22:
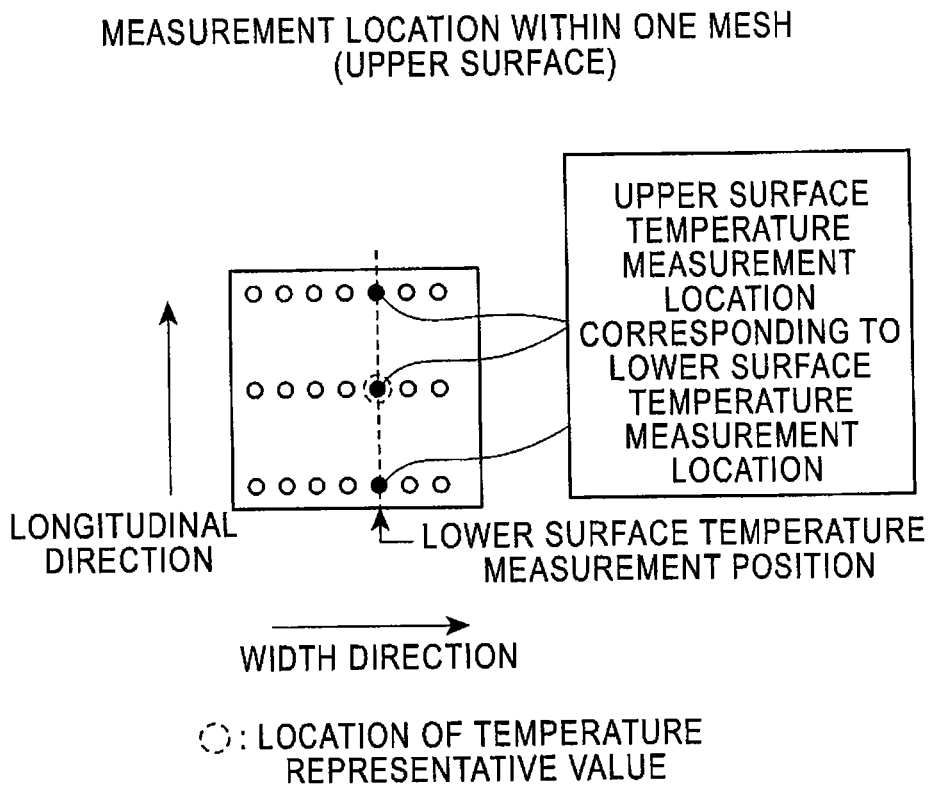
FIG. 22 is a diagram for describing how to determine a temperature representative value on the upper surface side of a steel plate within mesh including a temperature measurement position of the lower surface of the steel plate.

FIG. 21 is a diagram for describing how to cut mesh on a steel plate, and represents a scene in which the center in the width direction of the steel plate is matched with the center of the mesh, and is divided by 300×300 mm (width×length) mesh for example. The size of the mesh may be set in accordance with a measurement object and conditions as appropriate (e.g., 200 through 1000 mm or the like). Management is made with a temperature representative value within the mesh thus determined. Here, the temperature representative value is temperature representing the mesh, and for example, one of the maximum temperature, the minimum temperature, mean temperature, and so forth except for apparent abnormal values is employed. Hereafter, the maximum temperature will be described as an example. Here, employing the maximum temperature as a representative temperature is preferable in that data including the measurement error (temperature specification lower than the true value) of a radiation thermometer due to influence of water spread or water vapor on the upper surface of the steel plate can be removed. Hereafter, the maximum temperature will be described as an example. Note that both edge portions in the width direction (unsteady portion) and omission length (cropped portion) are usually taken as out of an object range.

As illustrated in FIG. 21, description will be made regarding a flowchart illustrating a procedure for measuring or calculating temperature of the whole area of the upper and lower surfaces of the steel plate, which is a region divided from the mesh such as illustrated in FIG. 21, with reference to FIG. 15.

First, determination of a temperature representative value on the upper surface side of the steel plate is performed with the mesh including temperature measurement positions on the lower surface side of the steel plate as an object (S21). FIG. 22 is a diagram for describing how to determine the temperature representative value on the upper surface side of the steel plate within the mesh including the temperature measurement positions of the lower surface of the steel plate. Temperature measurement points on the upper surface side of the steel plate are represented with a white circle mark or black circle mark of the mesh including the temperature measurement positions of the lower surface of the steel plate, black circle marks (three points) of these, are positions to be matched with the temperature measurement positions of the lower surface of the steel plate, and the temperature measurement values matched with the temperature measurement positions of the lower surface of the steel plate are temperature representative value candidates. Subsequently, the maximum temperature of these three points is taken as the temperature representative value. In the drawing, the location of the temperature representative value is represented with a black circle mark surrounded with a dashed line circle mark (the middle of the three points). Note that in the event that the mean temperature is taken as the temperature representative value, an addition average is obtained from the temperature of a black circle mark excluding an abnormal value.

Next, the temperature calculation value of the lower surface of the steel plate is calculated from the temperature representative value on the upper surface side of the steel plate obtained in S21 (S22). A procedure for calculating the temperature calculation value on the lower surface side of the steel plate from the temperature representative value on the upper surface side of the steel plate may be obtained in the same procedure by replacing the temperature measurement value on the upper surface side of the steel plate according to the first embodiment with the temperature value.

Next, error of the temperature calculation value on the lower surface side of the steel plate calculated in S22 as to the temperature measurement value is obtained (S23). This error is also the temperature correction value of the temperature calculation value of the mesh. The above processing from S21 to S23 is performed with the mesh including all of the thermometer positions of the lower surface of the steel plate (five meshes in the event that the temperature of the lower surface has been measured at five points).

Next, processing is performed with a mesh excluding the temperature measurement positions of the lower surface of the steel plate as an object. In the same way as in S21, determination of the temperature representative value of the upper surface of the steel plate is performed (S24). The temperature representative value within a mesh (e.g., the maximum temperature excluding an apparent abnormal value) is determined. Further, in the same way as in S22, calculation of the temperature calculation value of the lower surface of the steel plate is performed using an intra-plate temperature distribution method (S25).

Next, the correction value of the temperature calculation value of the lower surface of the steel plate is calculated (S26). The calculation procedure of a correction value mentioned here is the same as in S13 of the fifteenth embodiment. Error between the temperature measured value on the lower surface side of the steel plate obtained in S23, and the calculation value, i.e., based on the correction value on the position thereof, the correction value of the temperature calculation value of a mesh excluding the thermometers of the lower surface of the steel plate, positioned between meshes including the thermometer positions of the lower surface of the steel plate, is calculated by linear interpolation or curve interpolation or the like from a relative positional relationship of meshes.

Thus the obtained correction value is used to correct the temperature calculation value of the lower surface of the steel plate calculated in S25, thereby determining the temperature of the mesh thereof (S27). In the event that the above processing has been performed for all of the meshes not corresponding to the temperature measurement positions of the lower surface of the steel plate, the processing for all the widths ends.

Subsequently, next, the next mesh in the longitudinal direction is sequentially subjected to the processing in S21 through S27, and in the event that the processing has been completed for all the set meshes, calculation of the temperature of the whole area of the upper and lower surfaced of the steel plate ends.

According to aspects of the present invention described above, with a quality design, alloying elements to be added may be reduced by reducing the margin cost of a material property, and consequently, manufacturing cost may be reduced. Also, the target temperature range may be extended, so, a material having strict quality specifications can be manufactured with an accelerated cooling process after rolling.

Also, the temperature of the whole area is subjected to acceptance/rejection determination, whereby outflow of a quality rejected portion can be prevented. Further, cooling water flow rate in cooling equipment is adjusted based on the measured temperature of a quality rejected material, whereby quality rejected materials can be reduced (quality rejected ratio is reduced from 0.11% to 0.08%).

The invention claimed is:

1. Steel plate temperature assurance equipment comprising, together with a steel plate manufacturing line including a finishing mill and accelerated cooling equipment disposed above a transportation line on the downstream side of said finishing mill as to the advancing direction of the steel plate manufacturing line:

temperature measurement means configured to measure steel plate temperature at least on the upstream side or downstream side of said finishing mill, and at least on the upstream side or downstream side of said accelerated cooling equipment; and measured temperature analyzing means configured to analyze the steel plate temperature measured by said temperature measurement means;

wherein said temperature measurement means further includes a first temperature measurement means that includes a scanning radiation thermometer disposed on the downstream side of said accelerated cooling equipment so as to scan the plate width direction thereby measuring a width direction temperature distribution of the plate;

wherein said temperature measurement means comprises a second temperature measurement means that includes an optical fiber radiation thermometer installed at least on the upstream side or downstream side of said finishing mill, and at least on the upstream side or downstream side of said accelerated cooling equipment, and installed at least on the lower surface side of said transportation line steel plate;

and wherein said measured temperature analyzing means obtains steel plate temperature from the temperature measured by said temperature measurement means;

said first temperature measurement means being configured to measure a surface temperature distribution of one surface side selected from the upper surface of a steel plate and the lower surface of a steel plate;

said second temperature measurement means being configured to measure a surface temperature distribution of the surface side different from the surface side to be measured by said first temperature measurement means, at the corresponding position measured by the first temperature measurement means;

wherein the number of measurement points to be measured by the second temperature measurement means is smaller than the number of measurement points to be measured by said first temperature measurement means; and said measured temperature analyzing means comprising means configured to calculate the surface temperature of a measurement location of said second temperature measurement means from temperature measured by said first temperature measurement means, to obtain calculation error from the difference between the calculated temperature and the temperature measured by said second temperature measurement means, and to calculate surface temperature other than the measurement locations of said second temperature measurement means using the calculation error.

2. A steel plate material determining method, wherein the material of a steel plate is determined using temperature measured by said first temperature measurement means and said second temperature measurement means, and the temperature calculated by said temperature calculating means, of the steel plate temperature assurance equipment according to claim 1.

3. A steel plate manufacturing method including use of the steel plate temperature assurance equipment according to claim 1, wherein, with manufacturing of a following plate to the steel plate previously manufactured in the steel plate manufacturing line, the operating condition of at least one of a heating furnace on the upstream side of the finishing mill to heat a slab to be rolled into the steel plate, the finishing mill, and the cooling equipment is controlled to prevent a defective shape based on a difference of the steel plate temperature distribution from the temperature distribution whereby a suitable dimensional shape is obtained wherein the steel plate temperature distribution is measured by the steel plate temperature assurance equipment.

4. The steel plate manufacturing method according to claim 3, wherein in order to prevent a defective shape, while controlling the heating furnace, at least one of a temperature of the upper and lower surface of the steel plate and a gas flow rate of the upper and lower surface of the steel plate within the heating furnace is controlled, and in the event of controlling the finishing mill, at least one of a rolling speed of upper and lower rolls and a descaling water flow rate of the upper and lower surface of the steel plate is controlled, and in the event of controlling the cooling equipment, at least one of a water flow rate distribution in the plate width direction, the plate length direction or a water flow rate of the upper and lower surface of the steel plate is controlled.

* * * * *